US009407024B2

(12) United States Patent
Wu et al.

(10) Patent No.: US 9,407,024 B2
(45) Date of Patent: Aug. 2, 2016

(54) MULTIDIRECTIONAL ELECTRICAL CONNECTOR, PLUG AND SYSTEM

(71) Applicant: Gogoro Inc., Hong Kong (CN)

(72) Inventors: Yi-Tsung Wu, New Taipei (TW); Sung-Ching Lin, New Taipei (TW); Chen-Shin Hsu, New Taipei (TW); Yu-Min Chen, New Taipei (TW)

(73) Assignee: GOGORO INC., Hong Kong (CN)

( * ) Notice: Subject to any disclaimer, the term of this patent is extended or adjusted under 35 U.S.C. 154(b) by 0 days.

(21) Appl. No.: 14/822,562

(22) Filed: Aug. 10, 2015

(65) Prior Publication Data

US 2016/0043505 A1 Feb. 11, 2016

Related U.S. Application Data

(60) Provisional application No. 62/140,282, filed on Mar. 30, 2015, provisional application No. 62/035,788, filed on Aug. 11, 2014.

(51) Int. Cl.

| | |
|---|---|
| ***H01R 13/627*** | (2006.01) |
| ***H01R 13/11*** | (2006.01) |
| ***H01R 24/38*** | (2011.01) |
| ***H01R 35/02*** | (2006.01) |

(Continued)

(52) U.S. Cl.

CPC ..... *H01R 13/11* (2013.01); *H01R 24/38* (2013.01); *H01R 35/02* (2013.01); *H01R 35/04* (2013.01); *H01R 24/58* (2013.01)

(58) Field of Classification Search

CPC ..... H01R 13/6272; H01R 4/01

USPC ..... 439/352, 161, 353, 357, 675, 851

See application file for complete search history.

(56) References Cited

U.S. PATENT DOCUMENTS

| | | | |
|---|---|---|---|
| 1,387,848 | A | 8/1921 | Good |
| 3,470,974 | A | 10/1969 | Pefine |

(Continued)

FOREIGN PATENT DOCUMENTS

| | | | |
|---|---|---|---|
| CA | 2 797 507 | A1 | 5/2011 |
| CA | 2 865 976 | A1 | 9/2013 |

(Continued)

OTHER PUBLICATIONS

Taiwanese Office Action dated Dec. 25, 2015, for corresponding TW Application No. 101127034, with English Translation, 7 pages.

(Continued)

*Primary Examiner* — Phuongchi T Nguyen

(74) *Attorney, Agent, or Firm* — Seed IP Law Group PLLC

(57) ABSTRACT

Multidirectional electrical connectors, electrical connector plugs and electrical connection systems for electrically connecting a portable energy storage device to an electrically powered device, such as an electric powered vehicle or a device for electrically charging the portable electrical energy storage device are described. The multidirectional feature of the electrical connectors, electrical connector plugs and electrical connections systems permits electrical connection between the electrical connectors and electrical connector plugs in a plurality of rotational orientations between a portable electrical energy storage device to which a connector or plug is electrically connected and an electrically powered device to which a corresponding plug or connector is electrically connected.

25 Claims, 27 Drawing Sheets

(51) Int. Cl.
*H01R 35/04* (2006.01)
*H01R 24/58* (2011.01)

(56) References Cited

U.S. PATENT DOCUMENTS

D221,081 S 7/1971 Kahn
3,664,450 A 5/1972 Udden et al.
3,678,455 A 7/1972 Levey
3,687,484 A 8/1972 Cosby
3,708,028 A 1/1973 Hafer
D227,773 S 7/1973 Yardley et al.
4,087,895 A 5/1978 Etienne
4,129,759 A 12/1978 Hug
4,216,839 A 8/1980 Gould et al.
4,669,570 A 6/1987 Perret
4,799,902 A * 1/1989 Laudig ..... H01R 24/562 439/580
4,849,944 A * 7/1989 Matsushita ..... G11C 5/143 361/212
4,867,690 A * 9/1989 Thumma ..... H01R 12/727 439/631
5,187,423 A 2/1993 Marton
5,189,325 A 2/1993 Jarczynski
5,236,069 A 8/1993 Peng
5,339,250 A 8/1994 Durbin
5,349,535 A 9/1994 Gupta
5,376,869 A 12/1994 Konrad
5,491,486 A 2/1996 Welles, II et al.
5,544,784 A 8/1996 Malaspina
5,596,261 A 1/1997 Suyama
5,627,752 A 5/1997 Buck et al.
5,631,536 A 5/1997 Tseng
5,642,270 A 6/1997 Green et al.
5,648,897 A 7/1997 Johnson et al.
5,711,648 A 1/1998 Hammerslag
5,815,824 A 9/1998 Saga et al.
5,839,800 A 11/1998 Koga et al.
5,898,282 A 4/1999 Drozdz et al.
5,929,608 A 7/1999 Ibaraki et al.
5,998,963 A 12/1999 Aarseth
6,016,882 A 1/2000 Ishikawa
6,094,028 A 7/2000 Gu et al.
6,154,006 A 11/2000 Hatanaka et al.
6,177,867 B1 1/2001 Simon et al.
6,177,879 B1 1/2001 Kokubu et al.
6,236,333 B1 5/2001 King
6,403,251 B1 6/2002 Baggaley et al.
6,429,622 B1 8/2002 Svensson
6,494,279 B1 12/2002 Hutchens
6,498,457 B1 12/2002 Tsuboi
6,515,580 B1 2/2003 Isoda et al.
D472,209 S 3/2003 Wada et al.
D472,210 S 3/2003 Tada et al.
D476,294 S 6/2003 Tada et al.
6,583,592 B2 6/2003 Omata et al.
D476,620 S 7/2003 Tada et al.
6,593,713 B2 7/2003 Morimoto et al.
6,614,204 B2 9/2003 Pellegrino et al.
6,621,244 B1 9/2003 Kiyomiya et al.
6,796,396 B2 9/2004 Kamen et al.
6,822,560 B2 11/2004 Geber et al.
6,854,773 B2 2/2005 Lin
6,899,268 B2 5/2005 Hara
6,917,306 B2 7/2005 Lilja
6,952,795 B2 10/2005 O'Gorman et al.
7,010,682 B2 3/2006 Reinold et al.
7,066,739 B2 * 6/2006 McLeish ..... H01R 13/6205 439/39
7,111,179 B1 9/2006 Girson et al.
7,131,005 B2 10/2006 Levenson et al.
7,392,068 B2 6/2008 Dayan et al.
D573,948 S 7/2008 Itagaki et al.
7,415,332 B2 8/2008 Ito et al.
7,426,910 B2 9/2008 Elwart
D582,416 S 12/2008 Duarte et al.
7,495,543 B2 2/2009 Denison et al.
D588,537 S 3/2009 Allen
7,567,166 B2 7/2009 Bourgine De Meder
7,592,728 B2 9/2009 Jones et al.
7,596,709 B2 9/2009 Cooper et al.
D603,792 S 11/2009 Ferro
7,617,893 B2 11/2009 Syed et al.
7,630,181 B2 12/2009 Wilk et al.
7,698,044 B2 4/2010 Prakash et al.
7,728,548 B2 6/2010 Daynes et al.
7,761,307 B2 7/2010 Ochi et al.
7,778,746 B2 8/2010 McLeod et al.
7,863,858 B2 1/2011 Gangstoe et al.
7,868,591 B2 1/2011 Phillips et al.
7,898,439 B2 3/2011 Bettez et al.
7,908,020 B2 3/2011 Pieronek
7,923,144 B2 4/2011 Kohn et al.
7,948,207 B2 5/2011 Scheucher
7,979,147 B1 7/2011 Dunn
7,993,155 B2 8/2011 Heichal et al.
8,006,793 B2 8/2011 Heichal et al.
8,006,973 B2 8/2011 Toba et al.
8,013,571 B2 9/2011 Agassi et al.
8,035,341 B2 10/2011 Genzel et al.
8,035,349 B2 10/2011 Lubawy
8,063,762 B2 11/2011 Sid
8,068,952 B2 11/2011 Valentine et al.
8,098,050 B2 1/2012 Takahashi
8,106,631 B2 1/2012 Abe
8,118,132 B2 2/2012 Gray, Jr.
8,164,300 B2 4/2012 Agassi et al.
8,219,839 B2 7/2012 Akimoto
8,229,625 B2 7/2012 Lal et al.
8,265,816 B1 9/2012 LaFrance
8,301,365 B2 10/2012 Niwa et al.
8,319,605 B2 11/2012 Hassan et al.
8,326,259 B2 12/2012 Gautama et al.
8,348,678 B2 * 1/2013 Hardisty ..... H01R 13/6205 439/39
8,354,768 B2 1/2013 Cipriani
8,355,965 B2 1/2013 Yamada
8,378,627 B2 2/2013 Asada et al.
8,412,401 B2 4/2013 Bertosa et al.
8,437,908 B2 5/2013 Goff et al.
8,447,598 B2 5/2013 Chutorash et al.
8,560,147 B2 10/2013 Taylor et al.
8,564,241 B2 10/2013 Masuda
D693,765 S 11/2013 Workman et al.
8,614,565 B2 12/2013 Lubawy
8,725,135 B2 5/2014 Weyl et al.
D711,820 S 8/2014 Zeng
8,798,852 B1 8/2014 Chen et al.
8,825,250 B2 9/2014 Luke et al.
8,862,304 B2 10/2014 Chen et al.
8,862,388 B2 10/2014 Wu et al.
8,878,487 B2 11/2014 Wu et al.
8,901,861 B2 12/2014 Luke et al.
D723,462 S 3/2015 Druker et al.
8,996,188 B2 3/2015 Frader-Thompson et al.
8,996,212 B2 3/2015 Chen et al.
8,996,308 B2 3/2015 Wu et al.
D733,050 S 6/2015 Chiang
D733,651 S 7/2015 Liu
D738,302 S 9/2015 Jeong et al.
2001/0018903 A1 9/2001 Hirose et al.
2001/0052433 A1 12/2001 Harris et al.
2002/0023789 A1 2/2002 Morisawa et al.
2002/0026252 A1 2/2002 Wruck et al.
2002/0070851 A1 6/2002 Raichle et al.
2003/0052796 A1 3/2003 Schmidt et al.
2003/0141840 A1 7/2003 Sanders
2003/0163434 A1 8/2003 Barends
2003/0209375 A1 11/2003 Suzuki et al.
2004/0002266 A1 1/2004 Hinkle et al.
2004/0130292 A1 7/2004 Buchanan et al.
2004/0236615 A1 11/2004 Msndy
2004/0246119 A1 12/2004 Martin et al.
2006/0047380 A1 3/2006 Welch
2006/0208850 A1 9/2006 Ikeuchi et al.

(56) References Cited

U.S. PATENT DOCUMENTS

2006/0284601 A1 12/2006 Salasoo et al.
2007/0026996 A1 2/2007 Ayabe et al.
2007/0035397 A1 2/2007 Patenaude et al.
2007/0069687 A1 3/2007 Suzuki
2007/0090921 A1 4/2007 Fisher
2007/0126395 A1 6/2007 Suchar
2007/0145945 A1 6/2007 McGinley et al.
2007/0159297 A1 7/2007 Paulk et al.
2007/0208468 A1 9/2007 Sankaran et al.
2007/0238164 A1 10/2007 Kim
2008/0015721 A1 1/2008 Spearman
2008/0067974 A1 3/2008 Zhang et al.
2008/0143292 A1 6/2008 Ward
2008/0154801 A1 6/2008 Fein et al.
2008/0276110 A1 11/2008 Indiani et al.
2008/0281732 A1 11/2008 Yamada
2009/0024872 A1 1/2009 Beverly
2009/0033456 A1 2/2009 Castillo et al.
2009/0045773 A1 2/2009 Pandya et al.
2009/0082957 A1 3/2009 Agassi et al.
2009/0112394 A1 4/2009 Lepejian et al.
2009/0158790 A1 6/2009 Oliver
2009/0198372 A1 8/2009 Hammerslag
2009/0261779 A1 10/2009 Zyren
2009/0294188 A1 12/2009 Cole
2010/0012406 A1 1/2010 Kressner et al.
2010/0013433 A1 1/2010 Baxter et al.
2010/0017045 A1 1/2010 Nesler et al.
2010/0026238 A1 2/2010 Suzuki et al.
2010/0051363 A1 3/2010 Inoue et al.
2010/0052588 A1 3/2010 Okamura et al.
2010/0089547 A1 4/2010 King et al.
2010/0094496 A1 4/2010 Hershkovitz et al.
2010/0114798 A1 5/2010 Sirton
2010/0114800 A1 5/2010 Yasuda et al.
2010/0134067 A1 6/2010 Baxter et al.
2010/0145717 A1 6/2010 Hoeltzel
2010/0161481 A1 6/2010 Littrell
2010/0188043 A1 7/2010 Kelty et al.
2010/0191585 A1 7/2010 Smith
2010/0198535 A1 8/2010 Brown et al.
2010/0198754 A1 8/2010 Jones et al.
2010/0201482 A1 8/2010 Robertson et al.
2010/0225266 A1 9/2010 Hartman
2010/0235043 A1 9/2010 Seta et al.
2010/0250043 A1 9/2010 Scheucher
2010/0262312 A1 10/2010 Kubota et al.
2010/0308989 A1 12/2010 Gasper
2010/0324800 A1 12/2010 Hanft et al.
2011/0016063 A1 1/2011 Pollack et al.
2011/0025263 A1 2/2011 Gilbert
2011/0025267 A1 2/2011 Kamen et al.
2011/0029157 A1 2/2011 Muzaffer
2011/0032110 A1 2/2011 Taguchi
2011/0055037 A1 3/2011 Hayashigawa et al.
2011/0071932 A1 3/2011 Agassi et al.
2011/0082598 A1 4/2011 Boretto et al.
2011/0082621 A1 4/2011 Berkobin et al.
2011/0095723 A1 4/2011 Bhade et al.
2011/0106329 A1 5/2011 Donnelly et al.
2011/0111644 A1 5/2011 Jin
2011/0112710 A1 5/2011 Meyer-Ebeling et al.
2011/0114798 A1 5/2011 Gemmati
2011/0120789 A1 5/2011 Teraya
2011/0148346 A1 6/2011 Gagosz et al.
2011/0153141 A1 6/2011 Beechie et al.
2011/0156662 A1 6/2011 Nakamura et al.
2011/0160992 A1 6/2011 Crombez
2011/0169447 A1 7/2011 Brown et al.
2011/0191265 A1 8/2011 Lowenthal et al.
2011/0200193 A1 8/2011 Blitz et al.
2011/0202476 A1 8/2011 Nagy et al.
2011/0218703 A1 9/2011 Uchida
2011/0224868 A1 9/2011 Collings, III et al.
2011/0224900 A1 9/2011 Hiruta et al.
2011/0241824 A1 10/2011 Uesugi
2011/0260691 A1 10/2011 Ishibashi et al.
2011/0270480 A1 11/2011 Ishibashi et al.
2011/0279257 A1 11/2011 Au et al.
2011/0282527 A1 11/2011 Inbarajan et al.
2011/0292667 A1 12/2011 Meyers
2011/0295454 A1 12/2011 Meyers
2011/0303509 A1 12/2011 Agassi et al.
2012/0000720 A1 1/2012 Honda et al.
2012/0013182 A1 1/2012 Minegishi et al.
2012/0019196 A1 1/2012 Fung
2012/0038473 A1 2/2012 Fecher
2012/0058682 A1 3/2012 Huang
2012/0062361 A1 3/2012 Kosugi
2012/0068817 A1 3/2012 Fisher
2012/0078413 A1 3/2012 Baker, Jr.
2012/0105078 A1 5/2012 Kikuchi et al.
2012/0109519 A1 5/2012 Uyeki
2012/0123661 A1 5/2012 Gray, Jr.
2012/0126969 A1 5/2012 Wilbur et al.
2012/0157083 A1 6/2012 Otterson
2012/0158229 A1 6/2012 Schaefer
2012/0167071 A1 6/2012 Paek
2012/0194346 A1 8/2012 Tsai et al.
2012/0223575 A1 9/2012 Hachiya et al.
2012/0233077 A1 9/2012 Tate, Jr. et al.
2012/0248868 A1 10/2012 Mobin et al.
2012/0248869 A1 10/2012 Itagaki et al.
2012/0253567 A1 10/2012 Levy et al.
2012/0256588 A1 10/2012 Hayashi et al.
2012/0259665 A1 10/2012 Pandhi et al.
2012/0271723 A1 10/2012 Penilla et al.
2012/0280573 A1 11/2012 Ohkura et al.
2012/0296512 A1 11/2012 Lee et al.
2012/0299527 A1 11/2012 Vo
2012/0299537 A1 11/2012 Kikuchi
2012/0299721 A1 11/2012 Jones
2012/0316671 A1 12/2012 Hammerslag et al.
2012/0319649 A1 12/2012 Billmaier
2013/0024306 A1 1/2013 Shah et al.
2013/0026971 A1 1/2013 Luke et al.
2013/0026972 A1 1/2013 Luke et al.
2013/0026973 A1 1/2013 Luke et al.
2013/0027183 A1 1/2013 Wu et al.
2013/0030580 A1 1/2013 Luke et al.
2013/0030581 A1 1/2013 Luke et al.
2013/0030630 A1 1/2013 Luke et al.
2013/0030920 A1 1/2013 Wu et al.
2013/0046457 A1 2/2013 Pettersson
2013/0074411 A1 3/2013 Ferguson et al.
2013/0078867 A1 3/2013 ChongYu et al.
2013/0093271 A1 4/2013 Luke et al.
2013/0093368 A1 4/2013 Luke et al.
2013/0093384 A1 4/2013 Nyu et al.
2013/0116892 A1 5/2013 Wu et al.
2013/0119898 A1 5/2013 Ohkura
2013/0127416 A1 5/2013 Karner et al.
2013/0132307 A1 5/2013 Phelps et al.
2013/0151049 A1 6/2013 Higashitani et al.
2013/0164573 A1 6/2013 Williams et al.
2013/0166119 A1 6/2013 Kummer et al.
2013/0179061 A1 7/2013 Gadh et al.
2013/0181582 A1 7/2013 Luke et al.
2013/0200845 A1 8/2013 Bito
2013/0207605 A1 8/2013 Errattuparambil et al.
2013/0221928 A1 8/2013 Kelty et al.
2013/0254097 A1 9/2013 Marathe et al.
2013/0282254 A1 10/2013 Dwan et al.
2013/0345935 A1 12/2013 Chang
2014/0028089 A1 1/2014 Luke et al.
2014/0053620 A1 2/2014 Taylor et al.
2014/0111121 A1 4/2014 Wu
2014/0142786 A1 5/2014 Huang et al.
2014/0163813 A1 6/2014 Chen et al.
2014/0253021 A1 9/2014 Luke et al.
2014/0266006 A1 9/2014 Luke et al.
2014/0277844 A1 9/2014 Luke
2014/0279576 A1 9/2014 Luke

(56) References Cited

U.S. PATENT DOCUMENTS

| | | | |
|---|---|---|---|
| 2014/0368032 | A1 | 12/2014 | Doerndorfer |
| 2015/0123468 | A1 | 5/2015 | Wu et al. |
| 2015/0153967 | A1 | 6/2015 | Chen et al. |

FOREIGN PATENT DOCUMENTS

| | | | |
|---|---|---|---|
| CN | 1211844 | A | 3/1999 |
| CN | 101071953 | A | 11/2007 |
| CN | 102007418 | A | 4/2011 |
| CN | 102064565 | A | 5/2011 |
| CN | 101950998 | B | 9/2012 |
| DE | 44 32 539 | A1 | 6/1995 |
| DE | 10 2007 045 633 | A1 | 4/2009 |
| DE | 11 2008 000 424 | T5 | 12/2009 |
| DE | 10 2009 016 869 | A1 | 10/2010 |
| DE | 10 2010 039 075 | A1 | 2/2011 |
| EP | 0 693 813 | A1 | 1/1996 |
| EP | 1 177 955 | A2 | 2/2002 |
| EP | 1 667 306 | A1 | 6/2006 |
| EP | 1 798 100 | A2 | 6/2007 |
| EP | 0 902 521 | B1 | 12/2008 |
| EP | 2 101 390 | A2 | 9/2009 |
| EP | 2 110 923 | A1 | 10/2009 |
| EP | 2 182 575 | A1 | 5/2010 |
| EP | 2 230 146 | A2 | 9/2010 |
| EP | 2 428 939 | A1 | 3/2012 |
| JP | 5-135804 | A | 6/1993 |
| JP | 7-31008 | A | 1/1995 |
| JP | 7-36504 | U | 7/1995 |
| JP | 9-119839 | A | 5/1997 |
| JP | 10-170293 | A | 6/1998 |
| JP | 10-307952 | A | 11/1998 |
| JP | 11-49079 | A | 2/1999 |
| JP | 11-51681 | A | 2/1999 |
| JP | 11-176487 | A | 7/1999 |
| JP | 11-205914 | A | 7/1999 |
| JP | 11-296606 | A | 10/1999 |
| JP | 2000-102102 | A | 4/2000 |
| JP | 2000-102103 | A | 4/2000 |
| JP | 2000-341868 | A | 12/2000 |
| JP | 2001-23037 | A | 1/2001 |
| JP | 2001-57711 | A | 2/2001 |
| JP | 2001-128301 | A | 5/2001 |
| JP | 2002-140398 | A | 5/2002 |
| JP | 2002-269195 | A | 9/2002 |
| JP | 2002-324264 | A | 11/2002 |
| JP | 2003-102110 | A | 4/2003 |
| JP | 2003-118397 | A | 4/2003 |
| JP | 2003-262525 | A | 9/2003 |
| JP | 2004-215468 | A | 7/2004 |
| JP | 2005-67453 | A | 3/2005 |
| JP | 2006-121874 | A | 5/2006 |
| JP | 2006-331405 | A | 12/2006 |
| JP | 2007-35479 | A | 2/2007 |
| JP | 2007-60353 | A | 3/2007 |
| JP | 2007-148590 | A | 6/2007 |
| JP | 2007-182310 | A | 7/2007 |
| JP | 2007-325458 | A | 12/2007 |
| JP | 2008-127894 | A | 6/2008 |
| JP | 2008-219953 | A | 9/2008 |
| JP | 2008-285075 | A | 11/2008 |
| JP | 2009-8609 | A | 1/2009 |
| JP | 2009-512035 | A | 3/2009 |
| JP | 2009-103504 | A | 5/2009 |
| JP | 2009-171646 | A | 7/2009 |
| JP | 2009-171647 | A | 7/2009 |
| JP | 2009-526344 | A | 7/2009 |
| JP | 4319289 | B2 | 8/2009 |
| JP | 2009-303364 | A | 12/2009 |
| JP | 2010-022148 | A | 1/2010 |
| JP | 2010-081722 | A | 4/2010 |
| JP | 2010-108833 | A | 5/2010 |
| JP | 2010-148246 | A | 7/2010 |
| JP | 2010-172122 | A | 8/2010 |
| JP | 2010-179764 | A | 8/2010 |
| JP | 2010-186238 | A | 8/2010 |
| JP | 2010-191636 | A | 9/2010 |
| JP | 2010-200405 | A | 9/2010 |
| JP | 2010-212048 | A | 9/2010 |
| JP | 2010-213555 | A | 9/2010 |
| JP | 2010-263781 | A | 11/2010 |
| JP | 2010-269686 | A | 12/2010 |
| JP | 2010-540907 | A | 12/2010 |
| JP | 2011-83166 | A | 4/2011 |
| JP | 2011-118638 | A | 6/2011 |
| JP | 2011-142704 | A | 7/2011 |
| JP | 2011-142779 | A | 7/2011 |
| JP | 2011-233470 | A | 11/2011 |
| JP | 2012-503468 | A | 2/2012 |
| JP | 2012-151916 | A | 8/2012 |
| JP | 2012-526409 | A | 10/2012 |
| KR | 1998-045020 | U | 9/1998 |
| KR | 2004-0005146 | A | 1/2004 |
| KR | 10-2009-0103431 | A | 10/2009 |
| KR | 2010-0012401 | A | 2/2010 |
| KR | 10-0971278 | B1 | 7/2010 |
| KR | 2011-004292 | A | 1/2011 |
| KR | 2011-0041783 | A | 4/2011 |
| KR | 2012-0020554 | A | 3/2012 |
| TW | 477099 | B | 2/2002 |
| TW | 2008-0036452 | A | 9/2008 |
| TW | I303508 | B | 11/2008 |
| TW | I315116 | B | 9/2009 |
| TW | M371880 | U1 | 1/2010 |
| TW | M379269 | U1 | 4/2010 |
| TW | M379789 | U1 | 5/2010 |
| TW | M385047 | U1 | 7/2010 |
| TW | 201043986 | A1 | 12/2010 |
| TW | 201044266 | A1 | 12/2010 |
| TW | 201105985 | A | 2/2011 |
| TW | 201112579 | A | 4/2011 |
| WO | 98/21132 | A1 | 5/1998 |
| WO | 99/03186 | A1 | 1/1999 |
| WO | 2009/039454 | A1 | 3/2009 |
| WO | 2010/005052 | A2 | 1/2010 |
| WO | 2010/033517 | A2 | 3/2010 |
| WO | 2010/033881 | A1 | 3/2010 |
| WO | 2010/035605 | A1 | 4/2010 |
| WO | 2010/115573 | A1 | 10/2010 |
| WO | 2010/143483 | A1 | 12/2010 |
| WO | 2011/138205 | A1 | 11/2011 |
| WO | 2012/085992 | A1 | 6/2012 |
| WO | 2012/160407 | A1 | 11/2012 |
| WO | 2012/160557 | A2 | 11/2012 |
| WO | 2013/024483 | A2 | 2/2013 |
| WO | 2013/024484 | A1 | 2/2013 |
| WO | 2013/042216 | A1 | 3/2013 |
| WO | 2013/074819 | A1 | 5/2013 |
| WO | 2013/080211 | A1 | 6/2013 |
| WO | 2013/102894 | A1 | 7/2013 |
| WO | 2013/108246 | A2 | 7/2013 |
| WO | 2013/118113 | A2 | 8/2013 |
| WO | 2013/128007 | A2 | 9/2013 |
| WO | 2013/128009 | A2 | 9/2013 |
| WO | 2013/128009 | A3 | 9/2013 |
| WO | 2013/142154 | A1 | 9/2013 |
| WO | 2013/144951 | A1 | 10/2013 |

OTHER PUBLICATIONS

Chinese Office Action dated Sep. 28, 2015, for corresponding CN Application No. 201280046879, with English Translation, 18 pages.

International Search Report and Written Opinion mailed Dec. 15, 2015, for corresponding International Application No. PCT/US2015/047946, 10 pages.

International Search Report and Written Opinion mailed Nov. 11, 2015, for corresponding International Application No. PCT/US2015/044480, 8 pages.

Japanese Office Action dated Dec. 22, 2015, for corresponding JP Application No. 2014-523019, with English translation, 22 pages.

"Inrunner," retrieved from URL=http://en.wikipedia.org/w/index.php?title=Inrunner&printable=yes on Sep. 28, 2011, 1 page.

(56) References Cited

OTHER PUBLICATIONS

"Outrunner," retrieved from URL=http://en.wikipedia.org/w/index.php?title=Outrunner&printable=yes on Sep. 16, 2011, 2 pages.
Chen et al., "Apparatus, Method and Article for Providing Vehicle Diagnostic Data," Office Action mailed Jun. 3, 2015, for U.S. Appl. No. 14/179,442, 20 pages.
Chen et al., "Apparatus, System, and Method for Authentication of Vehicular Components ," U.S. Appl. No. 61/783,041, filed Mar. 14, 2013, 84 pages.
Chen et al., "Apparatus, System, and Method for Authentication of Vehicular Components," Office Action mailed Nov. 22, 2013, for U.S. Appl. No. 13/918,703, 35 pages.
Chen et al., "Adjusting Electric Vehicle Systems Based on an Electrical Energy Storage Device Thermal Profile," U.S. Appl. No. 61/862,854, filed Aug. 6, 2013, 74 pages.
Chen et al., "Apparatus, Method and Article for Providing Vehicle Diagnostic Data," Office Action mailed Dec. 30, 2013, for U.S. Appl. No. 14/022,134, 20 pages.
Chen et al., "Apparatus, Method and Article for Providing Vehicle Diagnostic Data," Office Action mailed Apr. 9, 2014, for U.S. Appl. No. 14/022,134, 20 pages.
Chen et al., "Apparatus, Method and Article for Providing Vehicle Diagnostic Data," Notice of Allowance mailed Jul. 9, 2014, for U.S. Appl. No. 14/022,134, 10 pages.
Chen et al., "Apparatus, Method and Article for Providing Vehicle Diagnostic Data," Office Action mailed Jun. 18, 2014, for U.S. Appl. No. 13/559,390, 16 pages.
Chen et al., "Apparatus, Method and Article for Providing Vehicle Diagnostic Data," Notice of Allowance mailed Nov. 3, 2014, for U.S. Appl. No. 13/559,390, 10 pages.
Chen et al., "Apparatus, Method and Article for Providing Vehicle Diagnostic Data," U.S. Appl. No. 61/601,404, filed Feb. 21, 2012, 56 pages.
Chen et al., "Apparatus, System, and Method for Authentication of Vehicular Components," Notice of Allowance mailed Mar. 25, 2014, for U.S. Appl. No. 13/918,703, 7 pages.
Chen et al., "Systems and Methods for Powering Electric Vehicles Using a Single or Multiple Power Cells," U.S. Appl. No. 61/862,852, filed Aug. 6, 2013, 46 pages.
Chinese Office Action with English Translation dated Jul. 31, 2015, for corresponding CN Application No. 201280046976.1, 45 pages.
Communication pursuant to Rules 161(2) and 162 EPC, for corresponding European Patent Application No. 12817273.1, dated Mar. 25, 2014, 3 pages.
Communication pursuant to Rules 161(2) and 162 EPC, for corresponding European Patent Application No. 12817141.0.0, dated Mar. 26, 2014, 3 pages.
Communication pursuant to Rules 161(2) and 162 EPC, for corresponding European Patent Application No. 12818308.4, dated Mar. 26, 2014, 3 pages.
Communication pursuant to Rules 161(2) and 162 EPC, for corresponding European Patent Application No. 12817696.3, dated Mar. 27, 2014, 3 pages.
Communication pursuant to Rules 161(2) and 162 EPC, for corresponding European Patent Application No. 12817883.7, dated Mar. 27, 2014, 3 pages.
Communication pursuant to Rules 161(2) and 162 EPC, for corresponding European Patent Application No. 12818447.0, dated Mar. 27, 2014, 3 pages.
Communication pursuant to Rules 70(2) and 70a(2) EPC, dated Aug. 21, 2015, for corresponding European Patent Application No. 12817696.3-1807, 1 page.
Communication pursuant to Rules 70(2) and 70a(2) EPC, dated Aug. 21, 2015, for corresponding European Patent Application No. 12818447.0-1807, 1 page.
English Translation of Japanese Office Action mailed Feb. 17, 2015, for corresponding Japanese Patent Application No. 2014-523007, 7 pages.
Extended European Search Report dated Apr. 24, 2015, for corresponding EP Application No. 12817097.4, 9 pages.
Extended European Search Report dated Aug. 5, 2015, for corresponding EP Application No. 12817696.3-1807, 13 pages.
Extended European Search Report dated Dec. 17, 2015, for corresponding EP Application No. 12817504.9, 11 pages.
Extended European Search Report dated Dec. 17, 2015, for corresponding EP Application No. 12817905.8, 9 pages.
Extended European Search Report, dated Aug. 5, 2015, for Corresponding European Application No. 12817392.9-1807, 9 pages.
Extended European Search Report, dated Aug. 5, 2015, for Corresponding European Application No. 12818447.0-1807, 17 pages.
Huang et al., "Apparatus, Method and Article for Vehicle Turn Signals," U.S. Appl. No. 61/727,403, filed Nov. 16, 2012, 41 pages.
Huang et al., "Apparatus, Method and Article for Vehicle Turn Signals," Office Action mailed May 14, 2015, for U.S. Appl. No. 14/079,894, 9 pages.
International Preliminary Report on Patentability and Written Opinion for corresponding International Patent Application No. PCT/US2012/048349, issued on Jan. 28, 2014, 5 pages.
International Preliminary Report on Patentability and Written Opinion for corresponding International Patent Application No. PCT/US2012/048354, issued on Jan. 28, 2014, 7 pages.
International Preliminary Report on Patentability and Written Opinion for corresponding International Patent Application No. PCT/US2012/048358, issued on Jan. 28, 2014, 5 pages.
International Preliminary Report on Patentability and Written Opinion for corresponding International Patent Application No. PCT/US2012/048366, issued on Jan. 28, 2014, 5 pages.
International Preliminary Report on Patentability and Written Opinion for corresponding International Patent Application No. PCT/US2012/048367, issued on Jan. 28, 2014, 4 pages.
International Preliminary Report on Patentability and Written Opinion for corresponding International Patent Application No. PCT/US2012/048375, issued on Jan. 28, 2014, 5 pages.
International Preliminary Report on Patentability and Written Opinion for corresponding International Patent Application No. PCT/US2012/048379, issued on Jan. 28, 2014, 5 pages.
International Preliminary Report on Patentability and Written Opinion for corresponding International Patent Application No. PCT/US2012/048380, issued on Jan. 28, 2014, 5 pages.
International Preliminary Report on Patentability and Written Opinion for corresponding International Patent Application No. PCT/US2012/048382, issued on Jan. 28, 2014, 5 pages.
International Preliminary Report on Patentability and Written Opinion for corresponding International Patent Application No. PCT/US2012/048391, issued on Jan. 28, 2014, 6 pages.
International Preliminary Report on Patentability and Written Opinion for corresponding International Patent Application No. PCT/US2013/070131, issued on May 19, 2015, 13 pages.
International Search Report and Written Opinion for corresponding International Application No. PCT/US2012/048344, mailed Feb. 28, 2013, 9 pages.
International Search Report and Written Opinion for corresponding International Application No. PCT/US2012/048347, mailed Dec. 18, 2012, 8 pages.
International Search Report and Written Opinion for corresponding International Application No. PCT/US2012/048349, mailed Feb. 18, 2013, 9 pages.
International Search Report and Written Opinion for corresponding International Application No. PCT/US2012/048354, mailed Feb. 18, 2013, 11 pages.
International Search Report and Written Opinion for corresponding International Application No. PCT/US2012/048366, mailed Jan. 21, 2013, 10 pages.
International Search Report and Written Opinion for corresponding International Application No. PCT/US2012/048367, mailed Jan. 17, 2013, 8 pages.
International Search Report and Written Opinion for corresponding International Application No. PCT/US2012/048375, mailed Jan. 23, 2013, 9 pages.
International Search Report and Written Opinion for corresponding International Application No. PCT/US2012/048379, mailed Dec. 17, 2012, 9 pages.

(56) References Cited

OTHER PUBLICATIONS

International Search Report and Written Opinion for corresponding International Application No. PCT/US2012/048380, mailed Feb. 27, 2013, 9 pages.
International Search Report and Written Opinion for corresponding International Application No. PCT/US2012/048382, mailed Feb. 27, 2013, 9 pages.
International Search Report and Written Opinion for corresponding International Application No. PCT/US2012/063979, mailed Mar. 4, 2013, 10 pages.
International Search Report and Written Opinion for corresponding International Application No. PCT/US2014/050000, mailed Nov. 18, 2014, 11 pages.
International Search Report and Written Opinion for corresponding International Application No. PCT/US2014/050001, mailed Nov. 18, 2014, 9 pages.
International Search Report and Written Opinion for corresponding International Application No. PCT/US2012/048391, mailed Dec. 21, 2012, 9 pages.
International Search Report and Written Opinion for corresponding International Application No. PCT/US2012/058930, mailed Mar. 15, 2013, 11 pages.
International Search Report and Written Opinion for corresponding International Application No. PCT/US2013/065704, mailed Feb. 13, 2014, 13 pages.
International Search Report and Written Opinion for corresponding International Application No. PCT/US2013/070131, mailed Feb. 19, 2014, 17 pages.
International Search Report and Written Opinion for corresponding International Application No. PCT/US2012/048358, mailed Feb. 25, 2013, 9 pages.
International Search Report and Written Opinion for corresponding International Application No. PCT/US2012/059931, mailed Mar. 29, 2013, 13 pages.
International Search Report and Written Opinion for corresponding International Application No. PCT/US2014/024757, mailed Jul. 11, 2014, 15 pages.
International Search Report and Written Opinion for corresponding International Application No. PCT/US2014/023539, mailed Sep. 4, 2014, 12 pages.
International Search Report and Written Opinion, for corresponding International Application No. PCT/US2014/063931, mailed Feb. 16, 2015, 14 pages.
International Search Report and Written Opinion, for corresponding International Application No. PCT/US2014/021369, mailed Jul. 2, 2014, 14 pages.
International Search Report and Written Opinion, for corresponding International Application No. PCT/US2014/022610, mailed Jul. 10, 2014, 12 pages.
Japanese Office Action dated Sep. 8, 2015, for corresponding JP Application No. 2014-523018, with English Translation, 12 pages.
Japanese Office Action with English Translation dated Jun. 30, 2015, for corresponding JP Application No. 2014-523020, 15 pages.
Japanese Office Action with English Translation dated Mar. 31, 2015, for corresponding JP Application No. 2014-523014, 9 pages.
Japanese Office Action with English Translation dated Oct. 14, 2015 for Corresponding JP Application No. 2014-523014, 9 pages.
Japanese Office Action with English Translation dated Sep. 28, 2015 for Corresponding JP Application No. 2014-523023, 15 pages.
Japanese Office Action with English Translation, mailed Dec. 16, 2014, for corresponding JP Application No. 2014-523013, 11 pages.
Luke et al., "Apparatus, Method and Article for Authentication, Security and Control of Portable Charging Devices and Power Storage Devices, Such as Batteries," Office Action mailed Jan. 6, 2014, for U.S. Appl. No. 14/017,090, 19 pages.
Luke et al., "Apparatus, Method and Article for Authentication, Security and Control of Portable Charging Devices and Power Storage Devices, Such as Batteries," Office Action mailed Jun. 26, 2014, for U.S. Appl. No. 14/017,090, 19 pages.
Luke et al., "Apparatus, Method and Article for Authentication, Security and Control of Portable Charging Devices and Power Storage Devices, Such as Batteries," U.S. Appl. No. 61/773,621, filed Mar. 6, 2013, 69 pages.
Luke et al., "Apparatus, Method and Article for Providing Targeted Advertising in a Rechargeable Electrical Power Storage Device Distribution Environment," U.S. Appl. No. 61/773,614, filed Mar. 6, 2013, 77 pages.
Luke et al., "Apparatus, Method and Article for Redistributing Power Storage Devices, Such as Batteries, Between Collection, Charging and Distribution Machines," Office Action mailed Mar. 13, 2015, for U.S. Appl. No. 13/559,091, 33 pages.
Luke et al., "Apparatus, Method and Article for Redistributing Power Storage Devices, Such as Batteries, Between Collection, Charging and Distribution Machines," Office Action mailed Sep. 14, 2015, for U.S. Appl. No. 13/559,091, 59 pages.
Luke et al., "Apparatus, Method and Article for Redistributing Power Storage Devices, Such as Batteries, Between Collection, Charging and Distribution Machines," Preliminary Amendment filed Jan. 30, 2013, for U.S. Appl. No. 13/559,091, 16 pages.
Luke et al., "Detectible Indication of an Electric Motor Vehicle Standby Mode," Office Action for U.S. Appl. No. 13/646,320, mailed May 30, 2013, 13 pages.
Luke et al., "Detectible Indication of an Electric Motor Vehicle Standby Mode," Notice of Allowance for U.S. Appl. No. 13/646,320, mailed Apr. 10, 2014, 8 pages.
Luke et al., "Detectible Indication of an Electric Motor Vehicle Standby Mode," U.S. Appl. No. 61/543,720, filed Oct. 5, 2011, 35 pages.
Luke et al., "Detectible Indication of an Electric Motor Vehicle Standby Mode," U.S. Appl. No. 61/684,432, filed Aug. 17, 2012, 41 pages.
Luke et al., "Drive Assembly for Electric Powered Device," U.S. Appl. No. 61/546,411, filed Oct. 12, 2011, 18 pages.
Luke et al., "Electric Device Drive Assembly and Cooling System," U.S. Appl. No. 61/615,144, filed Mar. 23, 2012, 43 pages.
Luke et al., "Modular System for Collection and Distribution of Electric Storage Devices," U.S. Appl. No. 61/789,065, filed Mar. 15, 2013, 76 pages.
Luke et al., "Apparatus, Method and Article for Authentication, Security and Control of Power Storage Devices, Such as Batteries, Based on User Profiles," Office Action mailed May 11, 2015, for U.S. Appl. No. 13/559,010, 26 pages.
Luke et al., "Apparatus, Method and Article for Authentication, Security and Control of Power Storage Devices, Such as Batteries, Based on User Profiles," U.S. Appl. No. 61/534,772, filed Sep. 14, 2011, 55 pages.
Luke et al., "Apparatus, Method and Article for Authentication, Security and Control of Power Storage Devices, Such as Batteries," Office Action mailed Feb. 26, 2014, for U.S. Appl. No. 13/559,038, 13 pages.
Luke et al., "Apparatus, Method and Article for Authentication, Security and Control of Power Storage Devices, Such as Batteries," Office Action mailed Aug. 19, 2014, for U.S. Appl. No. 13/559,038, 14 pages.
Luke et al., "Apparatus, Method and Article for Authentication, Security and Control of Power Storage Devices, Such as Batteries," Office Action mailed Feb. 25, 2014, for U.S. Appl. No. 14/023,344, 12 pages.
Luke et al., "Apparatus, Method and Article for Authentication, Security and Control of Power Storage Devices, Such as Batteries," Office Action mailed Aug. 21, 2014, for U.S. Appl. No. 14/023,344, 13 pages.
Luke et al., "Apparatus, Method and Article for Authentication, Security and Control of Power Storage Devices, Such as Batteries," U.S. Appl. No. 61/534,761, filed Sep. 14, 2011, 55 pages.
Luke et al., "Apparatus, Method and Article for Collection, Charging and Distributing Power Storage Devices, Such as Batteries," U.S. Appl. No. 61/511,900, filed Jul. 26, 2011, 73 pages.
Luke et al., "Apparatus, Method and Article for Collection, Charging and Distributing Power Storage Devices, Such as Batteries," U.S. Appl. No. 61/647,936, filed May 16, 2012, 76 pages.

(56) References Cited

OTHER PUBLICATIONS

Luke et al., "Apparatus, Method and Article for Collection, Charging and Distributing Power Storage Devices, Such as Batteries," Notice of Allowance mailed Jun. 8, 2015, for U.S. Appl. No. 13/559,314, 12 pages.
Luke et al., "Apparatus, Method and Article for Redistributing Power Storage Devices, Such as Batteries, Between Collection, Charging and Distribution Machines," U.S. Appl. No. 61/534,753, filed Sep. 14, 2011, 65 pages.
Luke et al., "Dynamically Limiting Vehicle Operation for Best Effort Economy," Office Action for U.S. Appl. No. 13/559,264, mailed Aug. 14, 2013, 21 pages.
Luke et al., "Dynamically Limiting Vehicle Operation for Best Effort Economy," Office Action for U.S. Appl. No. 13/559,264, mailed Feb. 12, 2014, 24 pages.
Luke et al., "Dynamically Limiting Vehicle Operation for Best Effort Economy," Office Action for U.S. Appl. No. 13/559,264, mailed Aug. 19, 2014, 26 pages.
Luke et al., "Dynamically Limiting Vehicle Operation for Best Effort Economy," Office Action for U.S. Appl. No. 13/559,264, mailed Jan. 21, 2015, 31 pages.
Luke et al., "Dynamically Limiting Vehicle Operation for Best Effort Economy," Office Action for U.S. Appl. No. 13/559,264, mailed Jun. 15, 2015, 36 pages.
Luke et al., "Dynamically Limiting Vehicle Operation for Best Effort Economy," U.S. Appl. No. 61/511,880, filed Jul. 26, 2011, 52 pages.
Luke et al., "Portable Electrical Energy Storage Device," U.S. Appl. No. 61/872,126, filed Aug. 30, 2013, 39 pages.
Luke et al., "Thermal Management of Components in Electric Motor Drive Vehicles," Office Action mailed Apr. 2, 2014, for U.S. Appl. No. 13/559,259, 11 pages.
Luke et al., "Thermal Management of Components in Electric Motor Drive Vehicles," U.S. Appl. No. 61/511,887, filed Jul. 26, 2011, 44 pages.
Luke et al., "Thermal Management of Components in Electric Motor Drive Vehicles," U.S. Appl. No. 61/647,941, filed May 16, 2012, 47 pages.
Luke, "Apparatus, Method and Article for Changing Portable Electrical Power Storage Device Exchange Plans," U.S. Appl. No. 61/778,038, filed Mar. 12, 2013, 56 pages.
Luke, "Apparatus, Method and Article for Providing Information Regarding a Vehicle via a Mobile Device," Office Action for U.S. Appl. No. 14/017,081, mailed Jan. 30, 2014, 36 pages.
Luke, "Apparatus, Method and Article for Providing Information Regarding a Vehicle via a Mobile Device," Office Action for U.S. Appl. No. 14/017,081, mailed Jul. 21, 2014, 42 pages.
Luke, "Apparatus, Method and Article for Providing Information Regarding a Vehicle via a Mobile Device," Office Action for U.S. Appl. No. 14/017,081, mailed Dec. 31, 2014, 59 pages.
Luke, "Apparatus, Method and Article for Providing Information Regarding a Vehicle via a Mobile Device," U.S. Appl. No. 61/780,781, filed Mar. 13, 2013, 80 pages.
Microchip, "AN885: Brushless DC (BLDC) Motor Fundamentals," Microchip Technology Inc., 2003, 19 pages.
Park, "A Comprehensive Thermal Management System Model for Hybrid Electric Vehicles," dissertation, The University of Michigan, 2011, 142 pages.
Taiwanese Office Action with English Translation dated Aug. 19, 2015, for corresponding TW Application No. 101127036, 25 pages.
Taiwanese Office Action with English Translation dated Sep. 15, 2015 for Corresponding TW Application No. 101127034, 7 pages.
Taiwanese Office Action with English Translation dated Sep. 21, 2015 for Corresponding TW Application No. 101127038, 50 pages.
Taylor et al., "Apparatus, Method and Article for Physical Security of Power Storage Devices in Vehicles," Notice of Allowance for U.S. Appl. No. 13/559,054, mailed May 30, 2013, 32 pages.
Taylor et al., "Apparatus, Method and Article for Physical Security of Power Storage Devices in Vehicles," Office Action for U.S. Appl. No. 13/559,054, mailed Dec. 3, 2012, 11 pages.
Taylor et al., "Apparatus, Method and Article for Physical Security of Power Storage Devices in Vehicles," Office Action mailed Dec. 10, 2014, for U.S. Appl. No. 14/012,845, 13 pages.
Taylor et al., "Apparatus, Method and Article for Physical Security of Power Storage Devices in Vehicles," U.S. Appl. No. 61/557,170, filed Nov. 8, 2011, 60 pages.
Taylor et al., "Apparatus, Method and Article for Providing Vehicle Event Data," U.S. Appl. No. 61/901,660, filed Nov. 8, 2013, 58 pages.
Taylor et al., "Systems and Methods for Utilizing an Array of Power Storage Devices, Such as Batteries," U.S. Appl. No. 14/601,840, filed Jan. 21, 2015, 51 pages.
Wu et al., "Apparatus, Method and Article for Security of Vehicles," Office Action mailed Oct. 2, 2014, for U.S. Appl. No. 13/671,144, 20 pages.
Wu et al., "Apparatus, Method and Article for Security of Vehicles," Office Action mailed Jun. 4, 2015, for U.S. Appl. No. 13/674,144, 20 pages.
Wu et al., "Battery Configuration for an Electric Vehicle," U.S. Appl. No. 61/716,388, filed Oct. 19, 2012, 37 pages.
Wu et al., "Apparatus, Method and Article for a Power Storage Device Compartment," Office Action for U.S. Appl. No. 13/559,125, mailed Feb. 24, 2014, 28 pages.
Wu et al., "Apparatus, Method and Article for a Power Storage Device Compartment," Office Action for U.S. Appl. No. 13/559,125, mailed Sep. 9, 2014, 28 pages.
Wu et al., "Apparatus, Method and Article for a Power Storage Device Compartment," U.S. Appl. No. 61/581,566, filed Dec. 29, 2011, 61 pages.
Wu et al., "Apparatus, Method and Article for Power Storage Device Failure Safety," Office Action for U.S. Appl. No. 14/071,134, mailed Feb. 12, 2014, 14 pages.
Wu et al., "Apparatus, Method and Article for Power Storage Device Failure Safety," Office Action mailed Jun. 9, 2014, for U.S. Appl. No. 14/071,134, 15 pages.
Wu et al., "Apparatus, Method and Article for Power Storage Device Failure Safety," Notice of Allowance mailed Apr. 13, 2015, for U.S. Appl. No. 14/071,134, 10 pages.
Wu et al., "Apparatus, Method and Article for Providing Information Regarding Availability of Power Storage Devices at a Power Storage Device Collection, Charging and Distribution Machine," Office Action mailed Mar. 5, 2014, for U.S. Appl. No. 14/022,140, 8 pages.
Wu et al., "Apparatus, Method and Article for Providing Information Regarding Availability of Power Storage Devices at a Power Storage Device Collection, Charging and Distribution Machine," U.S. Appl. No. 61/601,953, filed Feb. 22, 2012, 53 pages.
Wu et al., "Apparatus, Method and Article for Providing Locations of Power Storage Device Collection, Charging and Distribution Machines," Office Action for U.S. Appl. No. 13/559,333, mailed Jul. 3, 2013, 14 pages.
Wu et al., "Apparatus, Method and Article for Providing Locations of Power Storage Device Collection, Charging and Distribution Machines," Office Action mailed Nov. 27, 2013, for U.S. Appl. No. 13/559,333, 19 pages.
Wu et al., "Apparatus, Method and Article for Providing Locations of Power Storage Device Collection, Charging and Distribution Machines," Notice of Allowance mailed Jul. 10, 2014, for U.S. Appl. No. 13/559,333, 9 pages.
Wu et al., "Apparatus, Method and Article for Providing Locations of Power Storage Device Collection, Charging and Distribution Machines," Office Action mailed Nov. 19, 2013, for U.S. Appl. No. 14/022,147, 10 pages.
Wu et al., "Apparatus, Method and Article for Providing Locations of Power Storage Device Collection, Charging and Distribution Machines," Office Action mailed Mar. 5, 2014, for U.S. Appl. No. 14/022,147, 12 pages.
Wu et al., "Apparatus, Method and Article for Providing Locations of Power Storage Device Collection, Charging and Distribution Machines," Office Action mailed Aug. 6, 2014, for U.S. Appl. No. 14/022,147, 17 pages.
Wu et al., "Apparatus, Method and Article for Providing Locations of Power Storage Device Collection, Charging and Distribution Machines," Notice of Allowance mailed Nov. 25, 2014, for U.S. Appl. No. 14/022,147, 5 pages.

(56) References Cited

OTHER PUBLICATIONS

Wu et al., "Apparatus, Method and Article for Providing Locations of Power Storage Device Collection, Charging and Distribution Machines," U.S. Appl. No. 61/601,949, filed Feb. 22, 2012, 56 pages.
Wu et al., "Apparatus, Method and Article for Providing to a User Device Information Regarding Availability of Portable Electrical Energy Storage Devices at a Portable Electrical Energy Storage Device Collection, Charging and Distribution Machine," Notice of Allowance mailed Jun. 30, 2014, for U.S. Appl. No. 14/022,140, 5 pages.
Wu et al., "Apparatus, Method and Article for Providing to a User Device Information Regarding Availability of Portable Electrical Energy Storage Devices at a Portable Electrical Storage Device Collection, Charging and Distribution Machine," U.S. Appl. No. 14/511,137, filed Oct. 9, 2014, 56 pages.
Wu et al., "Apparatus, Method and Article for Security of Vehicles," U.S. Appl. No. 61/557,176, filed Nov. 8, 2011, 37 pages.
Taiwanese Office Action dated Jan. 14, 2016, for corresponding TW Application No. 101127042, with English Translation, 25 pages.
Taiwanese Office Action dated Jan. 30, 2016, for corresponding TW Application No. 101127036, with English Translation, 25 pages.
Chinese Office Action, dated Feb. 6, 2016, for corresponding CN Application No. 201280046976.1, with English Translation, 49 pages.

* cited by examiner

MULTIDIRECTIONAL ELECTRICAL CONNECTOR, PLUG AND SYSTEM

BACKGROUND

1. Technical Field

The embodiments described herein relate to portable electrical energy storage devices, such as those used to power electric powered devices such as vehicles and consumer electronics, and connectors for making an electrical connection between such portable electrical energy storage devices and devices to be powered by or used to charge such portable electrical energy storage devices.

2. Description of the Related Art

Batteries such as lithium-ion batteries are known for storing more energy into smaller, lighter units. Lithium-ion batteries have found wide application in powering portable electronic devices such as cell phones, tablets, laptops, power tools and other high-current equipment. The low weight and high energy density also makes lithium-ion batteries attractive for use in hybrid electric vehicles and fully electric-powered vehicles.

In some applications, a plurality of individual lithium-ion batteries are packaged together to form a battery pack. Such battery packs include electrical components that make electrical connection between the plurality of individual lithium-ion batteries and primary negative and positive electrical terminals of the battery pack. The negative and positive electrical terminals of the battery pack can be connected to corresponding negative and positive electrical terminals of a device to provide electric power to the device. In applications such as computers or mobile phones, the electric connection to the electrical terminals of the battery pack often can only be achieved when the battery pack is inserted into the battery compartment in one position. In other positions, the battery pack either cannot be received into the battery compartment and/or the terminals of the battery pack do not make electrical connection to the terminals of the device. Similarly, chargers for such types of battery packs often include compartments for receiving the battery pack to be charged. The battery compartment of these chargers is often a replica of the compartment contained in the device to be powered by the battery pack. As with the devices, if the battery pack is not oriented properly in the battery compartment of the battery charger, the battery pack may be not be accepted into the compartment and/or the electrical terminals of the battery pack may not make electrical connection with the electrical terminals of the charger. In other instances, when the battery pack is received into the battery compartment of the charger or device in an improper orientation, the electrical terminals of the battery pack may make contact with the electrical terminals of the charger or the device; however, such contact may not meet the design parameters set for the electrical connection between the battery pack and the charger and/or device. For example, the area of contact between the electrical terminals of the battery pack and the electrical terminals of the device or charger when the battery pack is not in its proper orientation may be less than the area of contact between the electrical terminals of the battery pack and the electrical terminals of the device or charger when the battery pack is in its proper orientation. This reduced area of contact when the battery pack is not in its proper orientation can result in the temperature of the electrical terminals rising to undesired and potentially unsafe levels.

Insertion of a battery pack in an improper orientation within a device to be electrically powered by the battery pack or within a device for charging the battery pack may occur due to the user's lack of understanding the proper orientation or due to carelessness on the part of the user. With the proliferation of electric powered devices, such as electric powered tools, appliances, personal portable communication devices, laptop and tablet computers, personal media devices, vehicles and the like, there is interest in battery pack and battery pack electrical connection designs that minimize the likelihood of installing a battery pack in an orientation within a device to be powered by the battery pack or within a device for charging the battery pack such that the electrical power does not flow between the two or does flow, but creates unsafe conditions. Avoiding improper orientation avoids the risk of creating potentially unsafe conditions and promotes proper discharge and charging of the battery pack, as well as avoiding damage to the terminals of the battery pack and/or terminals of the electrically powered device or charging device.

Connectors capable of electrically connecting a source of electrical energy to a device to be powered by electrical energy from the source of electrical energy without regard to the rotational orientation of the connector are known. For example, connectors historically referred to as 12V cigarette lighter socket, utilize a round female connector and a round male connector. An electrical connection can be made between the two, regardless of the rotational orientation the male connector is inserted in the female connector. Such types of connectors are designed for 12V systems and typically have recommended maximum operating currents on the order of 5 to 10 amps, well below current levels required for modern day high current draw devices, e.g., electric powered tools, electric powered appliances and electric powered vehicles, which draw current at levels one or two orders of magnitude greater than current levels 12V cigarette lighter electrical connectors are rated.

Even when a battery pack is installed/inserted in a proper orientation, the electrical connection between electrical terminals of the battery pack and electrical terminals of a device to be powered by the battery pack or a device for charging the battery pack may not operate as designed. For example, unwanted conductive or nonconductive materials could become lodged between the terminals of the battery pack and the terminals of the device or charger. Portions of the terminals could become damaged or could be broken off. Such conditions can result in unsafe conditions and degraded performance. Thus, even in situations where the battery pack is installed/inserted in its proper orientation, there is interest in effective ways to confirm the electrical connection between the electrical terminals of the battery pack and the electrical terminals of the electrically powered device or the device for charging the battery is as designed.

BRIEF SUMMARY

Zero tail pipe emissions alternatives to combustion engines would greatly benefit the air quality of, and hence health of, large populations.

While the zero tail pipe emissions benefit of all-electric vehicles are appreciated, adoption of all-electric vehicles by large populations has been slow. One of the reasons appears to be the cost, particularly the cost of secondary batteries. Another one of the reasons appears to be the limited driving range available on a single charge of a battery, and the relatively long time (e.g., multiple hours) necessary to recharge a secondary battery when depleted. Yet another reason appears to be the complicated nature of replacing secondary batteries in all-electric vehicles.

The approaches described herein may address some of the issues which have limited adoption of zero tailpipe emission technology, particularly in densely crowded cities, and in populations with limited financial resources.

For example, subject matter described herein relates to connectors for electrically connecting portable electrical energy storage devices, e.g., batteries or battery packs, to a device to be powered by the portable electrical energy storage device or a device for charging the portable electrical energy storage device. The connectors can make an electrical connection between the portable electrical energy storage device and a device to be powered by the portable electrical energy storage device or a device for charging the portable electrical energy storage device in more than one spatial (e.g., rotational) orientation. Electrical connectors for portable electrical energy storage devices of the type described herein are able to make the above-described electrical connections in a plurality of spatial orientations (e.g., a first position, a second position rotated from the first position, a third position rotated from the first and second position, and other rotational positions). The described connectors provide safe electrical connection between a portable electrical energy storage device and an electric device having extended time period electrical current that demands one, two or even more orders of magnitude greater than extended time period current ratings for conventional electrical connectors, such as 12V cigarette lighter style electrical connectors which typically have extended time period current ratings from about 5 to 10 amps and momentary peak ratings of about 15 to 20 amps. Conventional electrical connectors like cigarette lighter style electrical connectors include a positive pin in the form of a spring and point contact which are not designed to safely handle currents much greater than 20 amps or applications involving high levels of vibration. Connectors of the type described herein provide an advantage in that robust and safe electrical connections can be made in a plurality of the spatial orientations of the connector on the portable electrical energy storage device relative to the connector on the electrically powered device or the device for charging the portable electrical energy storage device.

Because a portable electrical energy storage device connector in accordance with embodiments described herein can mate with a connector of the electrically powered device or the device for charging the portable electrical storage device in a plurality of specific spatial orientations in which the portable electrical energy storage device is installed or received by the electrically powered device or the device for charging the portable electrical energy storage device, users of portable electrical energy storage devices utilizing electrical connectors of the type described herein will be confident that a robust and safe electrical connection can be made to an electrically powered device or a device for charging the portable electrical energy storage device. The user will be less concerned with and less likely to install the portable electrical energy storage device incorrectly and therefore utilization of the portable electrical energy storage devices will be safer and occur more rapidly and be more widespread.

Electrical connectors of the type described herein include a connector for making electrical connection between a portable electrical energy storage device electrically connected to the connector or an electric powered device electrically connected to the connector and a plug electrically connected to an electric powered device or a portable electrical energy storage device that is not electrically connected to the connector. The connectors include an electrically nonconductive connector base having a connector central axis; an electrical contact housing including an outer sidewall extending in a direction parallel to the connector central axis and an inner sidewall extending in a direction parallel to the connector central axis, the inner sidewall located closer to the connector central axis than the outer sidewall, the electrical contact housing centered on the connector central axis; a first terminal including at least two electrically conductive contact pads located adjacent the inner sidewall of the electrical contact housing; and a second terminal including at least one electrically conductive contact pad located adjacent the outer sidewall of the electrical contact housing.

The connectors may further comprise a connection test terminal located closer to the connector central axis than the first terminal and configured to be electrically connected to the first terminal when the connector is electrically connected to the plug.

The connection test terminal may include a high impedance material.

The connectors may be configured to mate with the plug in two or more orientations and make an electrical connection to the plug in each of the two or more orientations, the two or more orientations corresponding to different positions of the connector relative to the plug, each different position of the connector relative to the plug corresponding to different rotational positions of the connector relative to the connector central axis.

The two or more orientations may be three or more orientations, four or more orientations, or five or more orientations.

The electric powered device may be a traction electric motor for a vehicle.

The outer sidewall and the inner sidewall of the connector may be concentric.

The at least two electrically conductive contact pads of the first terminal and the at least one electrically conductive pad of the second terminal may be concentric.

The at least two electrically conductive contact pads may include at least three electrically conductive contact pads.

The at least one electrically conductive contact pad of the second terminal may include two or more contact pads.

A periphery of the electrical contact housing may lie in a plane perpendicular to the connector central axis and the periphery may define a quadrilateral with opposing angles that are equal. Adjacent sides of the quadrilateral may be equal in length.

The outer sidewall of the electrical contact housing may include four outer sidewalls with each outer sidewall arranged perpendicular to adjacent outer sidewalls and extending parallel to the connector central axis. The inner sidewall of the electrical contact housing may include four inner sidewalls with each inner sidewall arranged perpendicular to adjacent inner sidewalls and extending parallel to the connector central axis. The four inner sidewalls may be located closer to a connector base axis than the four outer sidewalls.

The at least two electrically conductive contact pads of the first terminal may include four electrically conductive contact pads, and one electrically conductive contact pad of the first terminal may be located adjacent each of the four inner sidewalls of the electrical contact housing.

The at least one electrically conductive contact pad of the second terminal may include four electrically conductive contact pads, and one electrically conductive contact pad of the second terminal may be located adjacent each of the four outer sidewalls of the electrical contact housing.

An electrical plug for making electrical connection between an electric powered device electrically connected to the plug or a portable electrical energy storage device electrically connected to the plug and a connector electrically connected to an electric powered device or a portable electrical energy storage device that is not electrically connected to the plug may include an electrically nonconductive plug housing including a plug end, a terminal end and a plug housing central axis, the plug end located at an end of the nonconductive plug housing that is opposite an end of the nonconductive plug housing where the terminal end is located; a first terminal located at the plug end and including at least two electrically conductive contact pads, each contact pad of the first terminal extending parallel to the plug housing central axis and positioned around the plug housing central axis; and a second terminal located at the plug end and including at least two electrically conductive contact pads, each contact pad of the second terminal extending parallel to the plug housing central axis and positioned around the plug housing central axis, the first terminal of the plug located closer to the plug housing central axis than the second terminal of the plug, each contact pad of the first terminal separated from the contact pads of the second terminal by an electrically nonconductive medium.

The plug may further include a connection test terminal located at the plug end further from the plug housing central axis than the contact pads of the first plug terminal, the connection test terminal configured to be electrically connected to the connector when the connector mates with the plug.

The plug may be configured to mate with the connector when the connector is in one of two or more orientations and the plug is configured to make an electrical connection to the connector in each of the two or more orientations with each of the connector's two or more orientations corresponding to a different position of the connector relative to the plug with each different position of the connector relative to the plug achieved by rotating the connector around the plug housing central axis.

The two or more orientations may be three or more orientations, four or more orientations, or five or more orientations.

The electric powered device may be a traction electric motor.

The at least two contact pads of the first terminal and the contact pads of the second terminal may be concentric.

The at least two contact pads of the first terminal may be are three contact pads or may be four contact pads.

The at least two contact pads of the second terminal may be three contact pads.

A system for electrically connecting a portable electrical energy storage device to an electrically powered device may include a connector that may include an electrically nonconductive connector base including a connector central axis; an electrical contact housing that may include an outer sidewall extending in a direction parallel to the connector central axis and an inner sidewall extending in a direction parallel to the connector central axis, the inner sidewall located closer to the connector central axis than the outer sidewall and the electrical contact housing centered on the connector central axis; a first connector terminal that may include at least one electrically conductive contact surface located adjacent the inner sidewall of the electrical contact housing; and a second connector terminal that may include at least one electrically conductive contact surface located adjacent the outer sidewall of the electrical contact housing.

The system may further include a plug including an electrically nonconductive plug housing including a plug end, a terminal end and a plug housing central axis, the plug end may be located at an end of the nonconductive plug housing that is opposite an end of the nonconductive plug housing where the terminal end is located; a first plug terminal may be located at the plug end and include at least two electrically conductive contact pads with each contact pad of the first plug terminal extending parallel to the plug housing central axis and positioned around the plug housing central axis; and a second plug terminal may be located at the plug end and include at least two electrically conductive contact pads, each contact pad of the second plug terminal extending parallel to the plug housing central axis and positioned around the plug housing central axis, the first plug terminal located closer to the plug housing central axis than the second plug terminal and each contact pad of the first plug terminal separated from the contact pads of the second plug terminal by an electrically nonconductive medium.

The connector of the system may further include a connection test terminal located at the plug end closer to the connector central axis than contact pads of the first plug terminal and configured to be electrically connected to the second connector terminal when the connector is mated with the plug.

The connector may be configured to mate with the plug in two or more orientations and make an electrical connection to the plug in each of the two or more orientations, each of the two or more orientations corresponding to a different position of the connector relative to the plug, each different position achieved by rotating the connector around the connector central axis.

The outer sidewall of the electrical contact housing and the inner sidewall of the electrical contact housing may be concentric.

The at least one electrically conductive contact surface of the first connector terminal and the at least one electrically conductive contact surface of the second connector terminal may be concentric.

The connector of the system may further include a connection test terminal located closer to the connector central axis than the first connector terminal and configured to be electrically connected to the first plug terminal when the connector is mated with the plug.

The plug of the system may be configured to mate with the connector when the connector is in one of two or more orientations and the plug is configured to make an electrical connection to the connector in each of the two or more orientations. Each of the connector's two or more orientations corresponds to a different position of the connector relative to the plug, each different position of the connector relative to the plug achieved by rotating the connector around the plug housing central axis.

BRIEF DESCRIPTION OF THE SEVERAL VIEWS OF THE DRAWINGS

In the drawings, identical reference numbers identify similar elements. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn are not intended to convey any information regarding the actual shape of the particular elements, and they have been solely selected for ease of recognition in the drawings.

DETAILED DESCRIPTION

Figure 1:
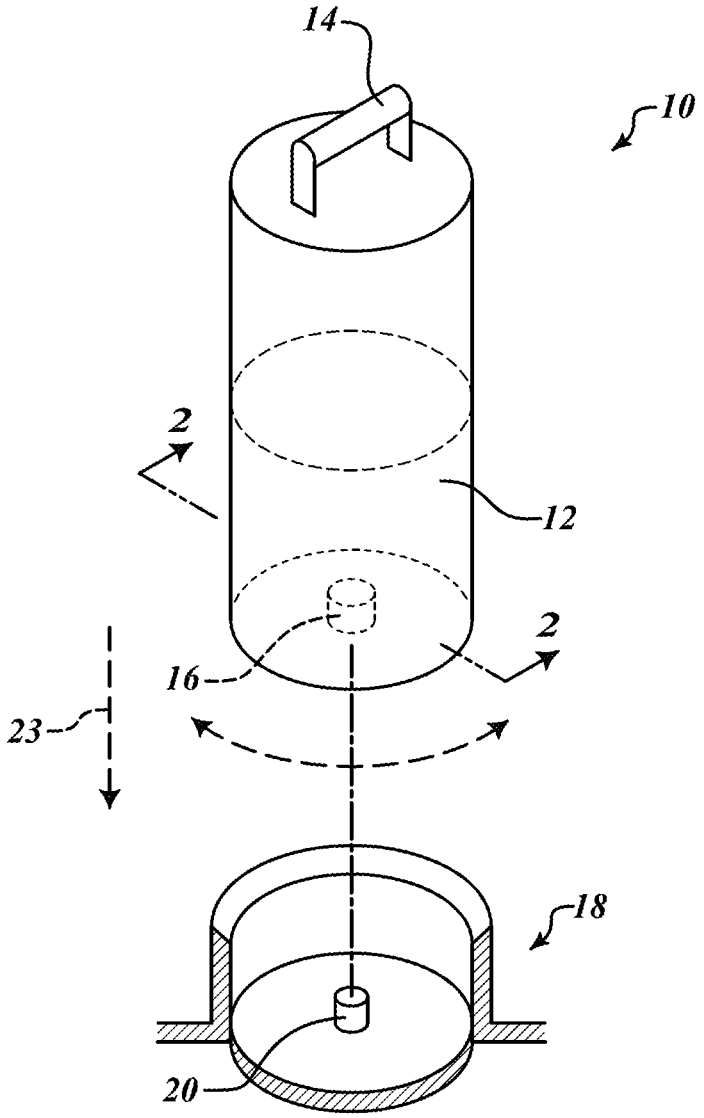
FIG. 1 is a schematic view illustrating receipt of a portable electrical energy storage device including an electrical connector in accordance with embodiments described herein by an electrically powered device including an electrical connector plug in accordance with embodiments described herein.

It will be appreciated that, although specific embodiments of the present disclosure are described herein for purposes of illustration, various modifications may be made without departing from the spirit and scope of the present disclosure. Accordingly, the present disclosure is not limited except as by the appended claims.

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with portable electrical energy storage devices, batteries, super- or ultra-capacitors, electrical terminals, devices to be powered by portable electrical energy storage devices, devices for charging portable electrical energy storage devices and electrical connectors for electrically connecting portable electrical energy storage devices and devices to be powered by such portable electrical energy storage devices or devices for charging such portable electrical energy storage devices have not been shown or described in detail to avoid unnecessarily obscuring descriptions of the embodiments.

Unless the context requires otherwise, throughout the specification and claims that follow, the word "comprise" and variations thereof, such as "comprises" and "comprising" are to be construed in an open, inclusive sense, that is, as "including, but not limited to."

Reference throughout the specification to "one embodiment" or "an embodiment" means that a particular feature, structure, or characteristic described in connection with the embodiment is included in at least one embodiment. Thus, the appearance of the phrases in "one embodiment" or in "an embodiment" in various places throughout the specification are not necessarily all referring to the same aspect. Furthermore, the particular features, structures, or characteristics may be combined in any suitable manner in one or more aspects of the present disclosure.

The use of ordinals such as first, second and third does not necessarily imply a ranked sense of order, but rather may only distinguish between multiple instances of an act or structure.

In the figures, identical reference numbers identify similar features or elements. The sizes and relative positions of the features in the figures are not necessarily drawn to scale.

Reference to portable electrical power storage device or portable electrical energy storage device means any device capable of storing electrical power and releasing stored electrical power including but not limited to batteries and super or ultra-capacitors. Reference to batteries means a chemical storage cell or cells, for instance rechargeable or secondary battery cells including but not limited to nickel cadmium alloy or lithium ion battery cells. Chemistries besides nickel cadmium alloy or lithium ion are also included in the reference to batteries or chemical storage cells.

Reference throughout the specification to an electric powered device includes devices that can be powered by a portable electrical energy storage device and devices that are electrically powered from a source other than a portable electrical energy storage device, e.g., a device for electrically charging a portable electrical energy storage device.

Referring to FIG. 1, a portable electrical energy storage device in the form of a battery pack 10 includes a battery pack housing 12. Though not illustrated, contained within battery pack housing 12 are one or more individual portable electrical energy storage devices. These individual portable electrical energy storage devices can be arranged in different configurations, including single or multiple layers, with each layer including one or more individual electrical energy storage devices. In the illustrated exemplary embodiment of FIG. 1, battery pack 10 has a cylindrical shape. A cross-section of the battery pack 10 along line 2-2 has a round cross-section in the illustrated embodiment. As will become apparent based on descriptions that follow, battery packs of the type described herein are not limited to battery packs that are cylindrical and have a round cross-section; battery packs having different shapes and cross-sections are included in the embodiments described herein. Battery packs having polygonal, e.g., square or rectangular, cross-sections are examples of different shaped battery packs that are included within the description of battery packs of the type described herein.

At one end, battery pack 10 includes a handle 14 attached to the top of battery pack 10 for grasping battery pack 10. At an end of battery pack 10 opposite the end containing handle 14, battery pack 10 includes a multidirectional electrical connector 16 shown in phantom lines. Multidirectional electrical connector 16 is represented schematically and is not limited to the shape illustrated in phantom lines, and can have a shape different than that shown in phantom lines in FIG. 1.

In the embodiment illustrated in FIG. 1, battery pack 10 is configured to cooperate with a battery pack receptacle 18 which includes an electrical connector plug 20. Electrical connector plug 20 is represented schematically in FIG. 1 and is not limited to the shape illustrated in phantom lines and can have a shape different than that shown in FIG. 1. Receptacle 18 is sized and configured to receive battery pack 10 when the battery pack 10 is moved in the direction of arrow 23 in FIG. 1. An advantage of the electrical connector 16 and the electrical connector plug 20 is their ability to electrically connect to each other regardless of the rotational position of battery pack 10 relative to battery receptacle 18 when the battery receptacle 18 receives battery pack 10. The ability to achieve an electrical connection between electrical connector 16 and electrical connector plug 20 regardless of the rotational orientation of the battery pack 10 relative to battery pack receptacle 18 reduces the likelihood that an ineffective electrical connection between electrical connector 16 and electrical connector plug 20 results due to insertion of a battery pack 10 into battery pack receptacle 18 in an improper orientation. Thus, in accordance with embodiments described herein, electrical connector 16 and electrical connector plug 20 provide a multidirectional electrical connection system which can make an electrical connection in a plurality of rotational orientations without compromising the quality and safety of the electrical connection due to insertion of a battery pack 10 into battery pack receptacle 18 in an improper orientation.

Specific embodiments are described herein with reference to connectors for electrically connecting portable electrical energy storage device(s) to an electrical system of electrically powered vehicles and devices for charging portable electrical energy storage devices; however, the present disclosure and the reference to connectors for electrically connecting a portable electrical energy storage device to an electrical system of electrically powered vehicles and devices for charging the portable electrical energy storage devices is not limited to electrical systems for electrically powered vehicles or devices for charging portable electrical energy storage devices. Connectors of the type described herein are also useful for electrically connecting portable electrical energy storage devices to electrical systems of electrically powered devices other than electrically powered vehicles and devices for charging the portable electrical energy storage devices. Connectors of the type described herein for use in providing an electrical connection between a portable electrical energy storage device and an electrical system of an electrically powered vehicle are capable of safely carrying electrical currents levels sufficient to drive a traction electric motor of the vehicle. For example, electric connectors of the type described herein safely carry electric current ranging from about 30 amps or more. In certain embodiments the electrical connectors can safely carry about 50 amps or more, about 75 amps or more, about 100 amps or more, about 200 amps or more, about 300 amps or more, about 400 amps or more, about 500 amps or more. In some embodiments the electrical connector can safely carry about 1000 amps or more.

Figure 2:
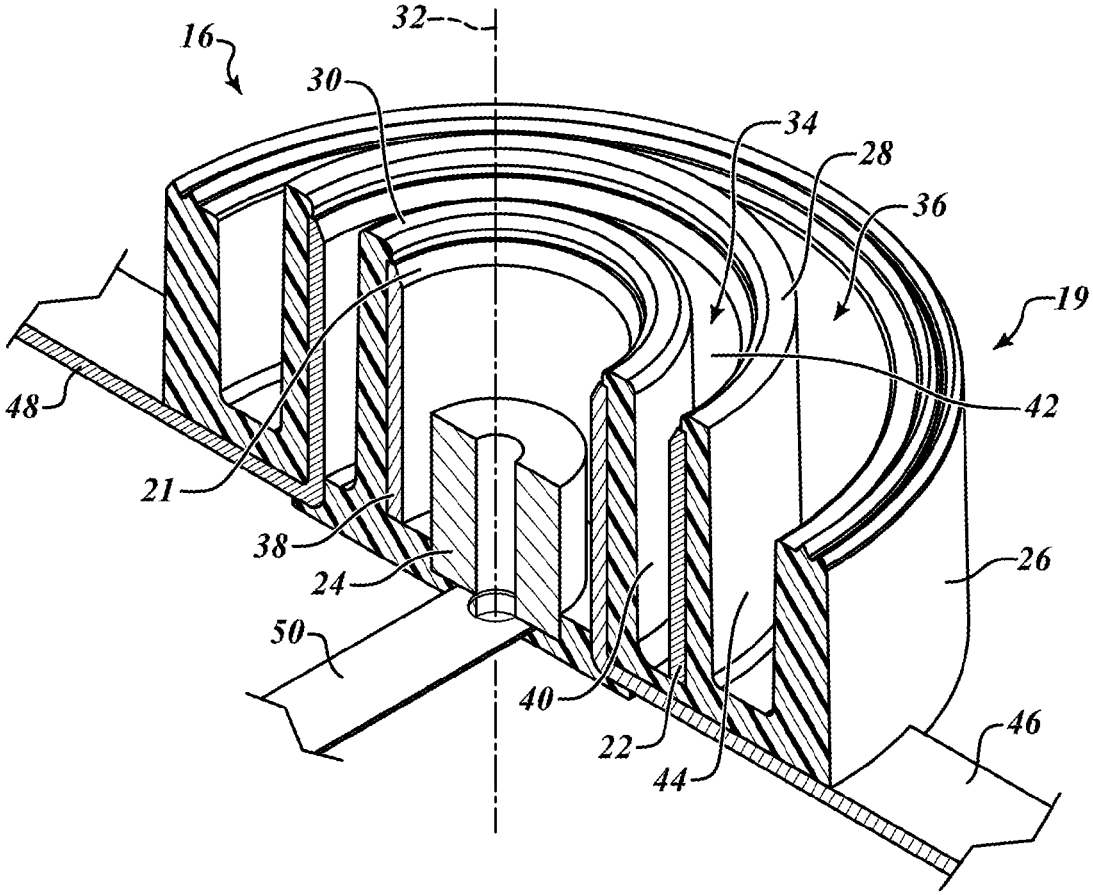
FIG. 2 is a cross-section view along line 2-2 in FIG. 3 of an electrical connector base according to one non-limiting illustrated embodiment of the subject matter described herein.
Figure 3:
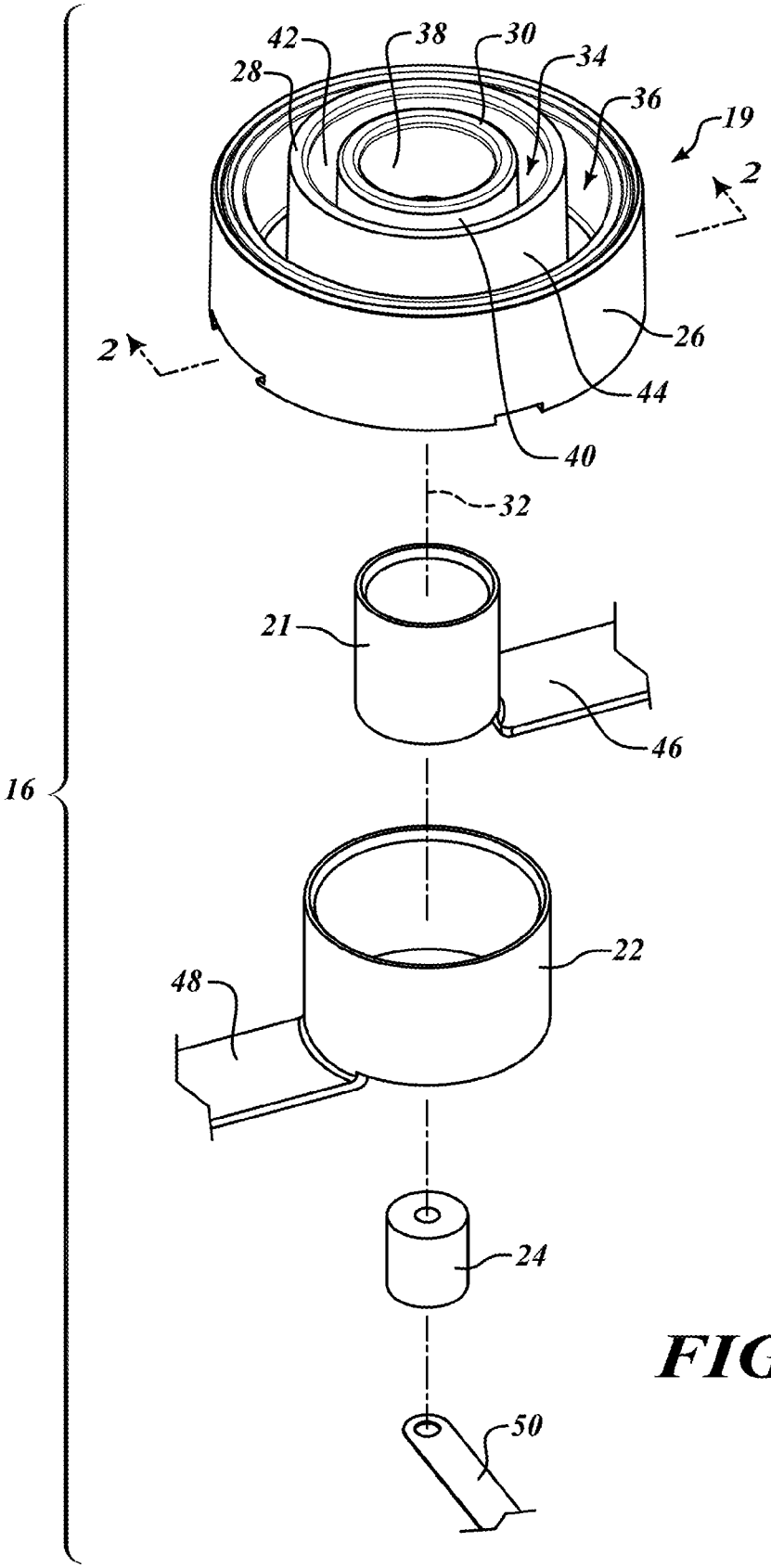
FIG. 3 is an exploded view of the connector base illustrated in FIG. 2.

Details of one embodiment of the present disclosure are described below with reference to FIGS. 2 and 3. FIGS. 2 and 3 illustrate one exemplary embodiment of an electrical connector 16 electrically connected to a portable electrical energy storage device or to a device to be powered by the portable electrical energy storage device. Connector 16 in the illustrated exemplary embodiment includes an electrically nonconductive connector base 19, a first terminal 21, a second terminal 22, and an electrical connection test terminal 24. In order to avoid obscuring aspects of the subject matter described herein, details of how first terminal 21 and second terminal 22 are electrically connected to the portable electrical energy storage device or an electrically powered device are omitted.

Electrically nonconductive connector base 19 includes a conductor base outer wall 26. In the illustrated exemplary embodiment of FIGS. 2 and 3, electrically nonconductive connector base 19 is circular in shape when viewed along a longitudinal axis 32. The electrically nonconductive connector base 19 including conductor base outer wall 26 is formed from a nonconductive material, such as plastic. Conventional techniques such as extrusion or injection molding can be used to form nonconductive connector base 19 and conductor base outer wall 26. Connector base 19 further includes an electrical terminal outer wall 28 and an electrical terminal inner wall 30. Electrical terminal outer wall 28 and electrical terminal inner wall 30 are also formed of an electrically nonconductive material. In the illustrated embodiment of FIGS. 2 and 3, electrical terminal outer wall 28 and electrical terminal inner wall 30 are integral with conductor base outer wall 26. Thus, in the illustrated embodiment, electrically nonconductive connector base 19 is an integral element; however, electrically nonconductive connector base 19 need not be an integral element, for example, conductor base outer wall 26, electrical terminal outer wall 28 and electrical terminal inner wall 30 can be formed individually and attached to each other in different combinations. In the illustrated exemplary embodiments of FIGS. 2 and 3, electrical terminal outer wall 28 and electrical terminal inner wall 30 are circular in shape when viewed along a longitudinal axis 32 and are positioned concentrically relative to conductor base outer wall 26. In FIGS. 2 and 3, electrical terminal inner wall 30 is spaced radially inward from electrical terminal outer wall 28 and is separated therefrom by an air gap 34. Electrical terminal outer wall 28 is spaced radially inward from conductor base outer wall 26 and is separated therefrom by an air gap 36. Air gap 34 provides an electrically nonconductive medium between electrical terminal inner wall 30 and electrical terminal outer wall 28. Air gap 36 provides an electrically nonconductive medium between electrical terminal outer wall 28 and conductor base outer wall 26.

Electrical terminal inner wall 30 includes an inner surface 38 and an outer surface 40. Inner surface 38 of electrical terminal inner wall 30 is located closer to longitudinal axis 32 than outer surface 40 of electrical terminal inner wall 30. Electrical terminal outer wall 28 includes an inner surface 42 and an outer surface 44. Inner surface 42 of electrical terminal outer wall 28 is located closer to longitudinal axis 32 than outer surface 44 of electrical terminal outer wall 28.

Inner surface 38 of electrical terminal inner wall 30 includes first electrically conductive terminal 21. In the illustrated exemplary embodiment, first electrically conductive terminal 21 is a ring-shaped member conforming in size and shape to the inner surface 38 of electrical terminal inner wall 30. The bottom edge of electrically conductive terminal 21 is electrically connected to a first terminal connector 46 which lies beneath the electrical terminal inner wall 30, electrical terminal outer wall 28 and conductor base outer wall 26. First terminal connector 46 can be electrically connected to a portable electrical energy storage device, a device to be powered by a portable electrical energy storage device or a device for charging a portable electrical energy storage device, thus providing an electrical connection between the device connected to the first terminal connector 46 and the other devices.

Inner surface 42 of electrical terminal outer wall 28 includes second electrically conductive terminal 22. In the illustrated exemplary embodiment, second electrically conductive terminal 22 is a ring-shaped member conforming to the size and shape of inner surface 42 of electrical terminal outer wall 28. The bottom edge of electrically conductive terminal 22 is electrically connected to a second electrical terminal connector 48 which lies beneath the electrical terminal outer wall 28 and conductor base outer wall 26. Second terminal connector 48 can be electrically connected to a portable electrical energy storage device, a device to be powered by the portable electrical energy storage device, or a device for charging a portable electrical energy storage device, thus providing an electrical connection between the device connected to the second terminal connector 48 and the other devices.

Figure 9A:
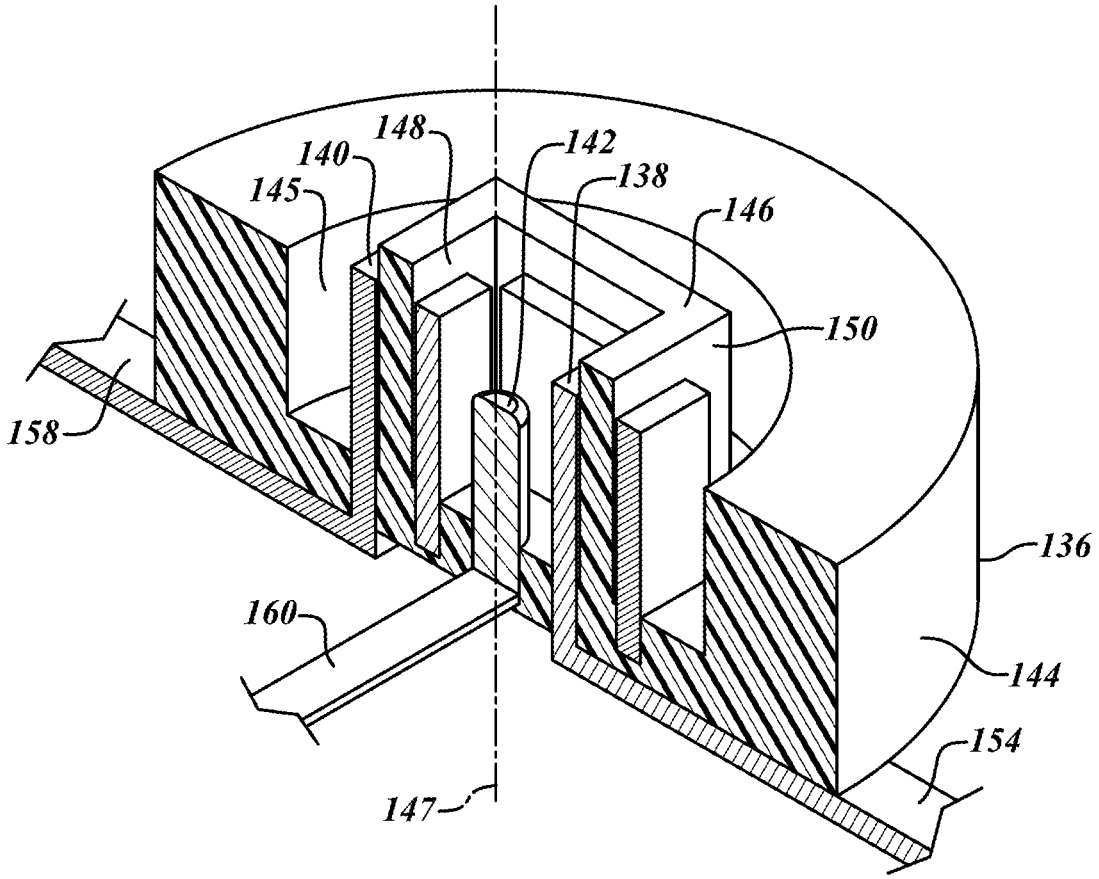
FIG. 9A is a cross-section view of an electrical connector base according to another non-limiting illustrated embodiment of the subject matter described herein taken along line 9A-9A in FIG. 9B.
Figure 9B:
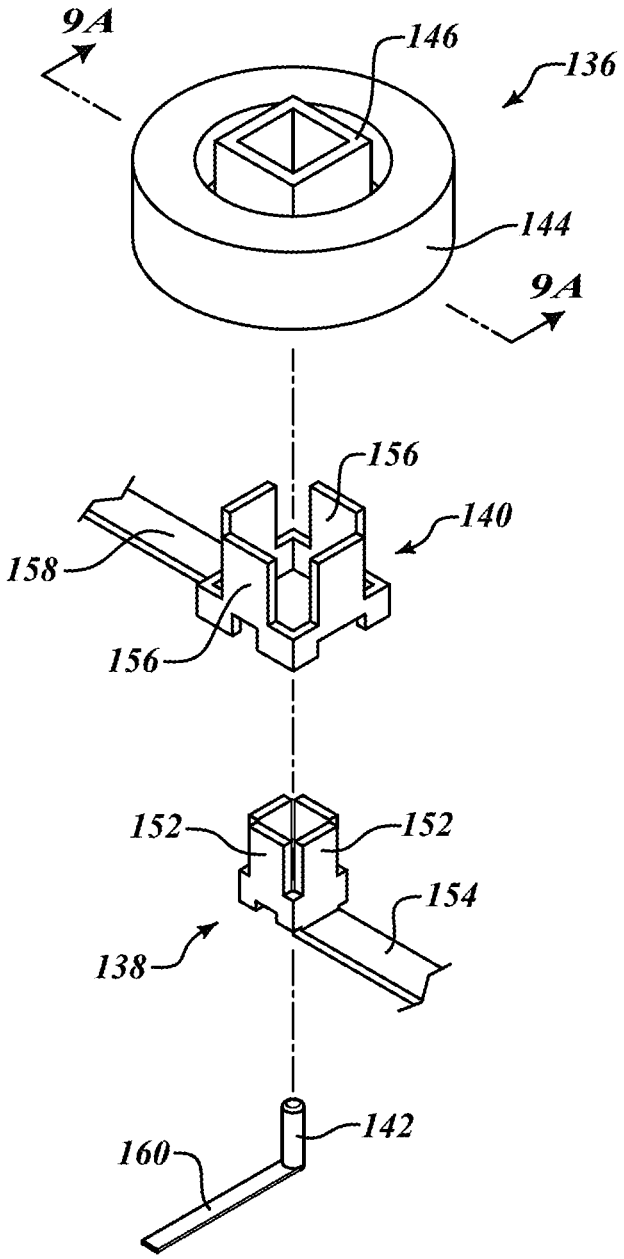
FIG. 9B is an exploded view of the electrical connector base illustrated in FIG. 9A.

In the exemplary embodiment illustrated in FIGS. 2 and 3, first electrically conductive terminal 21 and second electrically conductive terminal 22 are illustrated as a single terminal, respectively; however, embodiments of the present disclosure are not limited to first electrically conductive terminal 21 and electrically conductive terminal 22 including an integral continuous contact pad. First electrically conductive terminal 21 and second electrically conductive terminal 22 can take different forms, such as a terminal that includes more than one contact pad. An example of such type of terminal having more than one contact pad is illustrated in FIGS. 9A and 9B. In addition, while first electrically conductive terminal 21 is illustrated in FIGS. 2 and 3 as being connected to a single first terminal connector 46, first electrically conductive terminal 21 can be electrically connected to more than one first terminal connector 46. Similarly, while second electrically conductive terminal 22 is illustrated in FIGS. 2 and 3 as being connected to a single second terminal connector 48, second electrically conductive terminal 22 can be electrically connected to more than one second terminal connector 48. When first electrically conductive terminal 21 and/or second electrically conductive terminal 22 are provided in the form of a terminal that includes more than one contact pad, each individual contact pad can be connected to its own first terminal connector 46 or its own second terminal connector 48.

In the illustrated embodiment of FIGS. 2 and 3, electrical connection test terminal 24 of electrical connector 16 is an electrically conductive member in the shape of a cylinder centered along longitudinal axis 32. Electrical connection test terminal 24 is positioned radially inward of first electrically conductive terminal 21. The top of electrical connection test terminal 24 is recessed below the upper surfaces of a conductor base outer wall 26, electrical terminal outer wall 28, electrical terminal inner wall 30, first electrically conductive terminal 21 and second electrically conductive terminal 22. The center of electrical connection test terminal 24 includes a bore that passes through electrical connection test terminal 24 along a longitudinal axis 32. Electrical connection test terminal 24 is electrically connected to connection test terminal connector 50 which is located below conductor base outer wall 26, electrical terminal outer wall 28, and electrical terminal inner wall 30. In the illustrated embodiment, electrical test connection terminal 24 is electrically connected to connection test terminal connector 50 at its bottom; however, electrical connection between electrical test connection terminal 24 and connection test terminal connector 50 need not be at the bottom of connection test terminal connector 50. Connection between connection test terminal connector 50 and electrical test connection terminal 24 can occur at different locations along the body of electrical test connection terminal 24. Connection test terminal connector 50 provides electrical connection between electrical test connection terminal 24 and the electrical sensing device that can be connected to connection test terminal connector 50.

Figure 4:
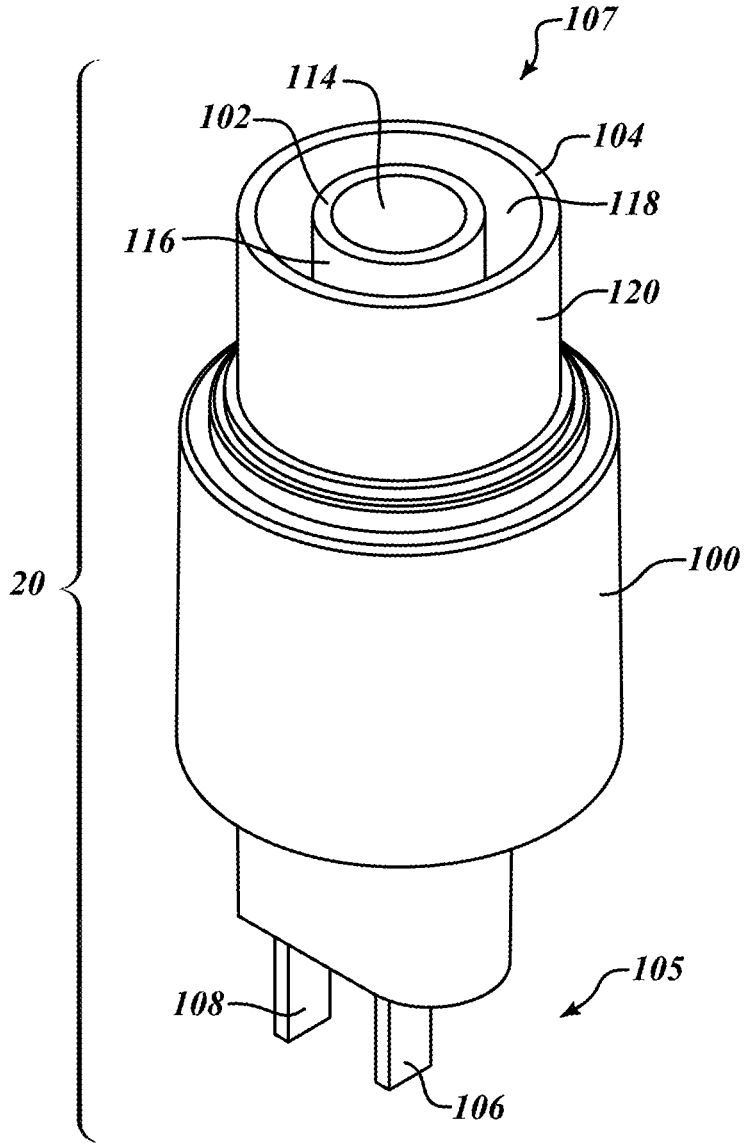
FIG. 4 is a perspective view of an electrical connector plug in accordance with one non-limiting illustrated embodiment of the subject matter described herein.
Figure 5:
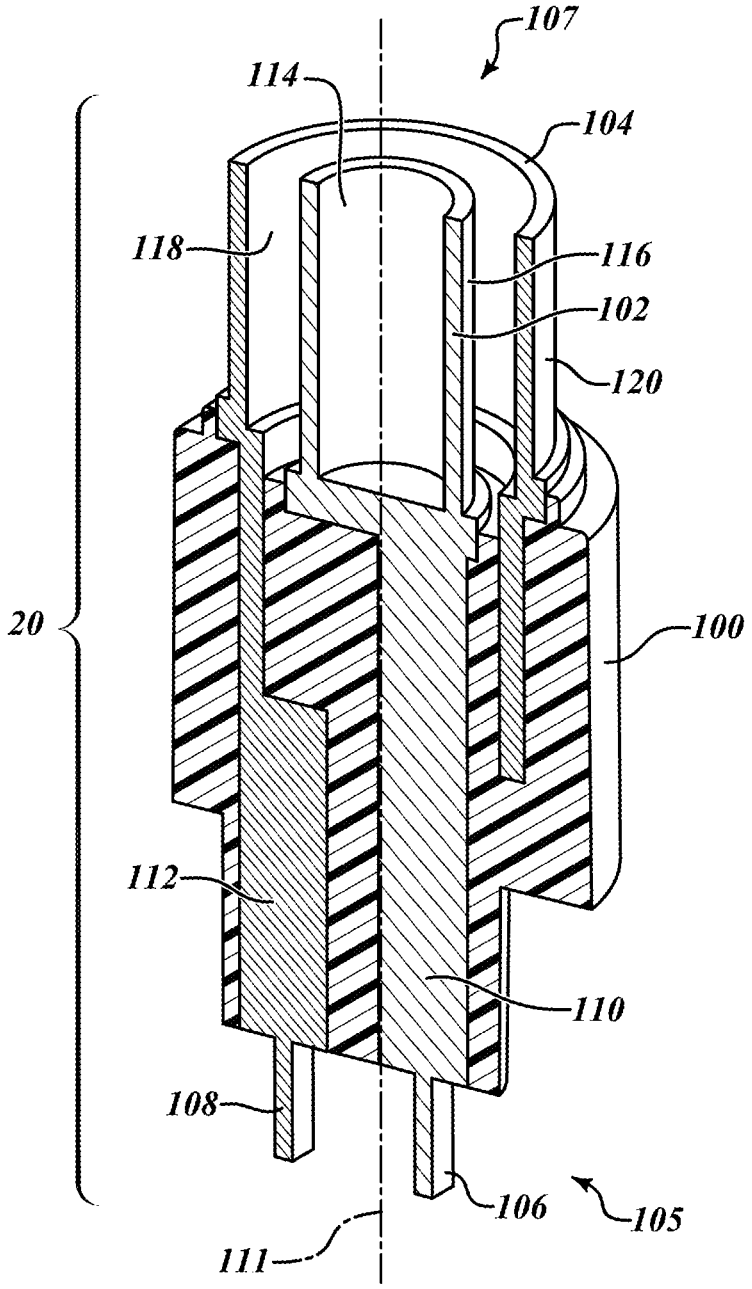
FIG. 5 is a cross-section view of the electrical connector plug illustrated in FIG. 4 taken along line 5-5.
Figure 6:
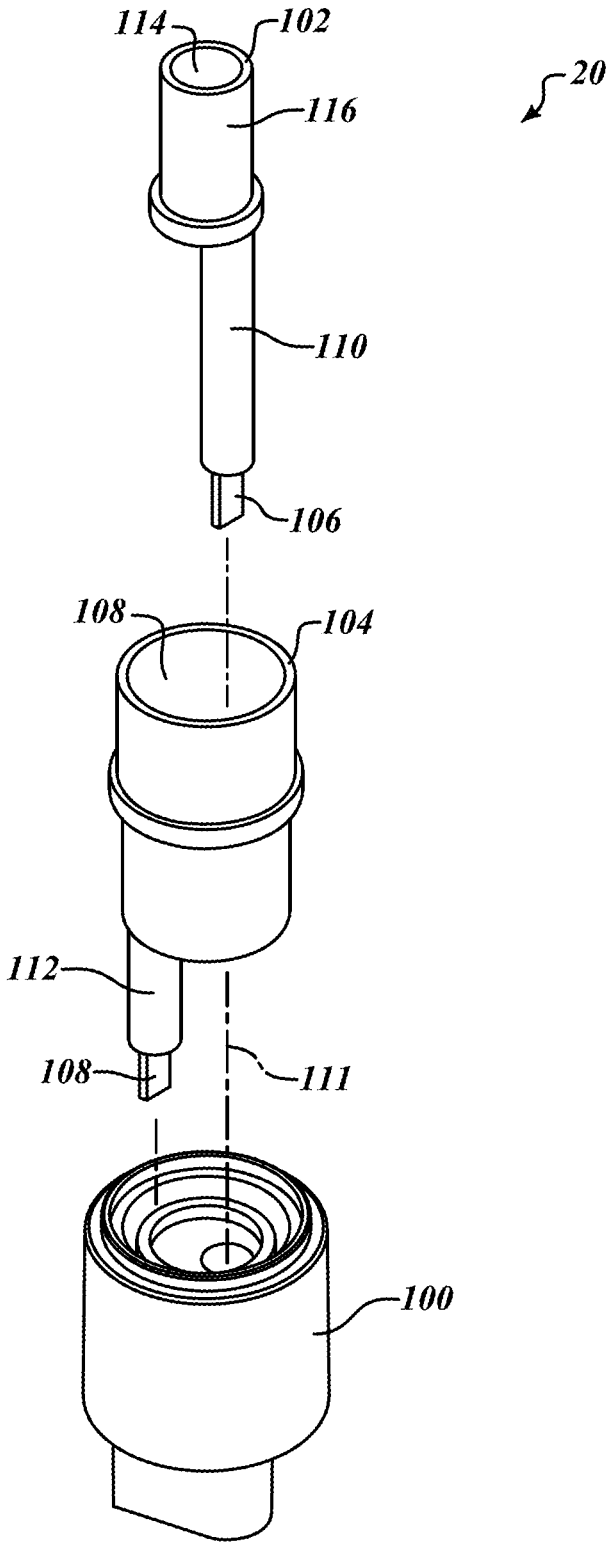
FIG. 6 is an exploded view of the electrical connector plug illustrated in FIG. 4.

Referring to FIGS. 4, 5 and 6, an exemplary electrical connector plug 20 in accordance with embodiments described herein is illustrated. Electrical connector plug 20 includes a nonconductive plug housing or body 100, a first electrical connection terminal 102 and a second electrical connection terminal 104. The electrical connection plug housing 100, first electrical connection terminal 102 and second electrical connection terminal 104 are sized and configured to mate with electrical connector 16 described above with reference to FIGS. 2 and 3. When mated, an electrical connection is provided between a device electrically connected to electrical connector 16 and a device connected to electrical connector plug 20.

Nonconductive plug housing body 100 is an electrically nonconductive material, such as an electrically nonconducting plastic, and has a cylindrical shape centered along plug housing longitudinal axis 111. At a plug end 107, a first electrical connection terminal 102 and a second electrical connection terminal 104 protrude from nonconductive plug housing body 100. First electrical connection terminal 102 and second electrical connection terminal 104 are formed out of an electrically conductive material, such as an electrically conductive metal. At the opposite terminal end 105 of nonconductive plug housing 100, a first terminal connector 106 and a second terminal connector 108 protrude from nonconductive plug housing 100. First terminal connector 106 and second terminal connector 108 are formed out of an electrically conductive material, such as an electrically conductive metal. Intermediate first connection terminal 102 and first terminal connector 106 comprise a first terminal body 110. First terminal body 110 is formed out of an electrically conductive material, such as an electrically conductive metal. First terminal body 110 provides an electrical connection between a first connection terminal 102 and first terminal connector 106. Intermediate second connection terminal 104 and second terminal connector 108 comprise a second terminal body 112. Second terminal body 112 is formed out of an electrically conductive material, such as an electrically conductive metal. Second terminal body 112 provides an electrical connection between the second connection terminal 104 and second terminal connector 108. In order to avoid obscuring aspects of the subject matter described herein, details of how first terminal connector 106 and second terminal connector 108 are electrically connected to a portable electrical energy storage device or an electrically powered device are omitted.

The specific example of embodiments described herein illustrated in FIGS. 4-6 illustrates a first terminal body 110 that is offset radially from the plug housing longitudinal axis 111. Similarly, secondary terminal body 112 is offset radially from the plug housing longitudinal axis 111. In addition to the specific examples of the shapes and locations of first terminal body 110 and second terminal body 112 illustrated in FIGS. 4-6, first terminal body 110 and second terminal body 112 can be shaped differently and located in other locations. For example, first terminal body 110 could be annular shaped like second terminal body 112 or a different shape, and/or second terminal body 112 need not be annular shaped, for example, second terminal body 112 could have a shape similar to first terminal body 110 or a different shape.

First electrical connection terminal 102 is annular in shape. Second electrical connection terminal 104 is also annular in shape and has a diameter greater than the diameter of the first electrical connection terminal 102. In the illustrated embodiment, first electrical connection terminal 102 and second electrical connection terminal 104 are concentric relative to each other. First electrical connection terminal includes an inner electrical contact pad surface 114 and an outer electrical contact pad surface 116. Similarly, second electrical connection terminal 104 includes an inner electrical contact pad surface 118 and an outer electrical contact pad surface 120. In the illustrated embodiment, inner electrical contact pad surface 114 and outer electrical contact pad surface 116 are separated by an electrically nonconductive medium, e.g., air or an electrically nonconductive plastic.

Figure 10A:
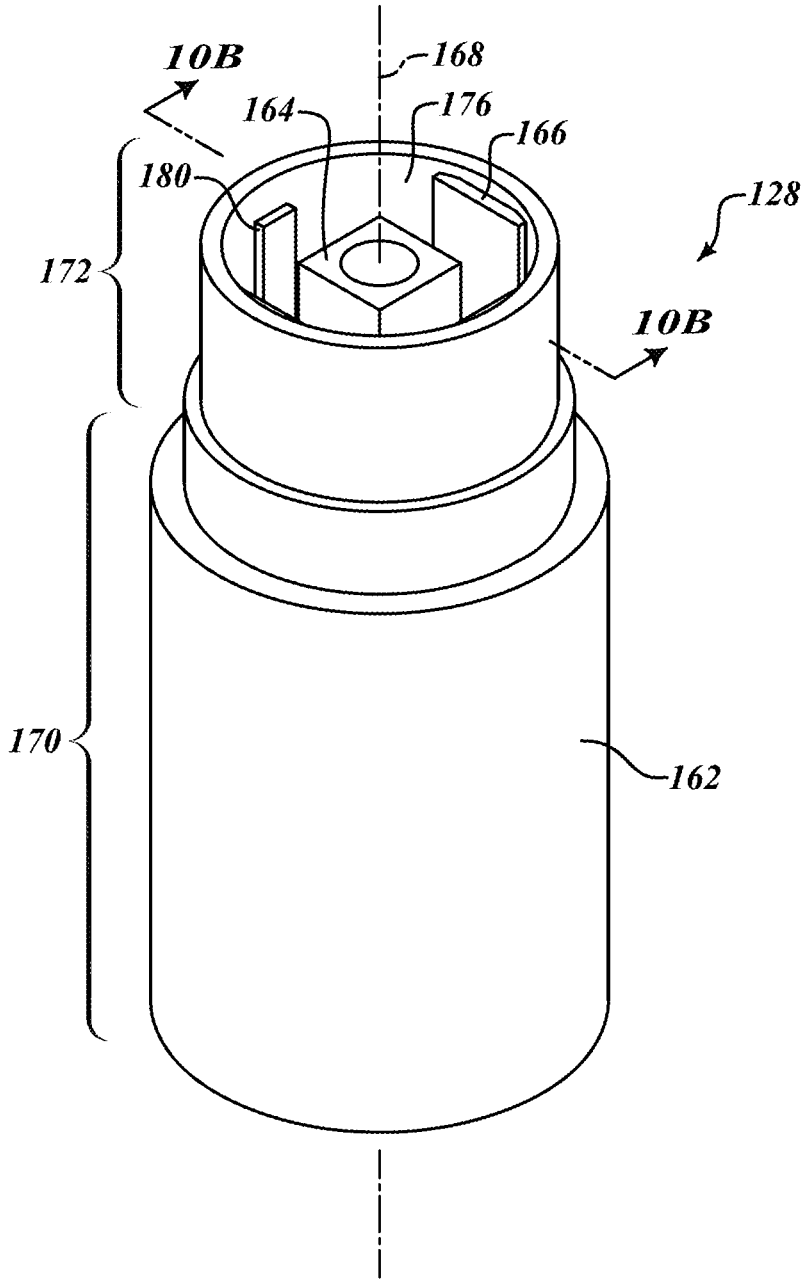
FIG. 10A is a perspective view of an electrical connector plug in accordance with one non-limiting illustrated embodiment of the subject matter described herein.
Figure 10B:
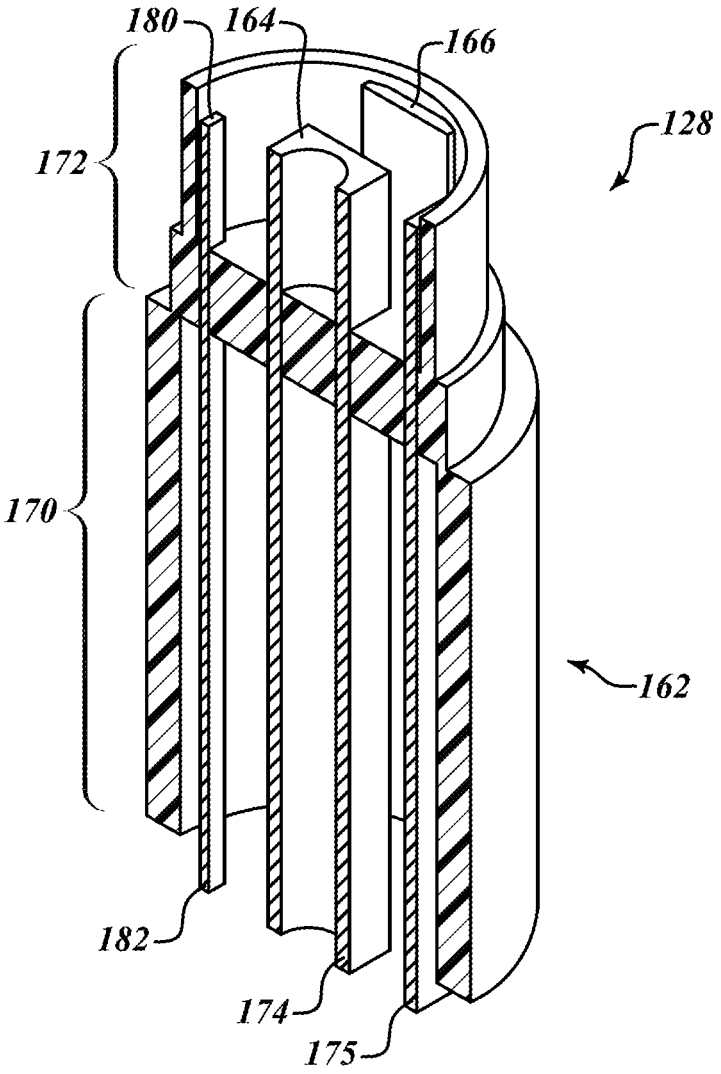
FIG. 10B is a cross-section view of the electrical connector plug illustrated in FIG. 10A taken along line 10B-10B in FIG. 10A.
Figure 10C:
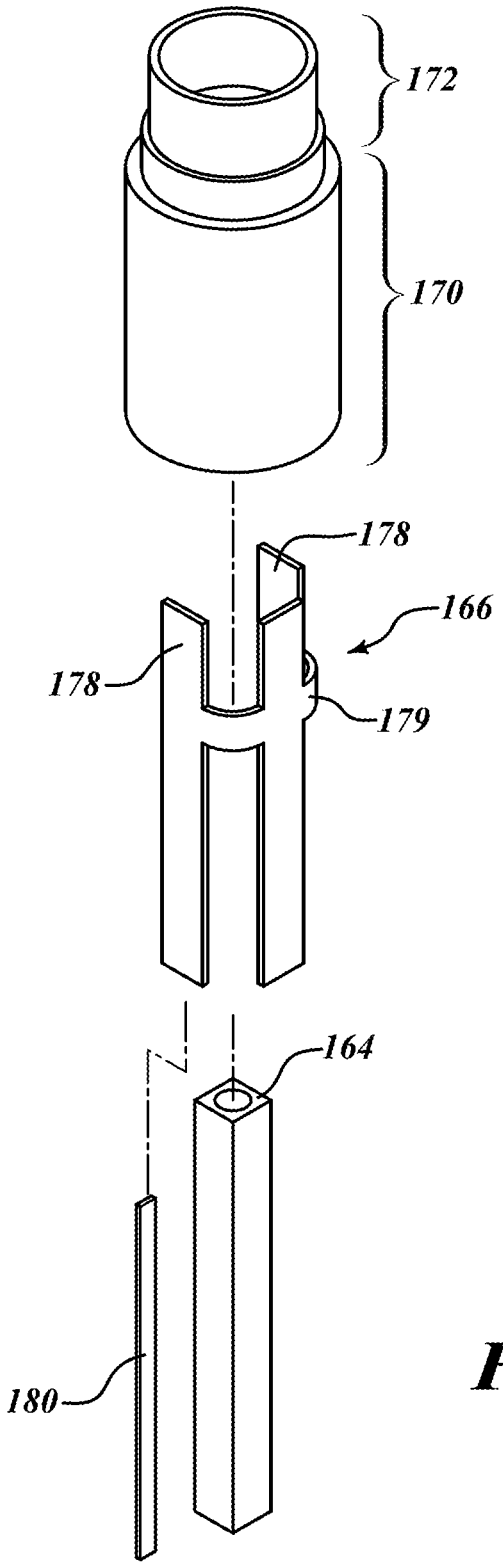
FIG. 10C is an exploded view of the electrical connector plug illustrated in FIG. 10A.

In the exemplary embodiment illustrated in FIGS. 4-6, first electrical connection terminal 102 and second electrical connection terminal 104 are illustrated as a single terminal, respectively; however, embodiments of the present disclosure are not limited to first electrical connection terminal 102 and second electrical connection terminal 104 being in the form of a single integral terminal. First electrical connection terminal 102 and second electrical connection terminal 104 can take different forms, such as a terminal that includes more than one contact pad. An example of such type of terminal is illustrated in FIGS. 10A-10C. In addition, while first electrical connection terminal 102 is illustrated in FIGS. 4-6 as being connected to a single first terminal connector 106, a plurality of first terminal connectors 106 can be provided and electrical connection terminal 102 connected to more than one first terminal connector 106. In addition, first terminal connector 106 can be of a different shape than illustrated in FIGS. 4-6 and first terminal body 110 can be of a different shape than illustrated in FIGS. 4-6. Similarly, while second electrical connection terminal 104 is illustrated in FIGS. 4-6 as being connected to a single second terminal connector 108, second electrical connection terminal 104 can be electrically connected to more than one second terminal connector 108. Furthermore when first electrically first electrical connection terminal 102 and/or second electrical connection terminal 104 are provided in the form of a terminal that includes more than one electrical contact pad, the individual contact pads can be electrically isolated from other contact pads and electrically connected to different first terminal connectors 106 and second terminal connectors 108, respectively.

Figure 7:
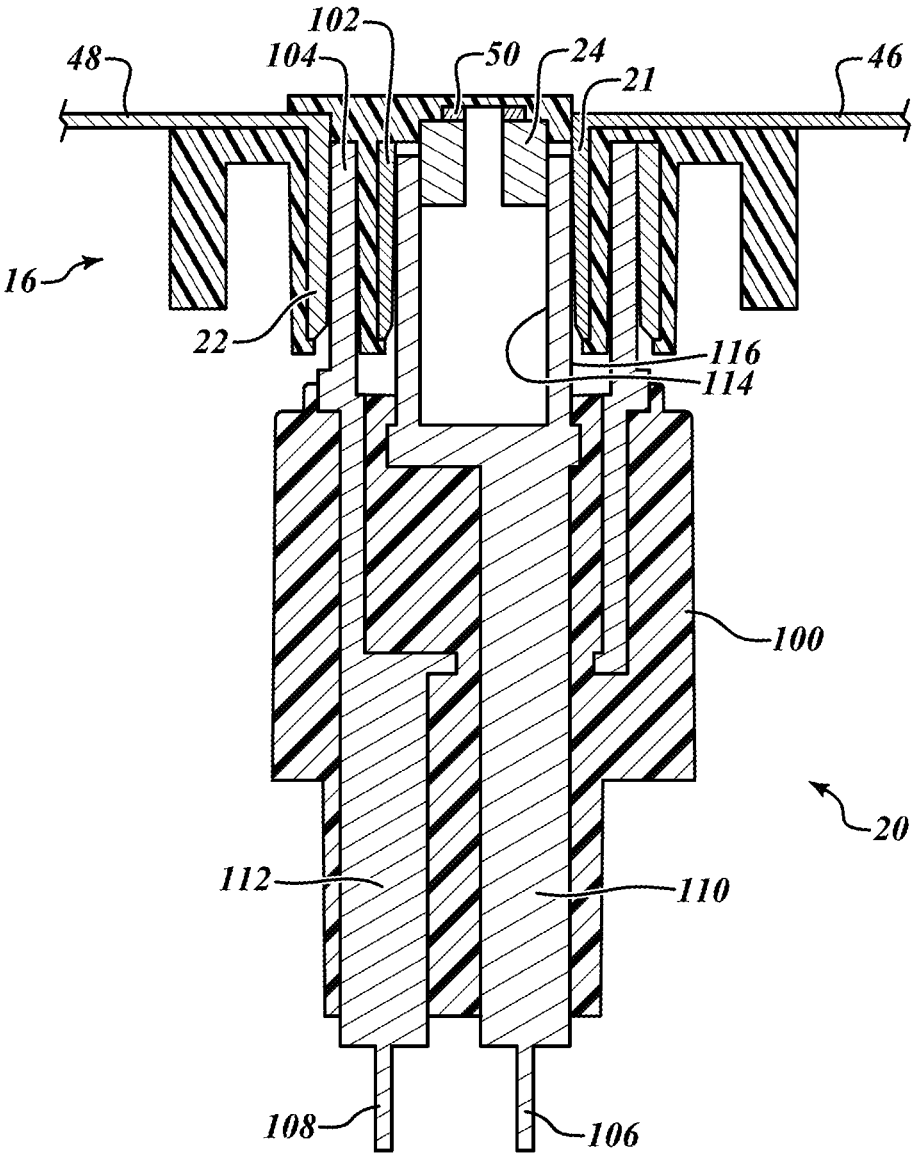
FIG. 7 is a cross-section of the electrical connector base illustrated in FIG. 2 and the electrical connector plug illustrated in FIG. 4 in a mated configuration.

Referring to FIG. 7, electrical connector 16 of FIGS. 2-3 and electrical connector plug 20 of FIGS. 4-6 are illustrated in a mated configuration. In FIG. 7, outer electrical contact pad surface 116 of first electrical connection terminal 102 makes an electrical connection with first electrically conductive terminal 21 by contacting the exposed surface of first electrically conductive terminal 21. Outer electrical contact pad surface 120 of second electrical connection terminal 104 makes an electrical connection with second electrically conductive terminal 22 of electrical connector 16 by contacting the exposed surface of second electrically conductive terminal 22. As a result, a portable electrical energy storage device or a device to be powered by or charge such portable electrical energy storage device that is connected to electrical connector 16 is electrically connected to a portable electrical energy storage device or a device to be powered by or charge such portable electrical energy storage device that is connected to electrical connector plug 20. Referring to the embodiments illustrated in FIG. 1, the shape of the electrical connector 16 and electrical connector plug 20 permit the insertion of a portable electrical energy storage device into a receptacle for the portable electrical energy storage device in an unlimited number of rotational orientations, while still establishing an effective and safe electrical connection between the electrical connector 16 and the electrical connector plug 20.

As seen in FIG. 7, when electrical connector 16 is mated with electrical connector plug 20, electrical connection test terminal 24 comes into electrical contact with inner electrical contact pad surface 114 of connection plug 20. When electrical connection test terminal 24 electrically contacts inner electrical contact pad surface 114 when outer electrical contact pad surface 116 is in electrical contact with first electrically conductive terminal 21 of electrical connector 16, electrical connection test terminal 24 is at the same voltage as first electrically conductive terminal 21. This voltage can be detected by a sensor connected to connection test terminal connector 50. Detection of this voltage provides a confirmation that first electrical connection terminal 102 of connection plug 20 is electrically connected to first electrically conductive terminal 21 of electrical connector 16.

As seen in FIG. 7, when electrical connector 16 is mated with electrical connector plug 20, electrical connection test terminal 24 of electrical connector 16 makes electrical contact with inner electrical contact pad surface 114 of connection plug 20. When electrical connection test terminal 24 electrically contacts inner electrical contact pad surface 114 when outer electrical contact pad surface 116 is in electrical contact with first electrically conductive terminal 21 of electrical connector 16, electrical connection test terminal 24 is at the same voltage as first electrically conductive terminal 21. The electrical connection test terminal 24 is connected to one terminal of a voltage sensor (not shown) via connection test terminal connector 50 for connection test terminal 24. Second electrically conductive terminal 22 is electrically connected to the other terminal of the voltage sensor (not shown) via second terminal connector 48. The voltage sensor is configured to detect the voltage between electrical connection test terminal 24 and second electrically conductive terminal 22. When electrical connector 16 is electrically connected to a portable electrical energy storage device, comparison of this detected voltage to the voltage of the portable electrical energy storage device to which electrical connector 16 is connected provides an indication of whether an electrical contact has been established between first electrically conductive terminal 21 of electrical connector 16 and first electrical connection terminal 102 of electrical connector plug 20. An electrical connection between these terminals will be indicated by the voltage detected by the voltage sensor being substantially equal to the voltage of the portable electrical energy storage device. When electrical connector 16 is electrically connected to a device to be powered by or charge a portable electrical energy storage device and the electrical connector plug 20 is electrically connected to the portable electrical energy storage device, comparison of the voltage detected by the voltage sensor to the voltage of the portable electrical energy storage device provides an indication of whether an electrical contact has been established between first electrically conductive terminal 21 of electrical connector 16 and first electrical connection terminal 102 of electrical connector plug 20 and between second electrically conductive terminal 22 of electrical connector 16, second electrical connection terminal 104 of electrical connector plug 20 and second electrical conductive terminal 22 of electrical connector 16.

The present description has not identified the polarity of the first electrically conductive terminal 21 and second electrically conductive terminal 22 of the electrical connector 16 or the polarity of the first electrical connection terminal 102 and the second electrical connection terminal 104 of the electrical connector plug 20. In accordance with embodiments described herein, the polarity of the different terminals can vary provided the first electrically conductive terminal 21 of electrical connector 16 is of the same polarity as the first electrical connection terminal 102 of the electrical connector plug 20. Similarly, the polarity of the second electrical conductive terminal 22 of electrical connector 16 should be of the same polarity as the second electrical connection terminal 104 of the electrical connector plug 20.

Figure 8:
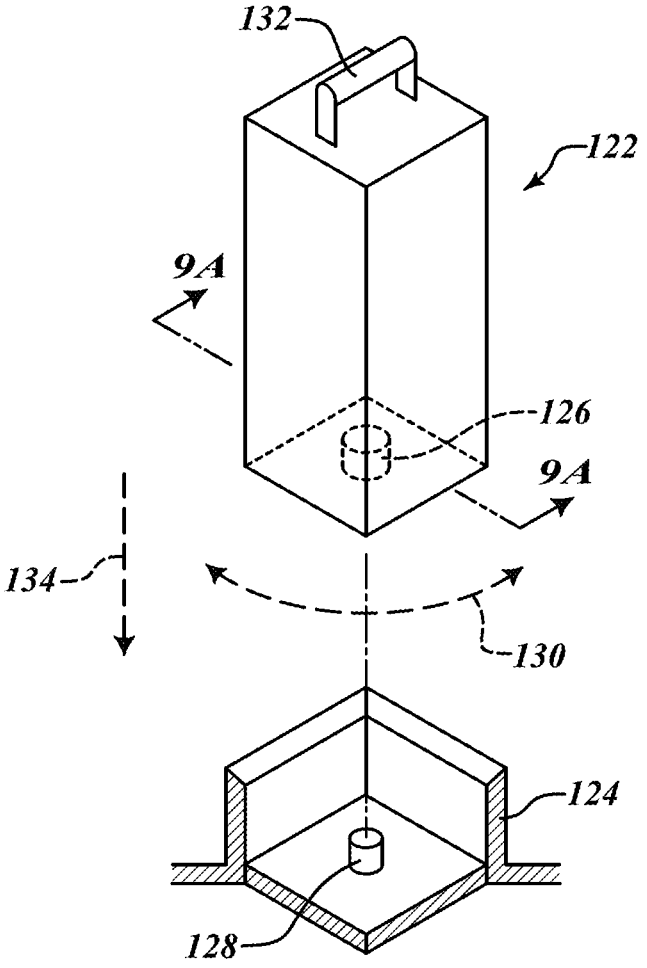
FIG. 8 is a schematic view illustrating receipt of a portable electrical energy storage device including an electrical connector base in accordance with embodiments described herein by an electrically powered device including an electrical connector plug in accordance with additional embodiments described herein.

Referring to FIG. 8, another example of an electrical connector 126 and the electrical connector plug 128 in accordance with embodiments described herein is illustrated. In FIG. 8, a battery pack 122 includes an electrical connector 126, and a battery pack receptacle 124 includes an electrical connector plug 128. Like battery pack 10 of FIG. 1, the battery pack 122 contains one or more individual portable electrical energy storage devices. These portable electrical energy storage devices can be arranged in different configurations, including single or multiple layers of individual electrical energy storage devices, each layer including one or more individual portable electrical energy storage devices. Battery pack 122 has a cross-section taken along line 9A-9A that has a shape that is not round, e.g., polygonal. In the illustrated embodiment the battery pack 122 has a cross-section taken along line 9A-9A that is square. Battery packs in accordance with embodiments described are not limited to those that have a square cross-section as shown in FIG. 8, but include battery packs that have a cross-section of a different polygonal shape, e.g., rectangular, triangular, pentagonal, hexagonal, heptagonal, octagonal and the like. Battery packs in accordance with embodiments described herein can have a cross-section that includes more than eight sides. Like battery pack 10 described with reference to FIGS. 1-7 which can be received in battery pack receptacle 18 in more than one rotational orientation, battery pack 122 can be received in battery pack receptacle 124 in more than one rotational orientation. For example, illustrated battery pack 122 can be received in battery pack receptacle 124 in up to four different rotational orientations by rotating the battery pack in the direction of arrow 130.

At one end, battery pack 122 includes a handle 132 attached to the battery pack 122. At an end of battery pack 122 opposite the end containing handle 132, battery pack 122 includes a multidirectional electrical connector 126 shown in phantom lines. Multidirectional electrical connector 126 is represented schematically and can have a different shape than that shown in phantom lines in FIG. 8. Receptacle 124 is sized and configured to receive battery pack 122 when a battery pack 122 is moved in the direction of arrow 134 in FIG. 8, and includes electrical connector plug 128. Electrical connector plug 128 is represented schematically in FIG. 8 and can have a different shape than that shown in FIG. 8. An advantage of electrical connector 126 and electrical connector plug 128 is their ability to cooperate with each other and electrically connect to each other when battery pack 122 is received in battery pack receptacle 124 in multiple rotational orientations. The ability to achieve an electrical connection between electrical connector 126 and electrical connector plug 128 in multiple rotational orientations of battery pack 122 relative to battery pack receptacle 124 reduces the likelihood that an ineffective electrical connection between electrical connector 126 and electrical connector plug 128 will result due to insertion of the battery pack 122 into battery pack receptacle 124 in an improper orientation. Thus, in accordance with embodiments described herein, electrical connector 126 and electrical connector plug 128 provide a multidirectional electrical connection system capable of providing an effective electrical connection in a plurality of rotational orientations whose effectiveness is not compromised due to insertion of a battery pack 122 into battery pack receptacle 124 in an improper orientation.

As with battery connector 16 illustrated in FIG. 1, specific embodiments are described herein with reference to connectors for electrically connecting portable electrical energy storage devices to an electrical system of electrically powered vehicles or devices for charging the portable electrical energy storage devices; however, the present disclosure and the reference to connectors for electrically connecting a portable electrical energy storage device to an electrical system of electrically powered vehicles or devices for charging the portable electrical energy storage devices is not limited to electrical systems for electrically powered vehicles or devices for charging portable electrical energy storage devices. Connectors of the type described herein are also useful for electrically connecting a portable electrical energy storage device to electrical systems of electrically powered devices other than electrically powered vehicles and devices for charging the portable electrical energy storage devices.

Details of another embodiment of the present disclosure are described below with reference to FIGS. 9A-9B, 10A-10C and 11. FIGS. 9A-9B, 10A-10C and 11 illustrate one exemplary embodiment of an electrical connector 126 electrically connected to a portable electrical energy storage device or to a device to be powered by or for charging the portable electrical energy storage device and an electrical connector plug 128 connected to a portable electrical energy storage device or to a device to be powered by or for charging the portable electrical energy storage device that is not connected to the electrical connector 126. Electrical connector 126 in the illustrated exemplary embodiment includes an electrically nonconductive connector base 136, a first electrically conductive terminal 138, a second electrically conductive terminal 140, and an electrical connection test terminal 142.

Electrically nonconductive connector base 136 includes a connector base outer wall 144. In the illustrated exemplary embodiment of FIGS. 9A-9B, 10A-10C and 11, electrically nonconductive connector base 136 is circular in shape when viewed along its longitudinal axis 147. The electrically nonconductive connector base 136 including connector base outer wall 144 is formed of a nonconductive material, such as plastic. Conventional techniques such as extrusion or injection molding can be used to form nonconductive connector base 136 and connector base outer wall 144. Electrically nonconductive connector base 136 further includes an annular shaped electrical contact housing 146 that includes an inner surface 148 and an outer surface 150. Electrical contact housing 146 is formed out of an electrically nonconductive material, such as an electrically nonconductive plastic. In the illustrated embodiment, the electrical contact housing 146 is integral with the electrically nonconductive connector base 136. Thus, in the illustrated embodiment, electrically nonconductive connector base 136 including connector base outer wall 144 and electrical contact housing 146 is an integral element; however, electrically nonconductive connector base 136 need not be an integral element, for example, conductive base outer wall 144 and electrical contact housing 146 can be formed separately and attached to each other. In the exemplary embodiment illustrated in FIG. 9A, annular shaped electrical contact housing 146 is a quadrilateral with equal opposing angles when viewed along longitudinal axis 147. In the illustrated embodiment, the quadrilateral has all sides of equal length. Annular shaped electrical contact housing 146 can be of other polygonal shapes besides a square, for example, annular shaped electrical contact housing 146 can have the shape of a rectangle, pentagon, hexagon, heptagon, octagon or other polygon with more than eight sides. Inner surface 148 of the electrical contact housing 146 is located closer to longitudinal axis 147 than outer surface 150 of the electrical contact housing 146. Outer surface 150 of the electrical contact housing 146 is separated from connector base outer wall 144 by an electrically nonconductive medium, such as air or other electrically nonconductive medium, such as a nonconductive plastic.

Inner surface 148 of electrical contact housing 146 includes first electrically conductive terminal 138. In the illustrated exemplary embodiment, first electrically conductive terminal 138 is a ring-shaped member conforming to the shape of the inner surface 148 of the electrical contact housing 146. First electrically conductive terminal 138 includes a plurality of electrical contact pads 152. In the exemplary embodiment illustrated in FIGS. 9A and 9B, first electrically conductive terminal 138 includes four electrical contact pads 152, one positioned on each of the four inner surfaces 148 of the square shaped annular electrical contact housing 146. First electrically conductive terminal 138 can include more than four or less than four electrical contact pads 152. Embodiments described herein are not limited to first electrically conductive terminal 138 including four electrical contact pads 152. As illustrated in FIG. 9B, the contact pads 152 of first electrically conductive terminal 138 are electrically connected along their base. In the illustrated embodiment, first electrically conductive terminal 138 is electrically connected at its base to a first terminal connector 154. First terminal connector 154 can be electrically connected to a portable electrical energy storage device or a device to be powered by or for charging the portable electrical energy storage device, thus providing an electrical connection between the portable electrical energy storage device or the device to be powered by or for charging the portable electrical energy storage device and the first electrically conductive terminal 138.

Outer surface 150 of electrical contact housing 146 includes a second electrical conductive terminal 140. In the illustrated exemplary embodiment, second electrical conductive terminal 140 is a ring-shaped member conforming to the shape of outer surface 150 of the electrical contact housing 146. Second electrically conductive terminal 140 includes a plurality of electrical contact pads 156. In the exemplary embodiment illustrated in FIGS. 9A and 9B, second electrically conductive terminal 140 includes four electrical contact pads 156, one positioned on each of the four outer surfaces 150 of the square shaped annular electrical contact housing 146. Second electrically conductive terminal 140 can include more than four or less than four electrical contact pads 156. Embodiments described herein are not limited to second electrical conductive terminal 140 including four electrical contact pads 156. As illustrated in FIG. 9B, contact pads 156 of second electrically conductive terminal 140 are electrically connected along their base. Second electrically conductive terminal 140 is electrically connected at its base to a second terminal connector 158. Second terminal connector 158 can be electrically connected to a portable electrical energy storage device or a device to be powered by or for charging a portable electrical energy storage device, thus providing an electrical connection between the portable electrical energy storage device or the device to be powered by or for charging the portable electrical energy storage device and the second electrically conductive terminal 140. In order to avoid obscuring aspects of the subject matter described herein, details of how first terminal connector 154 and second terminal connector 158 are electrically connected to a portable electrical energy storage device or an electrically powered device are omitted.

In the exemplary embodiment illustrated in FIGS. 9A and 9B, electrical connection test terminal 142 of electrical connector 126 is an electrically conductive member in the shape of a cylinder centered along longitudinal axis 147. Electrical connection test terminal 142 is positioned radially inward of first electrically conductive terminal 138. The upper surface of electrical connection test terminal 142 is recessed below the upper surfaces of conductive base outer wall 144, electrical contact housing 146, first electrically conductive terminal 138 and second electrically conductive terminal 140. Electrical connection test terminal 142 is electrically connected to connection test terminal connector 160. In the illustrated embodiment, electrical connection test terminal 142 is electrically connected to connection test terminal connector 160 at its bottom; however, electrical connection between electrical connection test terminal 142 and connection test terminal connector 160 need not be at the bottom of connection test terminal 142. Connection between connection test terminal 142 and electrical connection test terminal connector 160 can occur at different locations along the body of electrical connection test terminal 142.

Referring to FIGS. 10A-10C and 11, an exemplary electrical connector plug 128 in accordance with embodiments described herein is illustrated. Electrical connector plug 128 includes a nonconductive plug housing 162, a first electrical terminal 164 and a second electrical terminal 166. The first electrical terminal 164 and second electrical terminal 166 are sized and shaped to mate with the electrical connector 126 and its respective components. When mated, electrical connection is made between electrical connector 126 and electrical connector plug 128.

Nonconductive plug housing 162 includes a plug body 170 comprising an electrically nonconductive material, such as an electrically nonconductive plastic. Plug body 170 has a cylindrical shape and is centered along plug housing longitudinal axis 168. From one end of plug body 170 (the top end in FIG. 10A), first electrical terminal 164 and a second electrical terminal 166 protrude. First electrical terminal 164 and second electrical terminal 166 are formed out of an electrically conductive material, such as an electrically conductive metal. At the end of plug body 170 where first electrical terminal 164 and second electrical terminal 166 protrude, an annular terminal housing 172 protrudes from plug body 170 beyond the ends of first electrical terminal 164 and second electrical terminal 166. In the embodiment illustrated in FIG. 10A, annular terminal housing 172, when viewed along longitudinal axis 168, has a round shape; however, the shape of annular terminal housing is not limited to a round shape. For example, when the shape of the gap between outer surface 150 of electrical contact housing 146 and conductor-base inner wall 145 of connector 126 in FIG. 9A is something other than round, annular terminal housing 172 will have a complementary non-round shape. For example, if the shape of the gap between the outer surface 150 of the electrical contact housing 146 and conductor base inner wall 145 is square, annular terminal housing 172 will have a complementary square shape and will be sized to be received into that gap. One of the reasons the shapes are complementary is so annular terminal housing 172 can be received into the gap between outer surface 150 of electrical contact housing 146 and conductor base inner wall 145, thus allowing connector 126 and plug 128 to mate with each other.

At the end of nonconductive plug housing 162 opposite annular terminal housing 172 (the bottom end in FIG. 10A), first terminal connector 174 of first electrical terminal 164 and second terminal connector 175 of second electrical terminal 166 protrude from nonconductive plug body 170. Alternatively, first terminal connector 174 and second terminal connector 175 do not protrude from nonconductive plug body 170, but rather are accessible within nonconductive body 170. In FIG. 10B the interior of nonconductive plug body 170 is shown as being hollow. In accordance with other embodiments described herein, nonconductive plug body 170 is filled with a nonconductive material, such as a nonconductive plastic, and the first terminal connector 174 and second terminal connector 175 extend through and protrude from this nonconductive material at an end of the nonconductive plug body 170 that is opposite annular electrical terminal housing 172. First terminal connector 174 and second terminal connector 175 provide electrical connectors for making an electrical connection with first electrical terminal 164 and second electrical terminal 166. In order to avoid obscuring aspects of the subject matter described herein, details of how first terminal connector 174 and second terminal connector 175 are electrically connected to the portable electrical energy storage device or an electrically powered device are omitted.

In the embodiment illustrated in FIGS. 10A-10C, first electrical terminal 164 is formed out of an electrically conductive material, such as a conductive metal. When viewed along longitudinal axis 168, first electrical terminal 164 has a square shape and includes a cylindrical bore centered on longitudinal axis 168 that passes through first electrical terminal 164. First electrical terminal 164 may have a shape other than the illustrated square shape, for example, first electrical terminal 164 can have a circular shape when viewed along longitudinal axis 168 or it can have a polygon shape other than a square, for example, a triangle, rectangle, pentagon, hexagon, octagon, or a polygon having more than eight sides. Preferably, first electrical terminal 164 has a shape that complements the shape of the electrical contact housing 146 of electrical connector 126 in FIG. 9A. When the shape of first electrical terminal 164 complements the shapes of the electrical contact housing 146 (e.g., the shape of first electrical terminal 164 and the shape of electrical contact housing 146 are related in a male plug/female receptacle relationship), first electrical connection terminal 164 can be received in electrical contact housing 146 and the two are able to mate with each other.

In the exemplary embodiment illustrated in FIGS. 10A-10C, an inner surface of annular electrical terminal housing 172 includes a second electrical connection terminal 166. Second electrical terminal 166 is formed out of an electrically conductive material, such as an electrically conductive metal. As illustrated in FIG. 10C, second electrical terminal 166 includes three contact pads 178 that are offset from each other by 90° along inner surface 176 of electrical terminal housing 172. While the exemplary embodiment of FIGS. 10A-10C illustrates three contact pads 178, a greater number or a lesser number of contact pads 178 can be employed in accordance with embodiments described herein. For example, only one or two contact pads 178 can be utilized. As illustrated in FIG. 10C, contact pads 178 are electrically connected to each other at their base 179. In the embodiment illustrated in FIG. 10A-10C, base 179 extends through the nonconductive plug body 170 to the end of nonconductive plug body 170 opposite annular electrical terminal housing 172.

Located adjacent inner surface 176 of annular electrical terminal housing 172 is a connection test terminal 180. Connection test terminal 180 is an electrically conductive material such as an electrically conductive metal. In the embodiment illustrated in FIGS. 10A-10C, connection test terminal 180 is spaced apart 90° from two contact pads 178 of second electrical terminal 166 and extends from annular electrical terminal housing 172 through nonconductive plug body 170, and in the illustrated embodiment protrudes from an end of nonconductive plug body 170 that is opposite the end of nonconductive plug body 170 adjacent annular electrical terminal housing 172. This protruding end of connection test terminal 180 provides an electrical connector 182 for making an electrical connection to connection test terminal 180.

First terminal connector 174 and second terminal connector 175 provide electrical connection points for connecting first electrical terminal 164 and second electrical terminal 166 to a portable electrical energy storage device or to a device to be powered by or for charging the portable electrical energy storage device.

Figure 11:
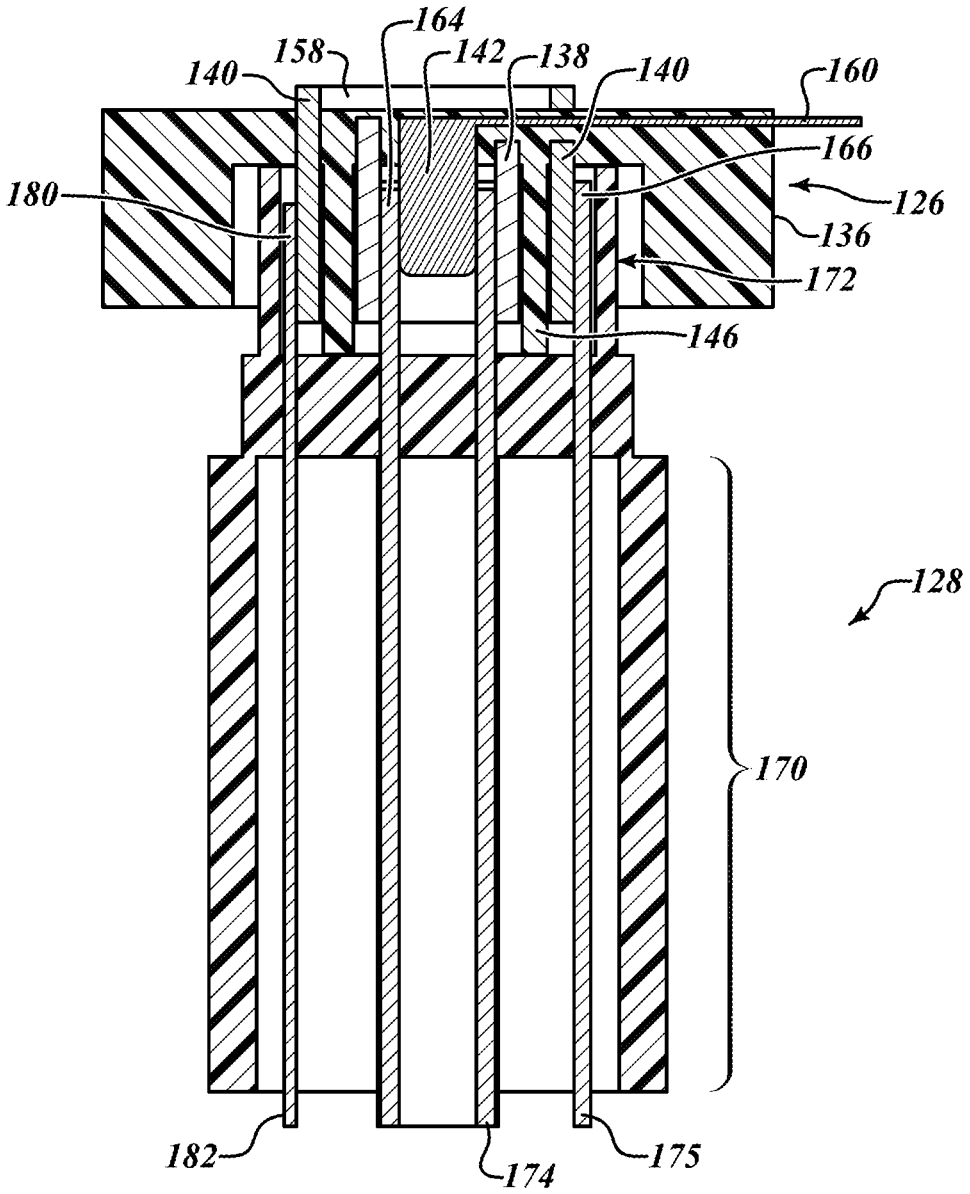
FIG. 11 is a cross-section of the electrical connector base illustrated in FIG. 10A and the electrical connector plug illustrated in FIG. 8 in a mated configuration.

Referring to FIG. 11, electrical connector 126 of FIGS. 9A and 9B and electrical connector plug 128 of FIGS. 10A-10C are illustrated in a mated configuration. In this mated configuration, first electrical terminal 138 of electrical connector 126 makes electrical contact with first electrical terminal 164 of the electrical connector plug 128. Second electrical terminal 140 of electrical connector 126 makes electrical contact with second electrical terminal 166 of electrical connector plug 128. As a result, a portable electrical energy storage device or a device to be powered by or for charging such portable electrical energy storage device that is connected to electrical connector 126 is electrically connected to a portable electrical energy storage device or a device to be powered by or for charging such portable electrical energy storage device that is connected to electrical connector plug 128.

Referring to FIG. 8, the size and shape of electrical connector 126 and the complementary size and shape of electrical connector plug 128 permit a user to insert the battery pack 122 into the battery pack receptacle 124 in a plurality of rotational orientations relative to each other, while establishing a useful and safe electrical connection between the electrical connector 126 and the electrical connector plug 128.

As seen in FIG. 11, when electrical connector 126 is mated with electrical connector plug 128, electrical connection test terminal 142 of electrical connector 126 makes electrical contact with first electrical terminal 164 of electrical connector plug 128. When electrical connector 126 is mated with electrical connector plug 128, electrical connection test terminal 180 of electrical connector plug 128 makes electrical contact with second electrical terminal 140 of electrical connector 126. Electrical connection test terminal 180 is electrically connected to one terminal of a voltage sensor (not shown) via electrical connector 182 for connection test terminal 180. When electrical connector 126 is mated with electrical connector plug 128, electrical connection test terminal 142 of electrical connector 126 makes electrical contact with first electrical terminal 164 of electrical connector plug 128. Electrical connection test terminal 142 of electrical connector plug 128 is electrically connected to another terminal of the voltage sensor (not shown) via electrical connection test terminal connector 160 for connection test terminal 142. When electrical connection test terminal 180 contacts second electrical terminal 140 and electrical connection test terminal 142 contacts first electrical terminal 164, electrical connection test terminal 180 will be at the same voltage as second electrical terminal 140 and electrical connection test terminal 142 will be at the same voltage as first electrical terminal 164. The voltage sensor is configured to detect the voltage between electrical connection test terminal 180 and electrical connection test terminal 142. Comparison of this detected voltage to the voltage of the portable electrical energy storage device to which electrical connector 126 or electrical connector plug 128 are connected provides an indication of whether an electrical contact has been established between first electrical terminal 164 of electrical connector plug 128 and first electrical terminal 138 of electrical connector 126 and second electrical terminal 166 of electrical connector plug 128 and second electrical terminal 140 of electrical connector 126. Electrical connection between these terminals will be indicated by the voltage detected by the voltage sensor being substantially equal to the voltage of the portable electrical energy storage device. The configuration of an independent electrical connection test terminal 180 illustrated in FIGS. 10A-C and 11 can also be implemented in the electrical connection system described with reference to FIGS. 1-7. For example an independent connection test terminal can be provided in electrical connector plug 20.

In accordance with embodiments described herein, portable electrical energy storage devices can be removably received by receptacles for the portable electrical energy storage devices. In FIGS. 1 and 8 electrical connectors 16 and 126 are illustrated as part of portable electrical energy storage devices 12 and 122, respectively. The same figures illustrate electrical connector plugs 20 and 128 as part of portable electrical energy storage device receptacles 18 and 128, respectively. Embodiments described herein are not limited to electrical connectors 16 or 126 being part of portable electrical energy storage devices. For example, electrical connectors 16 and 126 may be part of receptacles 18 or 128 for receiving portable electrical energy storage devices. When receptacles 18 or 128 include electrical connectors 16 or 126, portable electrical energy storage devices 12 or 122 will include the counterpart electrical connector plug 20 or 128.

An advantage of an electrical connection system including the electrical connector and electrical connection plug in accordance with embodiments described herein is the ability to establish an electrical connection between a portable electrical energy storage device and a device to be powered by or for charging the portable electrical energy storage device in a plurality of rotational orientations and, in the embodiments of FIGS. 1-8, an infinite number of rotational orientations. In accordance with embodiments described herein, a multidirectional or omni-directional electrical connection system is provided whereby electrical connection between an electrical connector and an electrical connection plug can be established in a plurality of rotational orientations and in some cases in an infinite number of rotational orientations. The ability to make electrical connections in a plurality or infinite number of rotational orientations reduces the likelihood of a faulty electrical connection due to a user inserting a battery pack into a battery pack receptacle in an improper rotational orientation. Electrical connections between a device including an electrical connector and a device including an electrical connector plug in accordance with embodiments described herein can be made when the devices are mated with each other in a plurality of rotational orientations. The ability to make electrical connections in a plurality of rotational orientations has other advantages, such as reducing the likelihood that damage will be done to the electrical connector or electrical connector plug due to the portable electrical energy storage device being inserted into the receptacle in an orientation in which an electrical connection cannot be made between the electrical connector and electrical connection plug or an orientation in which the electrical connector and electrical connection plug cannot mate physically with each other.

In accordance with additional embodiments of the subject matter described herein, multidirectional electrical connection systems capable of establishing an electrical connection between a portable electrical energy storage device and a device to be powered by or for charging the portable electrical energy storage device in a plurality of rotational orientations include electrical terminal patterns such as those illustrated in FIGS. 12-14.

Figure 12A:
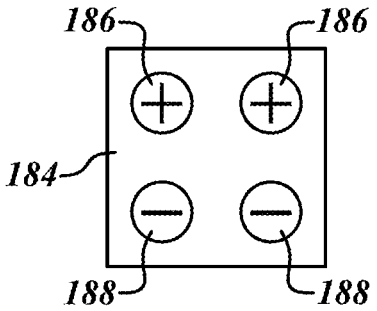
FIGS. 12A-12C are schematic illustrations of non-limiting illustrated embodiments of electrical connection terminals located on a portable electrical energy storage device and electrical connection terminals located on a device to be powered by the portable electrical energy storage device or a device for charging such portable electrical energy storage device.
Figure 12B:
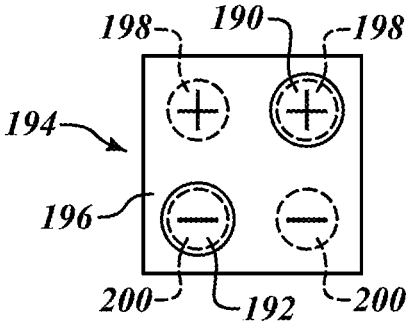
Figure 12C:
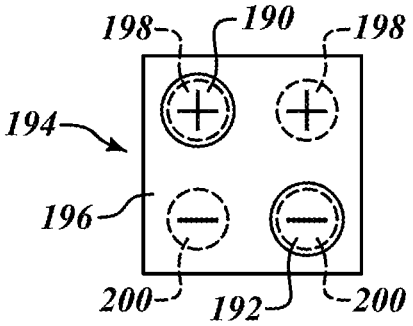

Referring to FIGS. 12A-12C, FIG. 12A is a schematic illustration of a top of a receptacle 184 for receiving a portable electrical energy storage device 194 and making electrical connection between electrical terminals of the receptacle and electrical terminals of a portable electrical energy storage device in two different rotational orientations of the portable electrical energy storage device 194 relative to receptacle 184. More specifically, FIG. 12A is a top down schematic illustration of the bottom of a receptacle 184 for receiving a portable electrical energy storage device (not shown). In the illustrated embodiment, the bottom of receptacle 184 includes two positive electric terminals 186 arranged in a horizontal row and two negative terminals 188 arranged in a horizontal row below positive electric terminals 186. FIG. 12B illustrates an arrangement of a positive terminal 190 and a negative terminal 192 located on the bottom of a portable electrical energy storage device 194 that has been received by receptacle 184 in a first rotational orientation. In this exemplary embodiment, positive terminal 190 is located in an opposite corner of portable electrical energy storage device 194 from negative terminal 192. Dotted line 196 identifies the outline of receptacle 184. Dotted lines 198 and 200 identify positive terminals 186 and negative terminals 188 of receptacle 184. FIG. 12C illustrates the position of positive terminal 190 and negative terminal 192 after portable electrical energy storage device 194 is rotated counterclockwise by 90°, placing portable electrical energy storage device 194 in a second rotation orientation relative to receptacle 184.

Figure 13A:
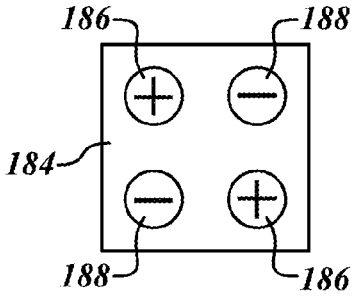
FIGS. 13A-13E are schematic illustrations of further non-limiting illustrated embodiments of electrical connection terminals located on a portable electrical energy storage device and electrical connection terminals located on a device to be powered by such portable electrical energy storage device or a device for charging such portable electrical energy storage device.
Figure 13B:
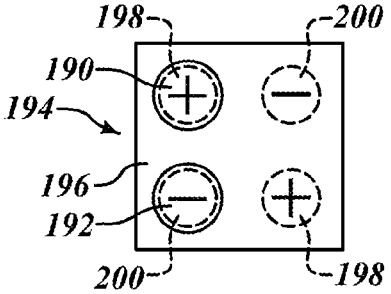
Figure 13C:
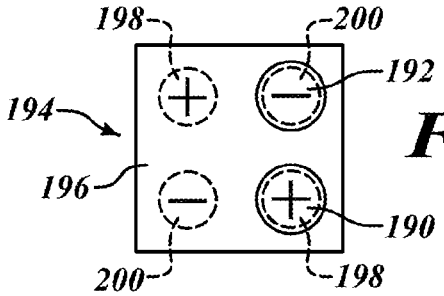

FIG. 13A is a schematic illustration of a different configuration of electrical terminals in a receptacle 184 for receiving a portable electrical energy storage device 194 and electrical terminals on the portable electrical energy storage device for making electrical connection between the receptacle and the portable electrical energy storage device in two different rotational orientations. More specifically, FIG. 13A is a top down schematic illustration of the bottom of a receptacle 184 for receiving a portable electrical energy storage device (not shown). In the illustrated embodiment, the bottom of receptacle 184 includes two positive electric terminals 186 and two negative electric terminals 188. Positive electric terminals 186 are located in opposite corners of the receptacle and negative terminals 188 are located in the remaining opposing corners. FIG. 13B illustrates an arrangement of a positive terminal 190 and a negative terminal 192 located on the bottom of a portable electrical energy storage device 194 that has been received by receptacle 184. In this exemplary embodiment, positive terminal 190 is located in a corner of portable electrical energy storage device 194 above a corner occupied by negative terminal 192. Dotted line 196 identifies the outline of receptacle 184. Dotted lines 198 and 200 identify positive terminals 186 and negative terminals 188 of receptacle 184 respectively. FIG. 13C illustrates the position of positive terminal 198 and negative terminal 192 after portable electrical energy storage device 194 has been rotated counterclockwise by 180°. In this manner, receptacle 184 and portable electrical energy storage device 194 cooperate so that an electrical connection between the electrical terminals of receptacle 184 and the electrical terminals of portable electrical energy storage device 194 can be made in two different rotational orientations of the receptacle 184 relative to the portable electrical energy storage device 194.

Figure 13D:
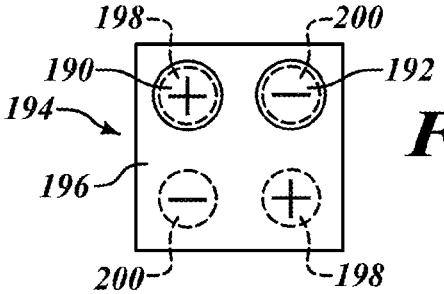
Figure 13E:
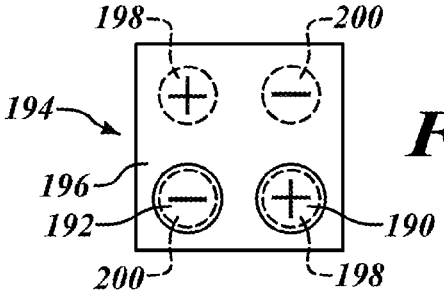

FIG. 13D illustrates another arrangement of a positive terminal 190 and a negative terminal 192 located on the bottom of a portable electrical energy storage device 194 that has been received by receptacle 184. In FIG. 13D, the arrangement of positive terminals 186 and negative terminals 188 at the bottom of receptacle 184 are the same as described and illustrated in FIGS. 13A-13C. In this exemplary embodiment, positive terminal 190 is located in a corner of portable electrical energy storage device 194 adjacent a corner occupied by negative terminal 192. Dotted line 196 identifies the outline of receptacle 184. Dotted lines 198 and 200 identify positive terminals 186 and negative terminals 188 of receptacle 184. FIG. 13E illustrates the position of positive terminal 190 and negative terminal 192 after portable electrical energy storage device 194 has been rotated counterclockwise 180°. In this manner, receptacle 184 and portable electrical energy storage device 194 cooperate so that an electrical connection between the electrical terminals of receptacle 184 and the electrical terminals of portable electrical energy storage device 194 can be made in two different rotational orientations of the receptacle 184 relative to the portable electrical energy storage device 194.

Though not illustrated, electrical connections between the receptacle 184 and portable electrical energy storage device 194 illustrated in FIGS. 12A-12C and 13A-13D in at least two rotational orientations can also be achieved if the illustrated arrangement of positive and negative terminals at the bottom of receptacle 184 are provided on the bottom of portable electrical energy storage device 194 and the arrangement of positive and negative terminals at the bottom of portable electrical energy storage device 194 are provided at the bottom of receptacle 184.

Figure 14A:
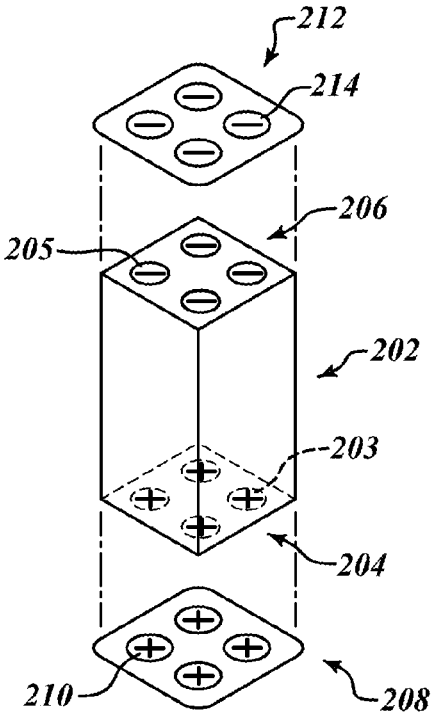
FIGS. 14A-14D are schematic illustrations of additional non-limiting illustrated embodiments of electrical terminals located on a portable electrical energy storage device and electrical connection terminals located on a device to be powered by such portable electrical energy storage device or a device for charging such portable electrical energy storage device.
Figure 14B:
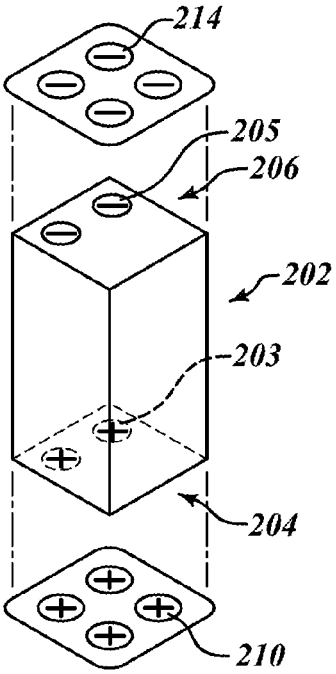
Figure 14C:
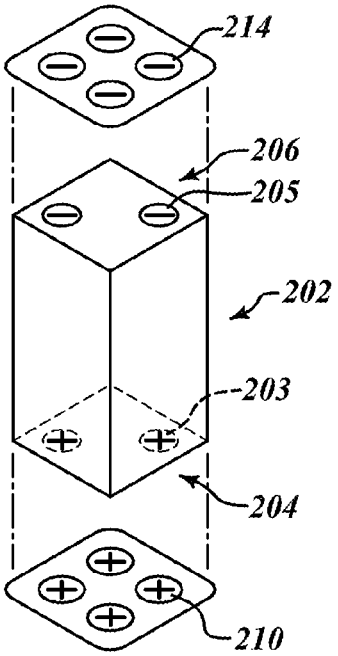
Figure 14D:
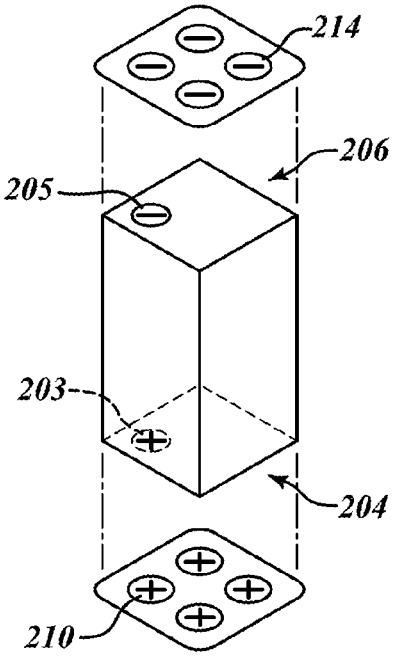

In contrast to the embodiments illustrated in FIGS. 12A-12C and 13A-13E, electrical connection systems illustrated in FIGS. 14A-14D do not include positive terminals and negative terminals located at the same end of a portable electrical energy storage device or a receptacle for the portable electrical energy storage device, but rather positive terminals 203 are located at one end 204 of portable electronic storage device 202 and negative terminals 205 are located at an opposite end 206 of portable electrical energy storage device 202. In the embodiment illustrated in FIG. 14A, positive terminals 210 are located in the bottom (schematically illustrated as 208) of a receptacle for receiving portable electrical energy storage device 202. The top of the receptacle (schematically illustrated as 212) includes four negative terminals 214. With the arrangement of positive terminals 203 and negative terminals 205 on portable electrical energy storage device 202 shown in FIG. 14A and the arrangement of positive terminals 210 and negative terminals 214 at the bottom and top of the receptacle for receiving portable electrical energy storage device 202 shown in FIG. 14A, the portable electrical energy storage device 202 can be received into the receptacle in at least four different rotational orientations relative to the receptacle. FIGS. 14B-14D illustrate further arrangements of positive electrical terminals 203 on the bottom of portable electrical energy storage device 202 and arrangement of negative electrical terminals 205 on the top of portable electrical energy storage device 202. In FIG. 14B, two negative terminals 205 are located along one edge of the top end 206 of portable electrical energy storage device 202 and two positive electrical terminals are located along the same edge of the bottom end 204 of portable electrical energy storage device 202. In accordance with embodiments of the subject matter described herein, the pair of negative electrical terminals 205 need not be positioned along the same edge as the pair of positive electrical terminals 203. For example, the pair of positive electrical terminals 203 can be positioned along an edge of portable electrical energy storage device 202 that is opposite the edge along which negative terminals 205 are located or adjacent the edge along which negative terminals 205 are located. FIG. 14C illustrates embodiments in accordance with the present disclosure that include a pair of negative terminals 205 located in opposite corners of the top end 206 of portable electrical energy storage device 202 and a pair of positive terminals 203 located in the same opposite corners of the bottom end 204 of portable electrical energy storage device 202. In accordance with embodiments of the subject matter described herein, the pair of negative electrical terminals 205 need not be located in the same opposite corners as the pair of positive electrical terminals 203. For example, the pair of negative electrical terminals 205 can be located in unoccupied opposing corners of the top 206 of portable electrical energy storage device 202.

FIG. 14D illustrates embodiments in accordance with the present disclosure that include a single negative terminal 205 located in a corner of the top end 206 of portable electrical energy storage device 202 and a single positive terminal 203 located in the same corner of the bottom end 204 of portable electrical energy storage device 202. In accordance with embodiments of the subject matter described herein, negative electrical terminal 205 need not be located in the same corner as the positive electric terminals 203. For example, negative electrical terminal 205 can be located in an unoccupied corner of the top 206 of portable electrical energy storage device 202.

In FIGS. 14A-14D, fewer negative electrical terminals 214 can be provided at the top 212 of the receptacle for portable electrical energy storage device 202 and fewer positive electrical terminals 210 can be provided at the bottom 208 of the receptacle for portable electrical energy storage device 202. Such negative electrical terminals 214 and positive electrical terminals 210 can be provided at numerous locations, provided such locations cooperate with the locations of negative terminals 205 and positive terminals 203 of portable electrical energy storage device 202 and provide for making an electrical connection between the terminals of the receptacle and the terminals of the portable electrical energy storage device 202 in more than one rotational orientation of portable electrical energy storage device 202 relative to the receptacle.

While the embodiments of FIGS. 12A-12C, 13A-13E and 14A-14D have been described with reference to specific locations of the positive terminals and negative terminals relative to the portable electrical energy storage device and the receptacle for the portable electrical energy storage device, in accordance with embodiments of the present disclosure, the locations of the positive electrical terminals and the negative electrical terminals relative to the portable electrical energy storage device and the receptacle for the portable electrical energy storage device can be reversed. For example, described arrangements of positive electric terminals and negative electric terminals on a portable electrical energy storage device can alternatively be provided on the receptacle for the portable electrical energy storage device and described arrangements of positive electric terminals and negative electric terminals on the receptacle can be provided on the portable electrical energy storage device.

Figure 15:
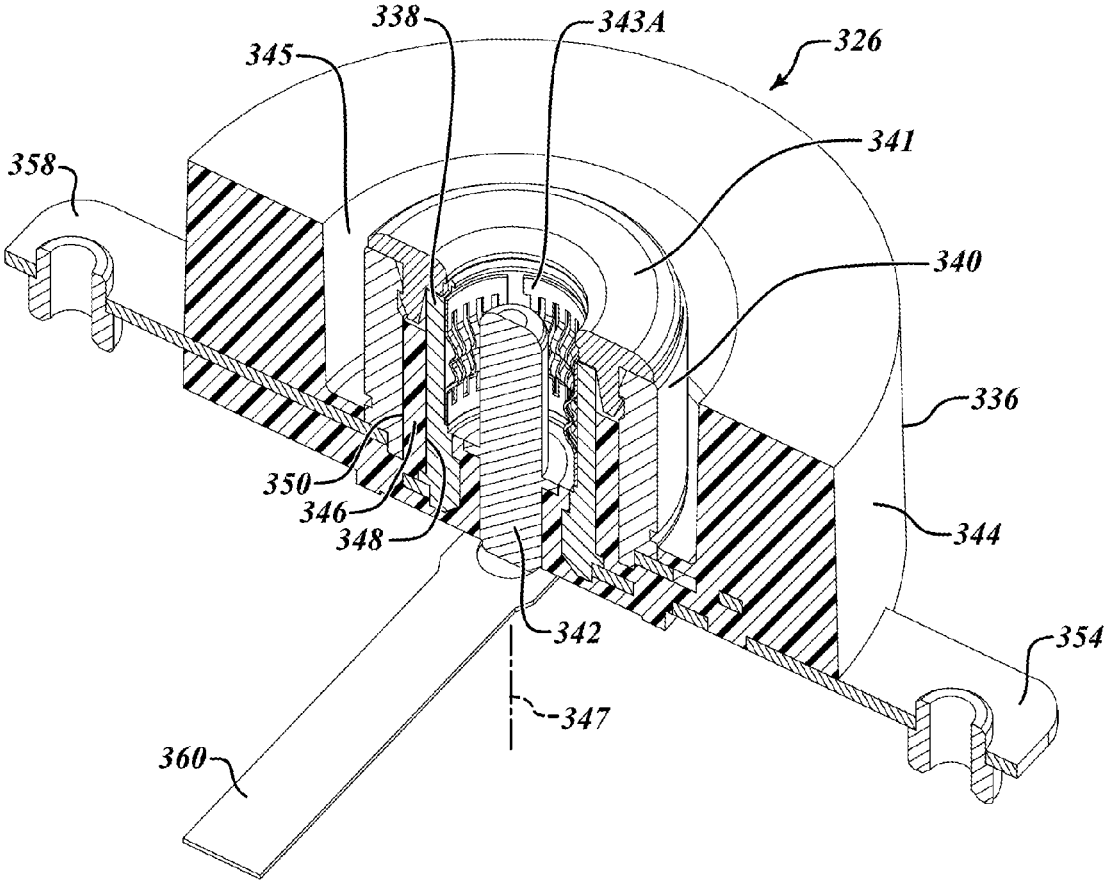
FIG. 15 is a cross-section view of an electrical connector base according to another non-limiting illustrated embodiment of the subject matter described herein taken along line 15A-15A in FIG. 16.
Figure 16:
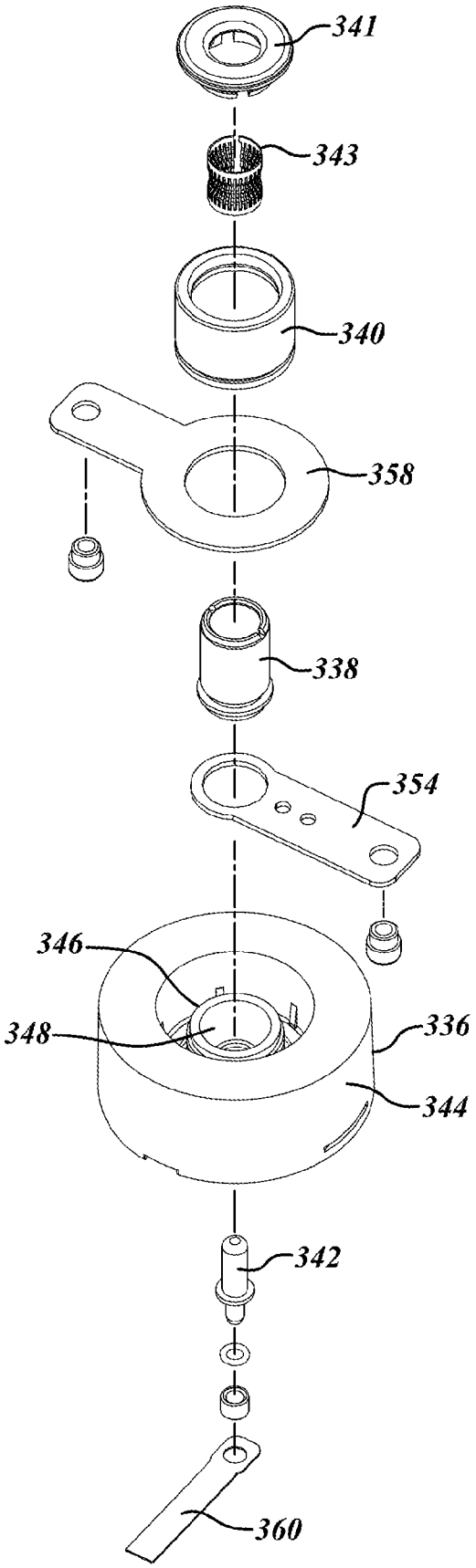
FIG. 16 is an exploded view of the electrical connector base illustrated in FIG. 15.

Details of another embodiment of the present disclosure are described below with reference to FIGS. 15-18, 19A-19C and 20-23. FIGS. 15-16 illustrate one exemplary embodiment of an electrical connector 326 electrically connected to a portable electrical energy storage device or to a device to be powered by or for charging the portable electrical energy storage device and an electrical connector plug 328 connected to a portable electrical energy storage device or to a device to be powered by or for charging the portable electrical energy storage device that is not connected to the electrical connector 326. Electrical connector 326 in the illustrated exemplary embodiment includes an electrically nonconductive connector base 336, a first electrically conductive terminal 338, a second electrically conductive terminal 340, an electrical connection test terminal 342 and a resilient electrically conductive connector 343.

Electrically nonconductive connector base 336 includes a connector base outer wall 344. In the illustrated exemplary embodiment of FIGS. 15 and 16, 19A-19C and 20, electrically nonconductive connector base 336 is circular in shape when viewed along its longitudinal axis 347. The electrically nonconductive connector base 336 including connector base outer wall 344 is formed of a nonconductive material, such as plastic. Conventional techniques such as extrusion or injection molding can be used to form nonconductive connector base 336 and connector base outer wall 344. Electrically nonconductive connector base 336 further includes an annular shaped electrical contact housing 346 that includes an inner surface 348 and an outer surface 350. Electrical contact housing 346 is formed out of an electrically nonconductive material, such as an electrically nonconductive plastic. In the illustrated embodiment, the electrical contact housing 346 is integral with the electrically nonconductive connector base 336. Thus, in the illustrated embodiment, electrically nonconductive connector base 336 including connector base outer wall 344 and electrical contact housing 346 is an integral element; however, electrically nonconductive connector base 336 need not be an integral element, for example, conductive base outer wall 344 and electrical contact housing 346 can be formed separately and attached to each other. In the exemplary embodiment illustrated in FIG. 15, annular shaped electrical contact housing 346 is a round when viewed in cross-section along longitudinal axis 347. Annular shaped electrical contact housing 346 can be polygonal shaped and not round when viewed in cross-section along longitudinal axis 347. For example, electrical contact housing 346 can have the shape of a rectangle, pentagon, hexagon, heptagon, octagon or other polygon with more than eight sides. Inner surface 348 of the electrical contact housing 346 is located closer to longitudinal axis 347 than outer surface 350 of the electrical contact housing 346. Outer surface 350 of the electrical contact housing 346 is separated from connector base inner wall 345 by an electrically nonconductive medium, such as air or other electrically nonconductive medium, such as a nonconductive plastic.

Figure 17:
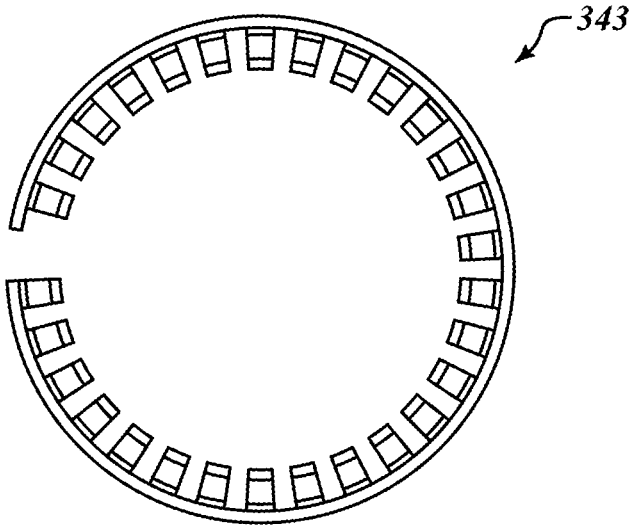
FIG. 17 is a top view of a crown spring connector according to a non-limiting embodiment of the subject matter described herein.
Figure 18:
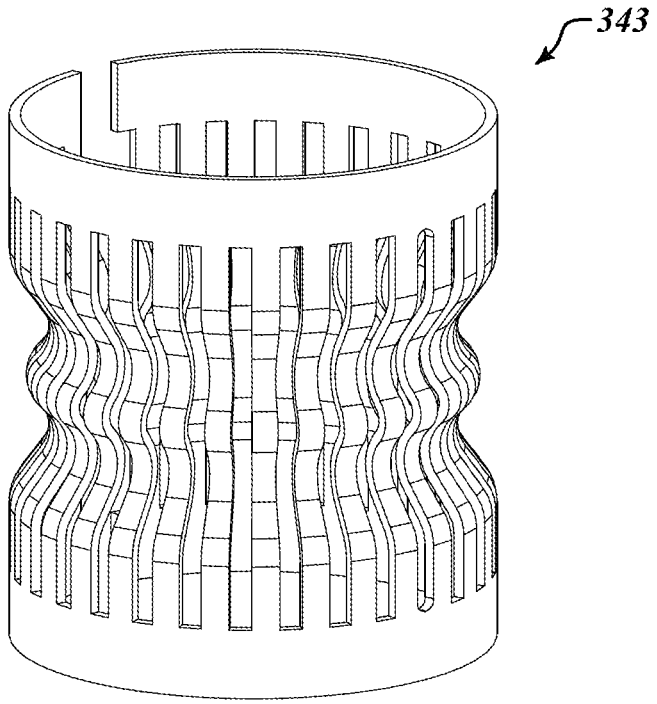
FIG. 18 is a perspective view of the crown spring connector of FIG. 17.

Inner surface 348 of electrical contact housing 346 includes first electrically conductive terminal 338. In the illustrated exemplary embodiment, first electrically conductive terminal 338 is a ring-shaped member conforming to the shape of the inner surface 348 of the electrical contact housing 346. First electrically conductive terminal 338 is in electrical contact with a resilient connector 343A. Resilient connector 343A is a spring-like member that can be compressed in a lateral direction perpendicular to longitudinal axis 347. The compressive characteristic of the described resilient connectors allows electrical connector plug 328 to be inserted into electrical connector 326 and achieving low resistance, electrical connection between first electrical terminal 338 and electrical terminal 364 of electrical connector plug 328. Resilient connector 343A is electrically conductive and of low electrical resistance. In addition, resilient connector 343A is resistant to corrosion or other degradation that could negatively affect its electrical conductivity and/or electrical resistance. In the illustrated embodiment, resilient connector 343A is illustrated as what is known as a crown spring connector. While an embodiment of a resilient connector has been illustrated with reference to a crown spring connector, resilient connectors which are not crown spring connectors are included in embodiments of the resilient connectors described herein. One exemplary embodiment of a resilient connector 343 is illustrated in FIGS. 17 and 18. In the illustrated embodiment, first electrically conductive terminal 338 is electrically connected at its base to a first terminal connector 354. First terminal connector 354 can be electrically connected to a portable electrical energy storage device or a device to be powered by or for charging the portable electrical energy storage device, thus providing an electrical connection between the portable electrical energy storage device or the device to be powered by or for charging the portable electrical energy storage device and the first electrically conductive terminal 338.

Outer surface 350 of electrical contact housing 346 includes a second electrical conductive terminal 340. In the illustrated exemplary embodiment, second electrical conductive terminal 340 is a ring-shaped member conforming to the shape of outer surface 350 of the electrical contact housing 346. In the exemplary embodiment illustrated in FIGS. 15 and 16, second electrically conductive terminal 340 is ring-shaped when viewed in cross-section along axis 347. Second electrically conductive terminal 340 is electrically connected at its base to a second terminal connector 358. Second terminal connector 358 can be electrically connected to a portable electrical energy storage device or a device to be powered by or for charging a portable electrical energy storage device, thus providing an electrical connection between the portable electrical energy storage device or the device to be powered by or for charging the portable electrical energy storage device and the second electrically conductive terminal 340. In order to avoid obscuring aspects of the subject matter described herein, details of how first terminal connector 354 and second terminal connector 358 are electrically connected to a portable electrical energy storage device or an electrically powered device are omitted. In the illustrated embodiment, tops of first electrically conductive terminal connector 338 and second electrically conductive terminal connector 340 are bridged by an electrically non-conductive cap 341.

In the exemplary embodiment illustrated in FIGS. 15 and 16, electrical connection test terminal 342 of electrical connector 326 is an electrically conductive member in the shape of a cylinder centered along longitudinal axis 347. Electrical connection test terminal 342 is positioned radially inward of first electrically conductive terminal 338. The upper surface of electrical connection test terminal 342 is recessed below the upper surfaces of conductive base outer wall 344, electrical contact housing 346, first electrically conductive terminal 338 and second electrically conductive terminal 340. Electrical connection test terminal 342 is electrically connected to connection test terminal connector 360. In the illustrated embodiment, electrical connection test terminal 342 is electrically connected to connection test terminal connector 360 at its bottom; however, electrical connection between electrical connection test terminal 342 and connection test terminal connector 360 need not be at the bottom of connection test terminal 342. Connection between connection test terminal 342 and electrical connection test terminal connector 360 can occur at different locations along the body of electrical connection test terminal 342.

Referring to FIGS. 19A-19C and 20, an exemplary electrical connector plug 328 in accordance with embodiments described herein is illustrated. Electrical connector plug 328 includes a nonconductive plug housing 362, a first electrical terminal 364 and a second electrical terminal 366. The first electrical terminal 364 and second electrical terminal 366 are sized and shaped to mate with the electrical connector 326 and its respective components. When mated, electrical connection is made between electrical connector 326 and electrical connector plug 328. In the illustrated embodiments, first electrical terminal 364 and second electric terminal are provided with resilient connector 343C and 343B respectively.

Nonconductive plug housing 362 includes a plug body 370 comprising an electrically nonconductive material, such as an electrically nonconductive plastic. Plug body 370 has a cylindrical shape and is centered along plug housing longitudinal axis 368. From one end of plug body 370 (the top end in FIG. 19A), first electrical terminal 364 and a second electrical terminal 366 protrude. First electrical terminal 364 and second electrical terminal 366 are formed out of an electrically conductive material, such as an electrically conductive metal. At the end of plug body 370 where first electrical terminal 364 and second electrical terminal 366 protrude, an annular terminal housing 372 protrudes from plug body 370 beyond the ends of first electrical terminal 364 and second electrical terminal 366. In the embodiment illustrated in FIG. 19A, annular terminal housing 372, when viewed along longitudinal axis 368, has a round shape; however, the shape of annular terminal housing is not limited to a round shape. For example, when the shape of the gap between outer surface 350 of electrical contact housing 346 and conductor-base inner wall 345 of connector 326 in FIG. 15 is something other than round, annular terminal housing 372 will have a complementary non-round shape. For example, if the shape of the gap between the outer surface 350 of the electrical contact housing 346 and conductor base inner wall 345 is square, annular terminal housing 372 will have a complementary square shape and will be sized to be received into that gap. One of the reasons the shapes are complementary is so annular terminal housing 372 can be received into the gap between outer surface of second electrical terminal 340 and inner surface 345 of electrical contact housing 346, thus allowing connector 326 and plug 328 to mate with each other.

At the end of annular terminal housing 372 adjacent nonconductive plug body 370 (the bottom end in FIG. 19A), first terminal connector 374 of first electrical terminal 364 and second terminal connector 375 of second electrical terminal 366 protrude from annular terminal housing 372. Alternatively, first terminal connector 374 and second terminal connector 375 do not protrude from annular terminal housing 372, but rather are accessible within terminal housing body 372. In FIG. 19B the interior of nonconductive plug body 370 is shown as being hollow. In accordance with other embodiments described herein, nonconductive plug body 370 is filled with a nonconductive material, such as a nonconductive plastic, and the first terminal connector 374 and second terminal connector 375 extend through and protrude from this nonconductive material at an end of the nonconductive plug body 370 that is opposite annular electrical terminal housing 372. First terminal connector 374 and second terminal connector 375 provide electrical connectors for making an electrical connection with first electrical terminal 364 and second electrical terminal 366. First terminal connector 374 and second terminal connector 375 are electrically connected to electrical cables 379 and 377 respectively. Cables 377 and 379 may be electrically connected to a portable electrical energy storage device or an electrically powered device.

Figure 19A:
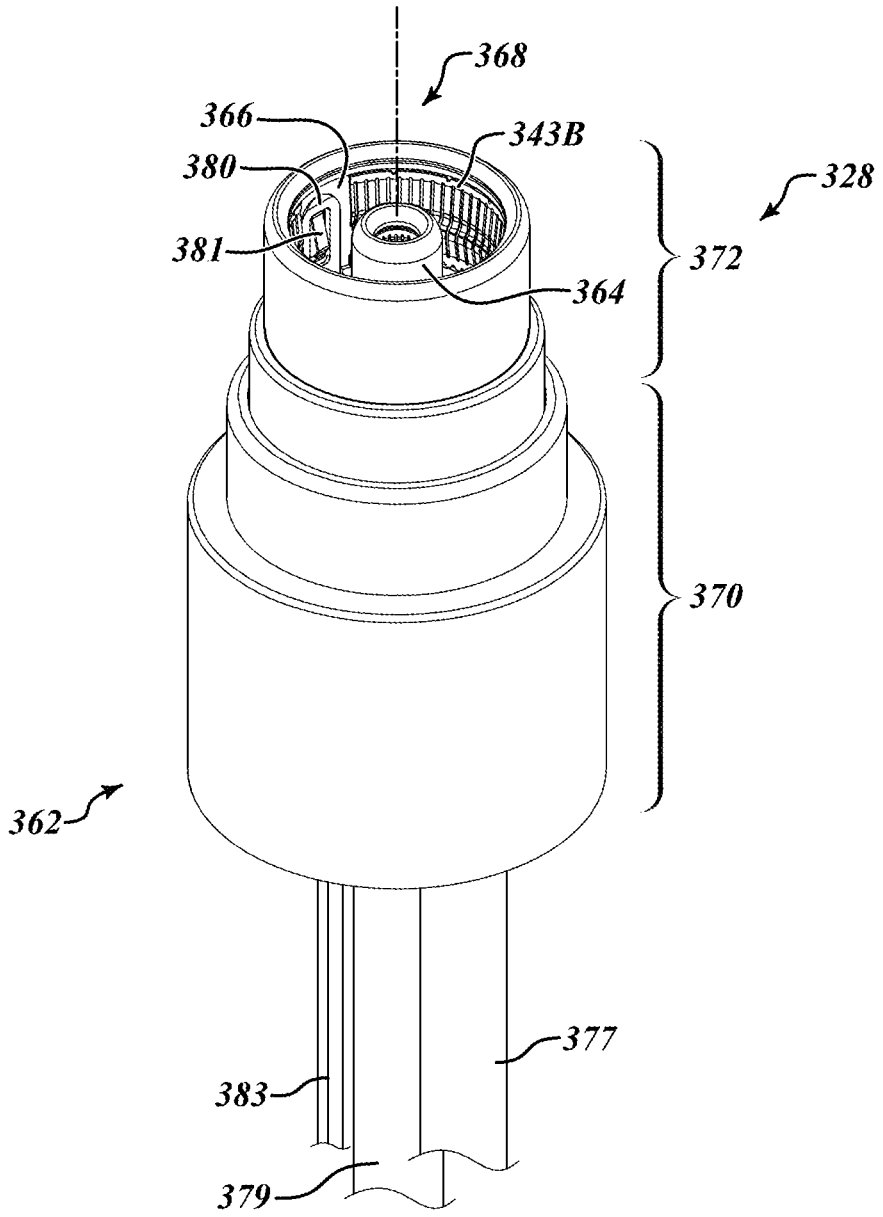
FIG. 19A is a perspective view of an electrical connector plug in accordance with another non-limiting illustrated embodiment of the subject matter described herein.
Figure 19B:
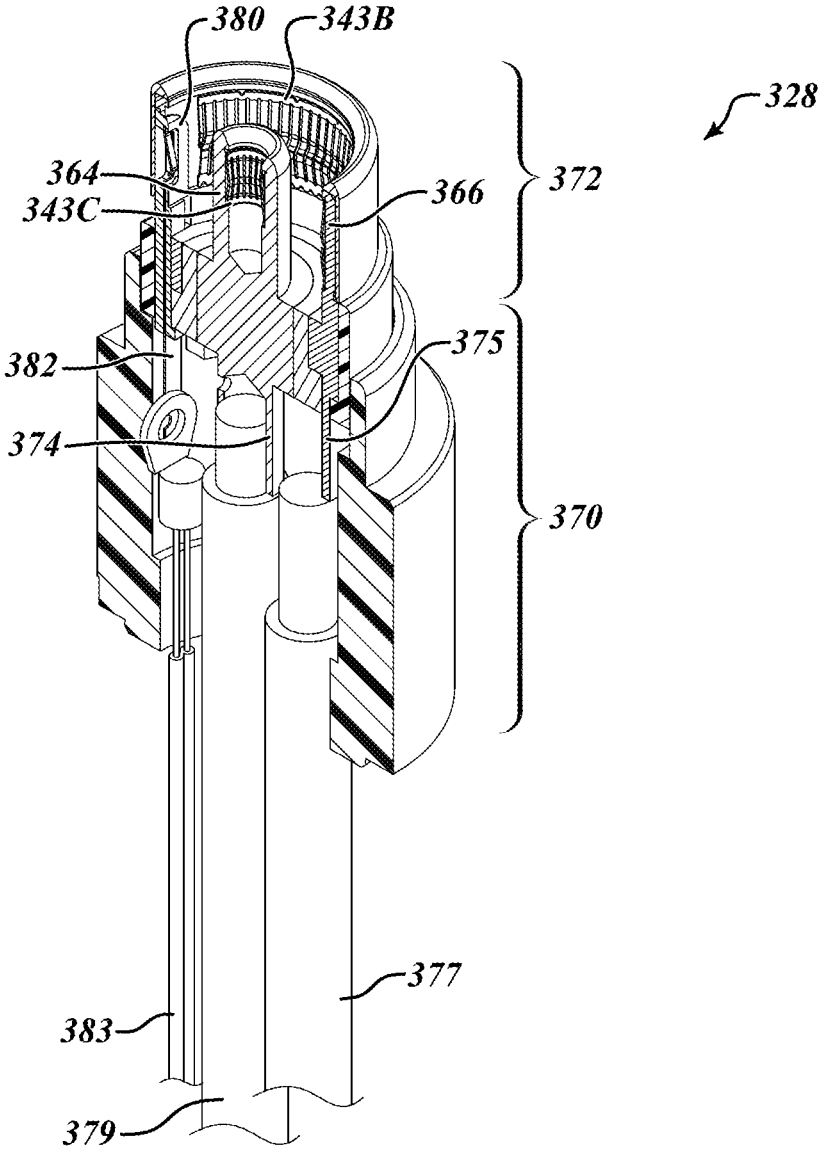
FIG. 19B is a cross-section view of the electrical connector plug illustrated in FIG. 19A taken along line 19B-19B in FIG. 19A.
Figure 19C:
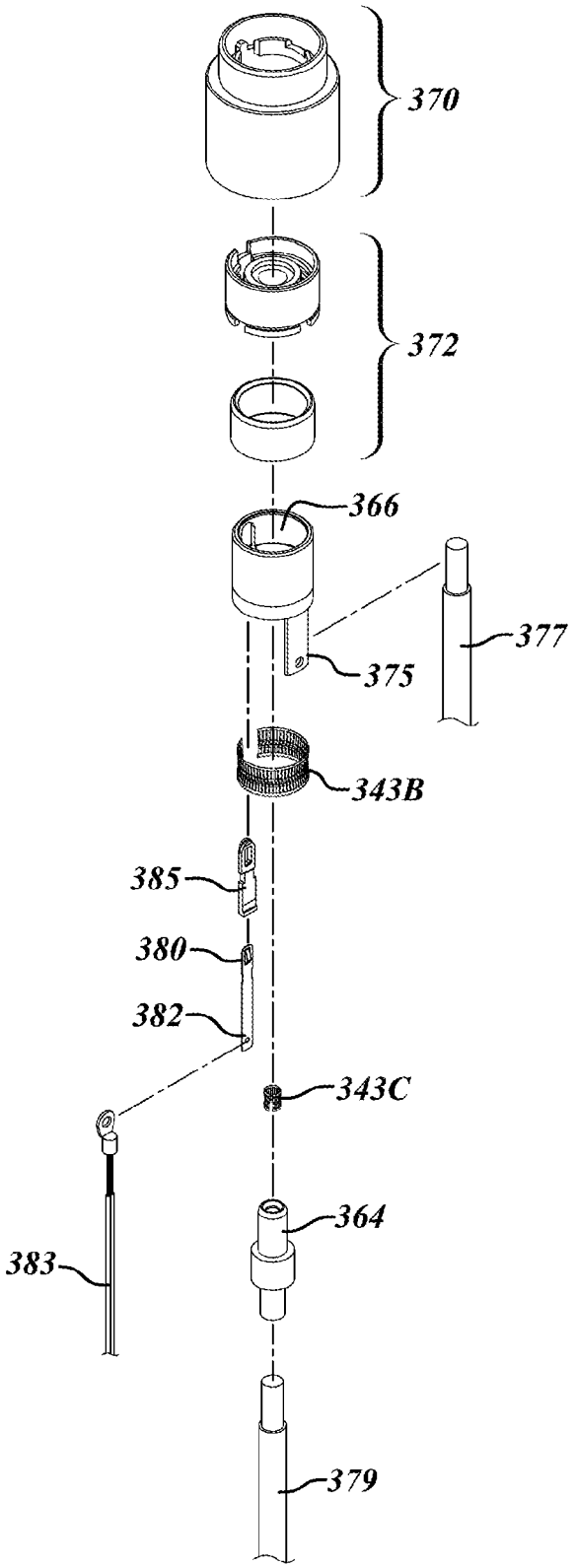
FIG. 19C is an exploded view of the electrical connector plug illustrated in FIG. 19A.

In the embodiment illustrated in FIGS. 19A-19C, first electrical terminal 364 is formed out of an electrically conductive material, such as a conductive metal. When viewed along longitudinal axis 368, first electrical terminal 364 has an annular round shape and includes a cylindrical bore centered on longitudinal axis 368 that passes through first electrical terminal 364. First electrical terminal 364 is in electrical contact with a resilient connector 343C. Resilient connector 343C is a spring-like member that can be compressed in a lateral direction perpendicular to longitudinal axis 368. Resilient connector 343C is similar to resilient connector 343A described above. Resilient connector 343C is smaller in diameter and length than resilient connector 343A. The compressive characteristic of the described resilient connector 343C allows test connection terminal 342 to be inserted into electrical connector plug 328 and achieve low resistance, electrical connection between test connection terminal 342 and first electrical terminal 364 of electrical connector plug 328. One exemplary embodiment of a resilient connector 343 is illustrated in FIGS. 17 and 18. First electrical terminal 364 may have a shape other than the illustrated round shape, for example, first electrical terminal 364 can have a square shape when viewed along longitudinal axis 368 or it can have a polygon shape other than a square, for example, a triangle, rectangle, pentagon, hexagon, octagon, or a polygon having more than eight sides. Preferably, first electrical terminal 364 has a shape that complements the shape of the electrical contact housing 346 of electrical connector 326 in FIG. 15. When the shape of first electrical terminal 364 complements the shape of the electrical contact housing 346 (e.g., the shape of first electrical terminal 364 and the shape of electrical contact housing 346 are related in a male plug/female receptacle relationship), first electrical connection terminal 364 can be received in electrical contact housing 346 and the two are able to mate with each other.

In the exemplary embodiment illustrated in FIGS. 19A-19C, an inner surface of annular electrical terminal housing 372 includes a second electrical connection terminal 366. Second electrical terminal 366 is formed out of an electrically conductive material, such as an electrically conductive metal. As illustrated in FIG. 19C, second electrical terminal 366 is round when viewed in cross-section perpendicular to central axis 368. While the exemplary embodiment of FIGS. 19A-19C illustrate a round second electrical terminal 366, second electrical terminal 366 is in electrical contact with a resilient connector 343B. Resilient connector 343B is a spring-like member that can be compressed in a lateral direction perpendicular to longitudinal axis 347. Resilient connector 343B is similar to resilient connector 343A and 343C described above. Resilient connector 343B is larger in diameter and length than resilient connectors 343A and 343C. The compressive characteristic of the described resilient connector 343B allows connector plug 328 to be inserted into electrical connector 326 and achieve low resistance, electrical connection between electrical terminal 340 and second terminal 366. One exemplary embodiment of a resilient connector 343 is illustrated in FIGS. 17 and 18.

Second electrical terminal 366 may have a shape other than the illustrated round shape, for example, second electrical terminal 366 can have a square shape when viewed along longitudinal axis 368 or it can have a polygon shape other than a square, for example, a triangle, rectangle, pentagon, hexagon, octagon, or a polygon having more than eight sides. Preferably, second electrical terminal 366 has a shape that complements the shape of the gap between inner wall 345 of non-conductive connector base 336 and the outer surface of second electrical connector 340 in FIG. 15. In the embodiment illustrated in FIG. 19A-19C, first electrical terminal 364 and second electrical terminal 366 extend through the end of electrical terminal housing 372 adjacent nonconductive plug body 370. Located adjacent inner surface of annular electrical terminal housing 372 is a connection test terminal 380. Connection test terminal 380 is an electrically conductive material such as an electrically conductive metal. In the embodiment illustrated in FIGS. 19A-19C, connection test terminal 380 extends from an end of annular electrical terminal housing 372 adjacent nonconductive plug body 370. This protruding end of connection test terminal 380 provides an electrical connector 382 for making an electrical connection between electric cable 383 and connection test terminal 380. In the illustrated embodiment, connection test terminal 380 includes a biased tab 381. Connection test terminal 380 and biased tab 381 are described in more detail below with reference to FIGS. 21-23.

Figure 21:
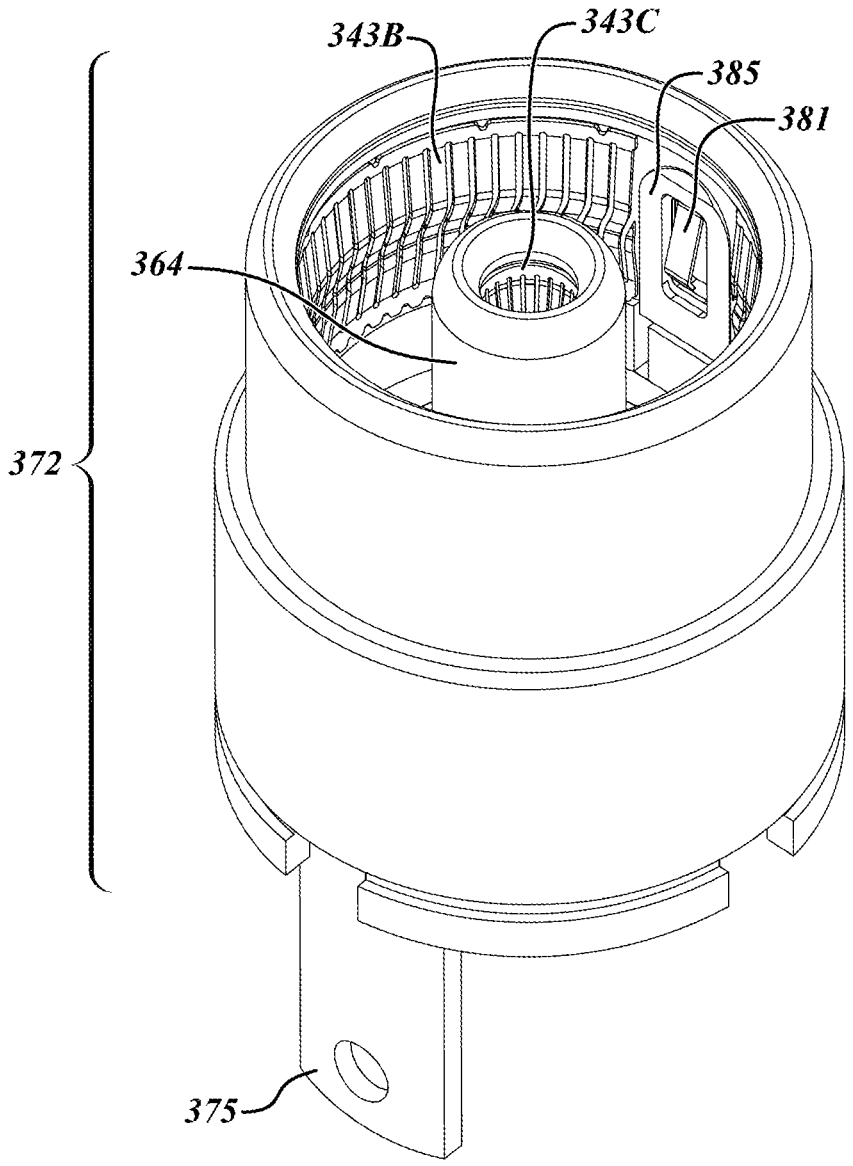
FIG. 21 is an enlarged view of a portion of the electrical connector plug illustrated in FIG. 19A.
Figure 22:
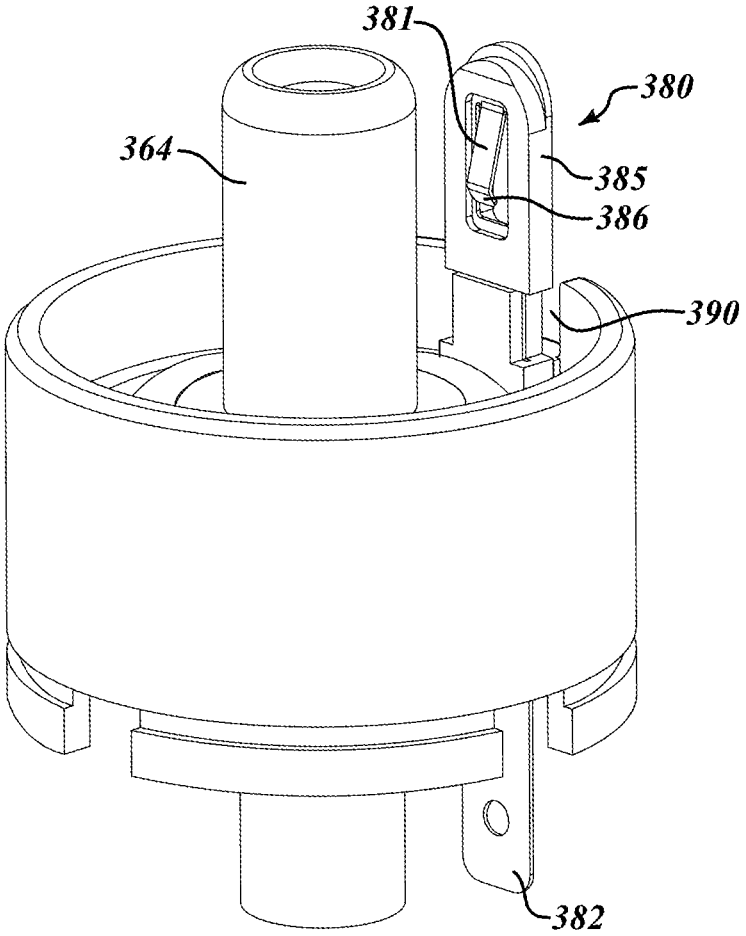
FIG. 22 is an enlarged view of a portion of the electrical connector plug illustrated in FIGS. 19A and 21 with a portion removed to better illustrate features of the illustrated embodiment.
Figure 23:
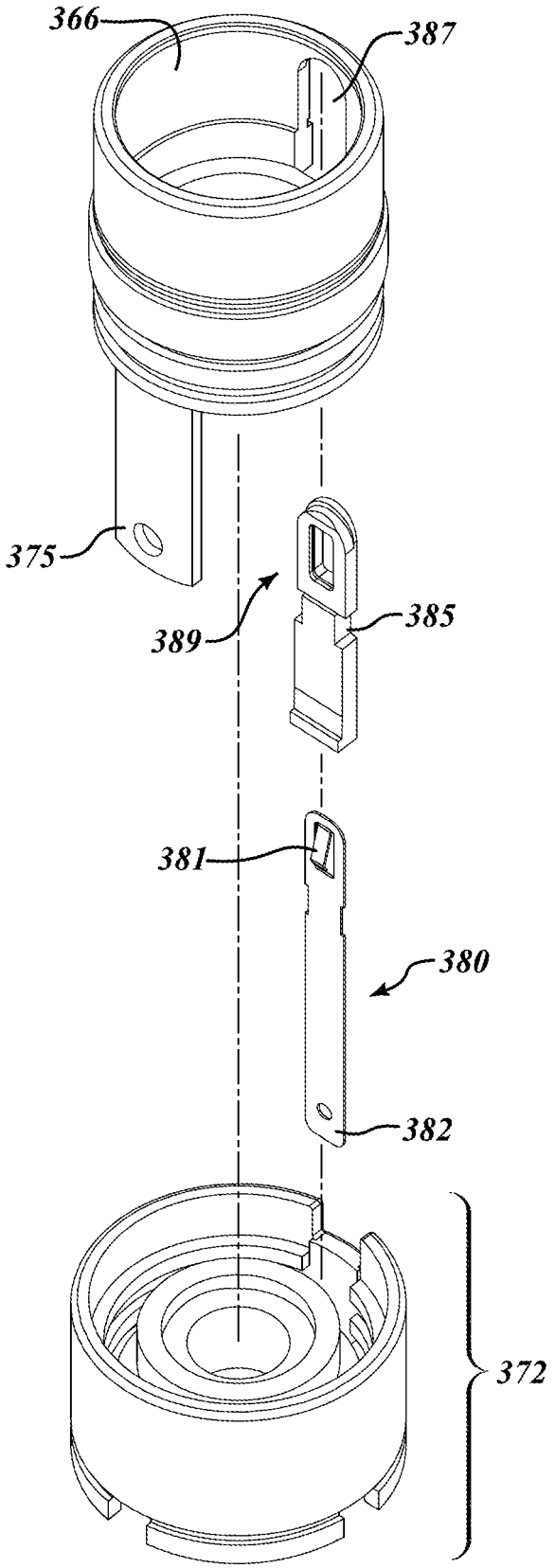
FIG. 23 is an exploded view of a portion of the electrical connector plug illustrated in FIG. 22.

In the embodiment illustrated in FIGS. 21-23 another embodiment of a connection test terminal is shown. The embodiment illustrated in FIGS. 21-23 includes connection test terminal 380 and connection test terminal housing 385. Connection test terminal 380 is an elongate conductive metal strip. At one end of connection test terminal 380 is located a connection test terminal tab 381 and disconnect bearing surface 386. At the opposite end of connection test terminal 380 is connection terminal 382. Connection test terminal tab 381 is a resilient member biased in a direction towards longitudinal axis 368 of connector plug 328. Connection test terminal tab 381 is a resilient, electrically conductive material such as an electrically conductive metal. In the illustrated embodiment, connection test terminal tab 381 is formed by removing a portion of the metal strip around three sides of connection test terminal tab 381 while not removing metal along one short edge of the metal strip. Bending the connection test terminal tab 381 along the portion of the metal strip that has not been removed and towards the longitudinal axis 368 causes connection test terminal tab 381 to be biased in an inward direction. In the illustrated embodiment, below connection test terminal tab 381, test connection terminal 380 includes a disconnect bearing surface 386. In the illustrated embodiment, disconnect bearing surface 386 is provided by an additional strip of metal bent outward slightly to form a surface that preferably does not snag or catch on outer surface 340 of electrical connector 326 when electrical connector plug 328 is disengaged from electrical connector 326. In the illustrated embodiment, the metal strip forming disconnect bearing surface 386 is bent at approximately 10 to 45 degrees relative to connection test terminal tab 381. The resiliency and bias of test connection terminal 380 serves to maintain test connection terminal 380 in contact with outer surface 340 of electrical connector 326. The bearing surface of connection test terminal tab 381 causes test connection terminal 380 to be pushed away from longitudinal axis 368 when electrical connection plug is inserted into electrical connector 326.

Connection test terminal tab 381 in the illustrated embodiment is housed within a connection test terminal housing 385. Connection test terminal housing 385 is formed from a non-conductive material, such as plastic and is received into a cut out 387 formed in second electrical terminal 366. Cut out 387 is sized to meet him closely with connection test terminal housing 385. By positioning connection test terminal 380 within connection test terminal housing 385, connection test terminal 380 is electrically isolated from second conductive terminal 366. Connection test terminal housing 385 includes a cut out 389 sized to allow connection test terminal tab 381 to be exposed when connection test terminal 380 is positioned within connection test terminal housing 385. Annular terminal housing 372 also includes a void 390 sized and shaped to receive and retain connection test terminal housing 385. FIG. 21-23 illustrate an exemplary embodiment of the connection test terminal housing 385; however, it is understood that connection test terminals of different sizes are also encompassed by the embodiments described herein.

First terminal connector 374 and second terminal connector 375 provide electrical connection points for connecting first electrical terminal 364 and second electrical terminal 366 to a portable electrical energy storage device or to a device to be powered by or for charging the portable electrical energy storage device.

Figure 20:
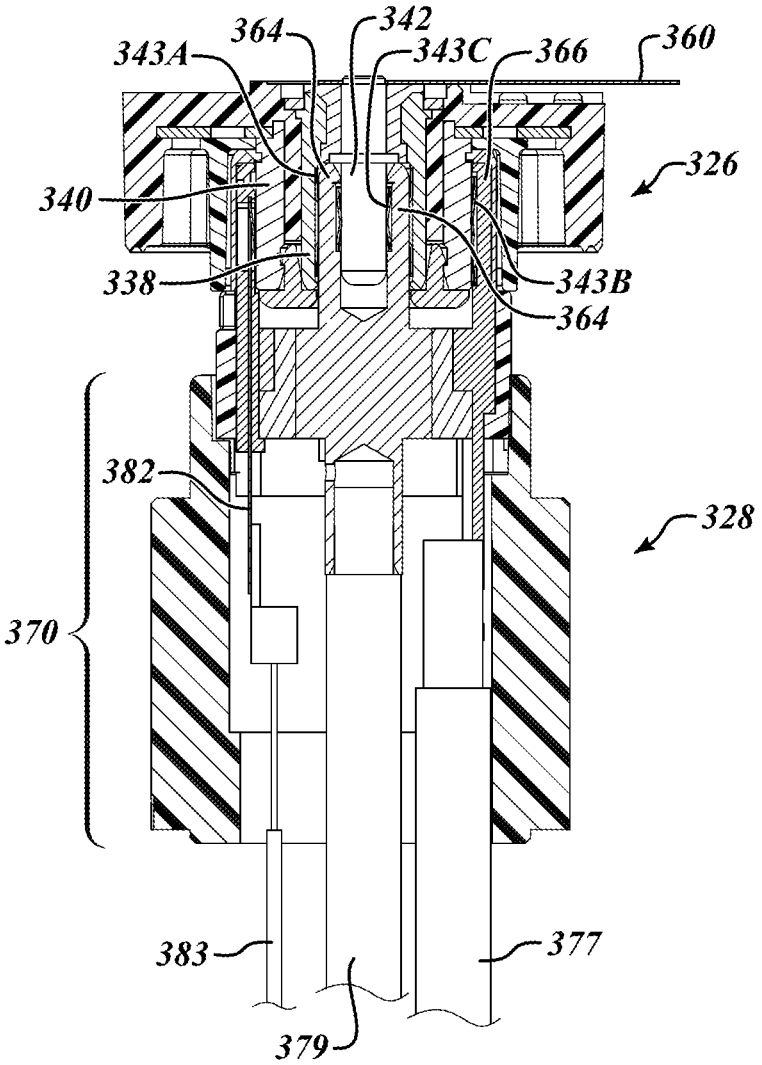
FIG. 20 is a cross-section of the electrical connector base illustrated in FIG. 19A and the electrical connector plug illustrated in FIG. 15 in a mated configuration.

Referring to FIG. 20, electrical connector 326 of FIGS. 15 and 16 and electrical connector plug 328 of FIGS. 19A-19C are illustrated in a mated configuration. In this mated configuration, first electrical terminal 338 of electrical connector 326 makes electrical contact with first electrical terminal 364 of the electrical connector plug 328 via resilient connector 343A located intermediate first electrical terminal 338 and first electrical terminal 364. Second electrical terminal 340 of electrical connector 326 makes electrical contact with second electrical terminal 366 of electrical connector plug 328 via resilient connector 343B located intermediate second electrical terminal 340 and second electric terminal 366. As a result, a portable electrical energy storage device or a device to be powered by or for charging such portable electrical energy storage device that is connected to electrical connector 326 is electrically connected to a portable electrical energy storage device or a device to be powered by or for charging such portable electrical energy storage device that is connected to electrical connector plug 328.

In a manner similar to that described with reference to FIG. 8, the size and shape of electrical connector 326 and the complementary size and shape of electrical connector plug 328 permit a user to insert a battery pack into a battery pack receptacle in a plurality of rotational orientations relative to each other, while establishing a useful and safe electrical connection between the electrical connector 326 and the electrical connector plug 328.

As seen in FIG. 20, when electrical connector 326 is mated with electrical connector plug 328, electrical connection test terminal 342 of electrical connector 326 makes electrical contact with first electrical terminal 364 of electrical connector plug 328. When electrical connector 326 is mated with electrical connector plug 328, electrical connection test terminal 380 of electrical connector plug 328 makes electrical contact with second electrical terminal 340 of electrical connector 326. Electrical connection test terminal 380 is electrically connected to one terminal of a voltage sensor (not shown) via electrical connector 382 for connection test terminal 380. When electrical connector 326 is mated with electrical connector plug 328, electrical connection test terminal 342 of electrical connector 326 makes electrical contact with first electrical terminal 364 of electrical connector plug 328. Electrical connection test terminal 342 of electrical connector plug 328 is electrically connected to another terminal of the voltage sensor (not shown) via electrical connection test terminal connector 360 for connection test terminal 342. When electrical connection test terminal 380 contacts second electrical terminal 340 and electrical connection test terminal 342 contacts first electrical terminal 364, electrical connection test terminal 380 will be at the same voltage as second electrical terminal 340 and electrical connection test terminal 342 will be at the same voltage as first electrical terminal 364. The voltage sensor is configured to detect the voltage between electrical connection test terminal 380 and electrical connection test terminal 342. Comparison of this detected voltage to the voltage of the portable electrical energy storage device to which electrical connector 326 or electrical connector plug 328 are connected provides an indication of whether an electrical contact has been established between first electrical terminal 364 of electrical connector plug 328 and first electrical terminal 338 of electrical connector 326 and second electrical terminal 366 of electrical connector plug 328 and second electrical terminal 340 of electrical connector 326. Electrical connection between these terminals will be indicated by the voltage detected by the voltage sensor being substantially equal to the voltage of the portable electrical energy storage device. The configuration of an independent electrical connection test terminal 380 illustrated in FIGS. 19A-C and 21-23 can also be implemented in the electrical connection system described with reference to FIGS. 1-14. For example an independent connection test terminal can be provided in electrical connector plug 20.

An advantage of an electrical connection system including the electrical connector and electrical connection plug in accordance with embodiments described herein is the ability to establish an electrical connection between a portable electrical energy storage device and a device to be powered by or for charging the portable electrical energy storage device in a plurality of rotational orientations and, in the embodiments of FIGS. 1-8 and FIGS. 15-23, an infinite number of rotational orientations. In accordance with embodiments described herein, a multidirectional or omni-directional electrical connection system is provided whereby electrical connection between an electrical connector and an electrical connection plug can be established in a plurality of rotational orientations and in some cases in an infinite number of rotational orientations. The ability to make electrical connections in a plurality or infinite number of rotational orientations reduces the likelihood of a faulty electrical connection due to a user inserting a battery pack into a battery pack receptacle in an improper rotational orientation. Electrical connections between a device including an electrical connector and a device including an electrical connector plug in accordance with embodiments described herein can be made when the devices are mated with each other in a plurality of rotational orientations. The ability to make electrical connections in a plurality of rotational orientations has other advantages, such as reducing the likelihood that damage will be done to the electrical connector or electrical connector plug due to the portable electrical energy storage device being inserted into the receptacle in an orientation in which an electrical connection cannot be made between the electrical connector and electrical connection plug or an orientation in which the electrical connector and electrical connection plug cannot mate physically with each other.

In addition, in accordance with embodiments described herein electrical connections made between a device including an electrical connector and different device including an electrical connector plug in accordance with embodiments described herein can do so repeatedly without a significant change in the resistance of the connection that could adversely affect electrical energy delivery from the portable electrical energy storage device and/or charging of the portable electrical energy storage device. In addition, electrical connections provided between a device including an electrical connector and different device including an electrical connector plug in accordance with embodiments described herein are made with low resistance to electrical power discharge or delivery to the portable electrical energy storage device.

In accordance with additional embodiments of the subject matter described herein, multidirectional electrical connection systems capable of establishing an electrical connection between a portable electrical energy storage device and a device to be powered by or for charging the portable electrical energy storage device in a plurality of rotational orientations include electrical terminal patterns such as those illustrated in FIGS. 12-14.

The headings and Abstract of the Disclosure provided herein are for convenience only and do not interpret the scope or meaning of the embodiments.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A connector for making electrical connection between a portable electrical energy storage device electrically connected to the connector or an electric powered device electrically connected to the connector and a plug electrically connected to an electric powered device or a portable electrical energy storage device that is not electrically connected to the connector, the connector comprising:

a. an electrically nonconductive connector base having a connector central axis;

b. an electrical contact housing including an outer sidewall extending in a direction parallel to the connector central axis and an inner sidewall extending in a direction parallel to the connector central axis, the inner sidewall located closer to the connector central axis than the outer sidewall, the electrical contact housing centered on the connector central axis;

c. a first terminal including at least two electrically conductive contact pads located adjacent the inner sidewall of the electrical contact housing; and d. a second terminal including at least one electrically conductive contact pad located adjacent the outer sidewall of the electrical contact housing.

2. The connector of claim 1, further comprising a connection test terminal located closer to the connector central axis than the first terminal and configured to be electrically connected to the first terminal when the connector is electrically connected to the plug.

3. The connector of claim 1, wherein the outer sidewall and the inner sidewall are concentric.

4. The connector of claim 1, wherein the at least two electrically conductive contact pads of the first terminal and the at least one electrically conductive pad of the second terminal are concentric.

5. The connector of claim 1, wherein the connector is configured to mate with the plug in two or more orientations and make an electrical connection to the plug in each of the two or more orientations, the two or more orientations corresponding to different positions of the connector relative to the plug, each different position of the connector relative to the plug corresponding to different rotational positions of the connector relative to the connector central axis.

6. The connector of claim 5, wherein the two or more orientations are three or more orientations.

7. The connector of claim 1, wherein a periphery of the electrical contact housing lies in a plane perpendicular to the connector central axis, the periphery defining a quadrilateral with opposing angles that are equal.

8. The connector of claim 7, wherein the quadrilateral includes adjacent sides, the adjacent sides being equal in length.

9. The connector of claim 1, wherein the outer sidewall of the electrical contact housing comprises four outer sidewalls, each outer sidewall arranged perpendicular to adjacent outer sidewalls and extending parallel to the connector central axis, and the inner sidewall of the electrical contact housing comprises four inner sidewalls, each inner sidewall arranged perpendicular to adjacent inner sidewalls and extending parallel to the connector central axis, the four inner sidewalls located closer to a connector base axis than the four outer sidewalls.

10. The connector of claim 9, wherein the at least two electrically conductive contact pads of the first terminal comprise four electrically conductive contact pads, one electrically conductive contact pad of the first terminal located adjacent each of the four inner sidewalls of the electrical contact housing.

11. The connector of claim 9, wherein the at least one electrically conductive contact pad of the second terminal comprises four electrically conductive contact pads, one electrically conductive contact pad of the second terminal located adjacent each of the four outer sidewalls of the electrical contact housing.

12. A plug for making electrical connection between an electric powered device electrically connected to the plug or a portable electrical energy storage device electrically connected to the plug and a connector electrically connected to an electric powered device or a portable electrical energy storage device that is not electrically connected to the plug, the plug comprising:

a. an electrical plug housing including a plug end, a terminal end and a plug housing central axis, the plug end located at an end of the electrical plug housing that is opposite an end of the electrical plug housing where the terminal end is located;

b. a first terminal located at the plug end and including at least two electrically conductive contact pads, each contact pad of the first terminal extending parallel to the plug housing central axis and positioned around the plug housing central axis; and c. a second terminal located at the plug end and including at least two electrically conductive contact pads, each contact pad of the second terminal extending parallel to the plug housing central axis and positioned around the plug housing central axis, the first terminal of the plug located closer to the plug housing central axis than the second terminal of the plug, each contact pad of the first terminal separated from the contact pads of the second terminal by an electrically nonconductive medium.

13. The plug of claim 12, further comprising a connection test terminal located at the plug end further from the plug housing central axis than the contact pads of the first plug terminal, the connection test terminal configured to be electrically connected to the connector when the connector mates with the plug.

14. The plug of claim 12, wherein the at least two contact pads of the first terminal and the contact pads of the second terminal are concentric.

15. The plug of claim 12, wherein the at least two contact pads of the first terminal are three contact pads.

16. The plug of claim 12, wherein the plug is configured to mate with the connector when the connector is in one of two or more orientations and the plug is configured to make an electrical connection to the connector in each of the two or more orientations, each of the connector's two or more orientations corresponding to a different position of the connector relative to the plug, each different position of the connector relative to the plug achieved by rotating the connector around the plug housing central axis.

17. The plug of claim 16, wherein the two or more orientations are three or more orientations.

18. A system for electrically connecting a portable electrical energy storage device to an electrically powered device, the system comprising a connector including:

a. an electrically nonconductive connector base, the electrically nonconductive connector base including a connector central axis;

b. an electrical contact housing including an outer sidewall extending in a direction parallel to the connector central axis and an inner sidewall extending in a direction parallel to the connector central axis, the inner sidewall located closer to the connector central axis than the outer sidewall, the electrical contact housing centered on the connector central axis;

c. a first connector terminal including at least one electrically conductive contact surface located adjacent the inner sidewall of the electrical contact housing;

d. a second connector terminal including at least one electrically conductive contact surface located adjacent the outer sidewall of the electrical contact housing; and e. a plug including:

f. an electrical plug housing including a plug end, a terminal end and a plug housing central axis, the plug end located at an end of the electrical plug housing that is opposite an end of the electrical plug housing where the terminal end is located;

g. a first plug terminal located at the plug end and including at least one electrically conductive contact pad, the at least one contact pad of the first plug terminal extending parallel to the plug housing central axis and positioned around the plug housing central axis; and h. a second plug terminal located at the plug end and including at least one electrically conductive contact pad, the at least one contact pad of the second plug terminal extending parallel to the plug housing central axis and positioned around the plug housing central axis, the first plug terminal located closer to the plug housing central axis than the second plug terminal and the at least one contact pad of the first plug terminal separated from the at least one contact pad of the second plug terminal by an electrically nonconductive medium.

19. The system of claim 18, wherein the connector is configured to mate with the plug in two or more orientations and make an electrical connection to the plug in each of the two or more orientations, each of the two or more orientations corresponding to a different position of the connector relative to the plug, each different position achieved by rotating the connector around the connector central axis.

20. The system of claim 18, wherein the outer sidewall of the electrical contact housing and the inner sidewall of the electrical contact housing are concentric.

21. The system of claim 18, wherein the at least one electrically conductive contact surface of the first connector terminal and the at least one electrically conductive contact surface of the second connector terminal are concentric.

22. The system of claim 18, wherein the connector further comprises a connection test terminal located closer to the connector central axis than the first connector terminal and configured to be electrically connected to the first plug terminal when the connector is mated with the plug.

23. The system of claim 18, wherein the plug is configured to mate with the connector when the connector is in one of two or more orientations and the plug is configured to make an electrical connection to the connector in each of the two or more orientations, each of the connector's two or more orientations corresponding to a different position of the connector relative to the plug, each different position of the connector relative to the plug achieved by rotating the connector around the plug housing central axis.

24. A connector for making electrical connection between a portable electrical energy storage device electrically connected to the connector or an electric powered device electrically connected to the connector and a plug electrically connected to an electric powered device or a portable electrical energy storage device that is not electrically connected to the connector, the connector comprising:

a. an electrically nonconductive connector base having a connector central axis;

b. an electrical contact housing including an outer sidewall extending in a direction parallel to the connector central axis and an inner sidewall extending in a direction parallel to the connector central axis, the inner sidewall located closer to the connector central axis than the outer sidewall, the electrical contact housing centered on the connector central axis;

c. a first terminal including at least one electrically conductive contact pad located adjacent the inner sidewall of the electrical contact housing;

d. a second terminal including at least one electrically conductive contact pad located adjacent the outer sidewall of the electrical contact housing;

e. a resilient electrically conductive connector adjacent the second terminal.

25. A plug for making electrical connection between an electric powered device electrically connected to the plug or a portable electrical energy storage device electrically connected to the plug and a connector electrically connected to an electric powered device or a portable electrical energy storage device that is not electrically connected to the plug, the plug comprising:

a. an electrical plug housing including a plug end, a terminal end and a plug housing central axis, the plug end located at an end of the electrical plug housing that is opposite an end of the electrical plug housing where the terminal end is located;

b. a first terminal located at the plug end and including at least one electrically conductive contact pad, the at least one contact pad of the first terminal extending parallel to the plug housing central axis and positioned around the plug housing central axis;

c. a second terminal located at the plug end and including at least one electrically conductive contact pad, the at least one contact pad of the second terminal extending parallel to the plug housing central axis and positioned around the plug housing central axis, the first terminal of the plug located closer to the plug housing central axis than the second terminal of the plug, the at least one contact pad of the first terminal separated from the at least one pad of the second terminal by an electrically nonconductive medium;

d. a resilient electrically conductive connector adjacent the first terminal; and e. a resilient electrically conductive connector adjacent the second terminal.

* * * * *